US006855488B2

(12) United States Patent
Yamada et al.

(10) Patent No.: US 6,855,488 B2
(45) Date of Patent: Feb. 15, 2005

(54) SILVER HALIDE PHOTOSENSITIVE MATERIAL

(75) Inventors: Kohzaburch Yamada, Minami-Ashigara (JP); Naoki Asanuma, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/359,624

(22) Filed: Feb. 7, 2003

(65) Prior Publication Data

US 2003/0203329 A1 Oct. 30, 2003

(30) Foreign Application Priority Data

Feb. 8, 2002 (JP) ..... 2002-032491
Jul. 5, 2002 (JP) ..... 2002-197792

(51) Int. Cl.[7] ..... G03C 1/295; G03C 1/10; G03C 1/42

(52) U.S. Cl. ..... 430/566; 430/599; 430/600; 430/603; 430/955

(58) Field of Search ..... 430/566, 599, 430/600, 603, 955

(56) References Cited

U.S. PATENT DOCUMENTS 5,747,235 A 5/1998 Farid et al.
5,747,236 A 5/1998 Farid et al.
5,994,051 A 11/1999 Gould et al.
6,054,260 A 4/2000 Adin et al.
6,153,371 A * 11/2000 Farid et al. ..... 430/600
6,514,683 B2 * 2/2003 Muenter et al. ..... 430/600
6,593,075 B1 * 7/2003 Ichikawa et al. ..... 430/600
2003/0207221 A1 * 11/2003 Yamada et al. ..... 430/600

* cited by examiner

*Primary Examiner*—Richard L. Schilling
(74) *Attorney, Agent, or Firm*—Sughrue Mion, PLLC

(57) ABSTRACT

A silver halide photosensitive material containing a compound selected from Types 1–4 below which is capable of undergoing a one-electron oxidation to form a one-electron oxidation product (OEOP), and a reducing compound (Type 1) the OEOP is capable of releasing further two or more electrons accompanying a subsequent bond cleavage reaction, (Type 2) the OEOP is capable of releasing further one electron accompanying a subsequent bond cleavage reaction, and the compound having, in its molecule, two or more groups adsorptive to silver halide, (Type 3) the OEOP is capable of releasing further one or more electrons after going through a subsequent bond forming process, and (Type 4) the OEOP is capable of releasing further one or more electrons after going through a subsequent intramolecular ring cleavage reaction.

12 Claims, No Drawings

SILVER HALIDE PHOTOSENSITIVE MATERIAL

CROSS-REFERENCE TO RELATED APPLICATIONS

This application is based upon and claims the benefit of priority from the prior Japanese Patent Applications No. 2002-032491, filed Feb. 8, 2002; and No. 2002-197792, filed Jul. 5, 2002, the entire contents of both of which are incorporated herein by reference.

BACKGROUND OF THE INVENTION

1. Field of the Invention

The present invention relates to a photographic element containing a light-sensitive silver halide emulsion with enhanced photographic speed.

2. Description of the Related Art

Various techniques have been used to improve photographic speed of silver halide photosensitive materials. Chemical sensitizers such as compounds of sulfur, gold and metal of the VIII group are used to enhance the inherent sensitivity of silver halide. Further, spectral sensitization using cyanine and other polymethyne dyes is also a technique well known in the field.

It is well known as dye desensitization that the photographic speed is remarkably reduced by addition, to an emulsion, of a spectral sensitizing dye exceeding its optimum amount. As a method of solving this problem, a technique of utilizing supersensitizing effect of a supersensitizer. Supersensitizers are generally colorless organic compounds, which have an effect of acting on sensitizing dyes (or excited sensitizing dyes) to inhibit dye desensitization.

Examples of such compounds are shown in the following patents: U.S. Pat. Nos. 2,937,089, 3,706,567, 2,875,058, 3,695,888, 3,457,078, 3,458,318, 3,615,632, 5,192,654, 5,306,612, 2,419,975, 5,459,052, and 4,971,890, and EP 554856.

Further, various electron-donating compounds are used together with sensitizing dyes to enhance the spectral sensitivity of silver halide photosensitive materials. Examples thereof are disclosed in U.S. Pat. Nos. 3,695,588 and 3,809,561, and GB's 255084 and 1064193.

Furthermore, used is a compound obtained by binding the electron-donating compound to a sensitizing dye by a covalent bonding. Examples thereof are disclosed in U.S. Pat. Nos. 5,436,121 and 5,478,719 (a compound having an electron-donating styryl base bound to a monomethyne dye), U.S. Pat. No. 4,607,006 (a compound having a triarylamine skeleton bound to an electron-donating group derived from phenothiazinephenoxazine, carbazole, dibenzophenothiazine, ferrocene, and tris-2,2'-bipyridylruthenium, or to a silver halide adsorptive group).

However, even by adopting the above means, an ideal high photographic speed has not yet been realized. In particular, in the present circumstances there are few compounds which can achieve high speed and simultaneously overcome a problem of fog caused by increase in speed, and a problem of storage fog caused by storage under sever conditions, for example, silver halide photosensitive material is kept under a high temperature and a high humidity or exposed to noxious gas generated by combustion, such as car exhaust.

In the meantime, recently, a sensitizing technique using compounds called "two-electron sensitizers" which are fragmentized (bond cleavage) after being one-electron-oxidized and can further release one electron has been reported, as shown in U.S. Pat. Nos. 5,747,235, and 5,747,236, EP's 786692A1, 893731A1, and 893732A1, WO99/05570, and a thesis appearing on a U.S. chemical society journal, "Two-Electron Sensitization: A New Concept for Silver halide Photography", J. Am. Chem. Soc., 122, 11934–11943 (2000). The documents describe that the compounds are characterized in that the compounds are oxidized by a dye positive hole (a sensitizing dye molecule which has lost one electron, after the electron has been injected from the sensitizing dye in an excited sate into a conduction band of silver halide), or a positive hole generated by excitation of silver halide, and then release another electron only after reaction of fragmentation, which provides high sensitivity.

However, even these compounds cannot achieve an ideal high speed which can provide a photosensitive material having a high speed/fog ratio and an excellent storability.

BRIEF SUMMARY OF THE INVENTION

It is an object of the present invention to provide a silver halide photosensitive material whose photographic speed is enhanced and, at the same time, whose fog that arises together with the high-sensitization is suppressed, and whose increment of fog is small when the silver halide material is stored under sever conditions, for example, the silver halide photosensitive material is kept under a high temperature and a high humidity or exposed to noxious gas generated by combustion, such as car exhaust. The above object has been achieved by the following Constitutions 1 to 7.

<Constitution 1>

A silver halide photosensitive material containing at least one compound selected from the following compounds of Types 1 to 4, and at least one reducing compound.

(Type 1)

A compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

A compound capable of undergoing a one-electron oxidation to thereby form a one-electron oxidation product thereof, wherein the one-electron oxidation product is capable of releasing further one electron accompanying a subsequent bond cleavage reaction, and the compound having, in its molecule, two or more groups adsorptive to silver halide;

(Type 3)

A compound capable of undergoing a one-electron oxidation to thereby form a one-electron oxidation product thereof, wherein the one-electron oxidation product is capable of releasing further one or more electrons after going through a subsequent bond forming process; and (Type 4)

A compound capable of undergoing a one-electron oxidation to thereby form a one-electron oxidation product thereof, wherein the one-electron oxidation product is capable of releasing further one or more electrons after going through a subsequent intramolecular ring cleavage reaction.

<Constitution 2>

The silver halide photosensitive material according to Constitution 1, wherein the compounds of Types 1 to 4 described in Constitution 1 are represented by the following formula (A), formula (B), formula (1), formula (2), formula (3), formula (C), formula (D), formula (E), or formula (F).

(A)

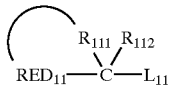

(B)

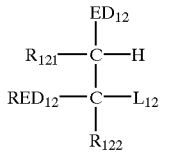

(1)

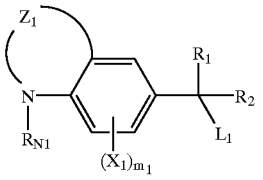

(2)

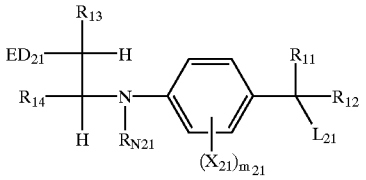

(3)

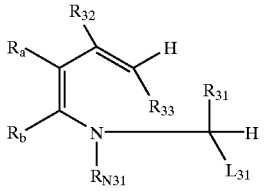

(C)

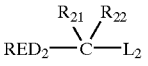

(D)

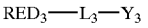

(E)

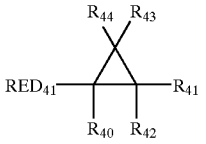

(F)

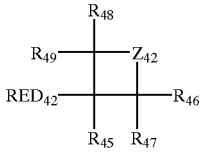

In the general formula (A), $RED_{11}$ represents a one-electron oxidizable reducing group; $L_{11}$ represents a split-off group; $R_{112}$ represents a hydrogen atom or substituent; and $R_{111}$ represents a nonmetallic atomic group capable of forming, together with carbon atom (C) and $RED_{11}$, a cyclic structure corresponding to a tetrahydro form, hexahydro form or octahydro form of a 5-membered or 6-membered aromatic ring (including an aromatic heterocycle).

In the general formula (B), $RED_{12}$ represents a one-electron oxidizable reducing group; $L_{12}$ represents a split-off group; each of $R_{121}$ and $R_{122}$ represents a hydrogen atom or substituent; and $ED_{12}$ represents an electron-donating group. In the general formula (B), $R_{121}$ and $RED_{12}$, or $R_{121}$ and $R_{122}$, or $ED_{12}$ and $RED_{12}$ may be bonded with each other to thereby form a cyclic structure.

In the general formula (1), $Z_1$ represents an atomic group capable of forming a 6-membered ring together with the nitrogen atom and the-two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group.

In the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent capable of substituting on the benzene ring; $m_{21}$ is an integer of 0 to 3; and $L_{21}$ represents a split-off group. Any two of $R_{N21}$, $R_{13}$, $R_{14}$, $X_{21}$ and $ED_{21}$ may be bonded with each other to thereby form a cyclic structure.

In the general formula (3), each of $R_{32}$, $R_{33}$, $R_{31}$, $R_{N31}$, $R_a$ and $R_b$ represents a hydrogen atom or substituent; and $L_{31}$ represents a split-off group. Provided that, when $R_{N31}$ represents a group other than an aryl group, $R_a$ and $R_b$ are bonded to each other to thereby form an aromatic ring.

In the general formula (C), $RED_2$ has the same meaning as $RED_{12}$ of the general formula (B); $L_2$ has the same meaning as $L_{11}$ of the general formula (A); each of $R_{21}$ and $R_{22}$ represents a hydrogen atom or substituent; and $RED_2$ and $R_{21}$ may be bonded with each other to thereby form a cyclic structure. The compound represented by the general formula (C) is a compound having, in its molecule, two or more adsorptive groups acting on silver halides. More preferably, the compound represented by the general formula(C) is a compound having a nitrogen-containing heterocyclic group that is substituted by two or more mercapto group, as its adsorptive group.

In the general formula (D), $RED_3$ has the same meaning as $RED_{12}$ of the general formula (B); $Y_3$ represents an organic group having a carbon-carbon double bond moiety, carbon-carbon triple bond moiety, aromatic moiety or benzo-condensed nonaromatic heterocyclic group, and capable of reacting with a one-electron oxidation product formed as a result of a one-electron oxidation of $RED_3$ to thereby form a new bond; and $L_3$ represents a linking group which links between $RED_3$ and $Y_3$.

In the general formulae (E) and (F), each of $RED_{41}$ and $RED_{42}$ has the same meaning as $RED_{12}$ of the general formula (B); and each of $R_{40}$ to $R_{44}$ and $R_{45}$ to $R_{49}$ represents a hydrogen atom or substituent. In the general formula (F), $Z_{42}$ represents —$CR_{420}R_{421}$—, —$NR_{423}$— or —O—. Herein, each of $R_{420}$ and $R_{421}$ represents a hydrogen atom or substituent; and $R_{423}$ represents a hydrogen atom, alkyl group, aryl group or heterocyclic group.

<Construction 3>

The silver halide photosensitive material according to Construction 1 or 2, wherein the compounds of Types 1 to 4 described in Construction 1 or 2 are capable of undergoing one-electron oxidation that is triggered by an exposure.

<Construction 4>

The silver halide photosensitive material according to any one of Constructions 1 to 3, wherein each of the compounds of Types 1 to 4 described in Constructions 1 to 3 is a compound having, in its molecule, at least one group adsorptive to silver halide or at least one partial structure of a spectral sensitizing dye.

<Construction 5>

The silver halide photosensitive material according to Construction 4, wherein the "compound having, in its molecule, at least one group adsorptive to silver halide"

described in Construction 4 is a compound having, in its molecule and as a partial structure, two or more mercapto groups.

<Construction 6>

The silver halide photosensitive material according to any one of Constructions 1 to 5, wherein the reducing compound described in Constructions 1 to 5 is a compound selected from hydroxyamines, hydroxamic acids, hydroxyureas, hydroxyurethanes, hydroxysemicarbazides, phenols (including chroman-6-ols, hydroquinones, catechols, resorcinols, and bisphenols), hydrazines and reductons (including reducton derivatives).

<Construction 7>

The silver halide photosensitive material according to any one of Constructions 1 to 6, wherein, when the reducing compounds described in Constructions 1 to 6 are classified into three classes consisting of a class of compounds having an adsorptive group, a class of compounds having a ballast group, and a class of diffusive compounds having none of the both adsorptive and ballast groups, compounds of two or three classes are selected from the three classes and used in the photosensitive material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The compounds of types 1 to 4 (these are compounds having a chemically sensitizing ability) will now be described in detail.

With respect to the compound of type 1, the expression "bond cleavage reaction" refers to the cleavage of a carbon-carbon bond, carbon-silicon bond, carbon-hydrogen bond, carbon-boron bond, carbon-tin bond, or carbon-germanium bond. Further, cleavage of carbon-hydrogen bond may further accompany the above bond cleavage. The compound of type 1 is a compound capable of undergoing a one-electron oxidation to thereby form a one-electron oxidation product. The one-electron oxidation product only thereafter capable of undergoing a bond cleavage reaction to thereby further release two or more electrons (preferably three or more electrons). In another expression, the one-electron oxidation product of the compound of type 1 is capable of being oxidized with further two or more electrons (preferably three or more electrons).

Among the compounds of type 1, preferable compounds are represented by the general formula (A), general formula (B), general formula (1), general formula (2) or general formula (3).

(A)

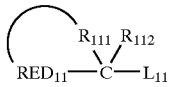

-continued (B)

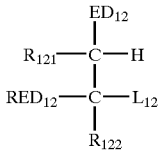

In the general formula (A), $RED_{11}$, represents a one-electron oxidizable reducing group; $L_{11}$ represents a split-off group; $R_{112}$ represents a hydrogen atom or substituent; and $R_{111}$ represents a nonmetallic atomic group capable of forming, together with carbon atom (C) and $RED_{11}$, a cyclic structure corresponding to a tetrahydro form, hexahydro form or octahydro form of a 5-membered or 6-membered aromatic ring (including an aromatic heterocycle).

In the general formula (B), $RED_{12}$ represents a one-electron oxidizable reducing group; $L_{12}$ represents a split-off group; each of $R_{121}$ and $R_{122}$ represents a hydrogen atom or substituent; and $ED_{12}$ represents an electron-donating group. In the general formula (B), $R_{121}$ and $RED_{12}$, or $R_{121}$ and $R_{122}$, or $ED_{12}$ and $RED_{12}$ may be bonded with each other to thereby form a cyclic structure.

These compounds are compounds which, after a one-electron oxidation of the reducing group represented by $RED_{11}$ or $RED_{12}$ of the general formula (A) or general formula (B), can spontaneously split $L_{11}$ or $L_{12}$ through a bond cleavage reaction, namely, cleave the C (carbon atom)-$L_{11}$ bond or the C (carbon atom)-$L_{12}$ bond to thereby further release two or more, preferably three or more, electrons.

(1)

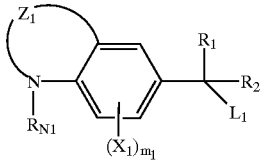

(2)

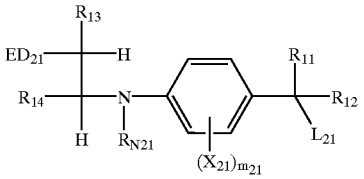

(3)

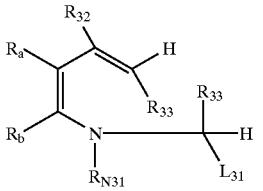

In the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group. In the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent capable of substituting on the benzene ring; $m_{21}$ is an integer of 0 to 3; and $L_{21}$ represents a split-off group. Any two of $R_{N21}$, $R_{13}$, $R_{14}$, $X_{21}$ and $ED_{21}$ may be bonded with each other to thereby form a cyclic structure. In the general formula (3), each of $R_{32}$, $R_{33}$, $R_{31}$, $R_{N31}$, $R_a$ and $R_b$ represents a hydrogen atom or substituent; and $L_{31}$ represents a split-off group. Provided that, when $R_{N31}$ represents a group other than an aryl group, $R_a$ and $R_b$ are bonded to each other to thereby form an aromatic ring.

These compounds are compounds which, after a one-electron oxidation, can spontaneously split $L_1$, $L_{21}$ or $L_{31}$ through a bond cleavage reaction, namely, cleave the C (carbon atom)-$L_1$ bond, the C (carbon atom)-$L_{21}$ bond or the C (carbon atom)-$L_{31}$ bond to thereby further release two or more, preferably three or more, electrons.

First, the compound represented by the general formula (A) will be described in detail below.

In the general formula (A), the reducing group represented by $RED_{11}$ that is capable of being oxidized with one-electron, is a group capable of bonding with $R_{111}$ described later to thereby form a specific ring. The reducing group can be, for example, a divalent group corresponding to a monovalent group, as mentioned below, having one hydrogen atom removed therefrom at a position that is appropriate for cyclization. The monovalent group can be, for example, any of an alkylamino group, arylamino group (e.g., anilino, naphthylamino), heterocyclic amino group (e.g., benzothiazolylamino, pyrrolylamino), alkylthio group, arylthio group (e.g., phenylthio), heterocyclic thio group, alkoxy group, aryloxy group (e.g., phenoxy), heterocyclic oxy group, aryl group (e.g., phenyl, naphthyl, anthranyl) and aromatic or nonaromatic heterocyclic group (for example, 5- to 7-membered monocyclic or condensed heterocycle containing at least one hetero atom selected from a group consisting of a nitrogen atom, sulfur atom, oxygen atom and selenium atom, which heterocycle can be, for example, a tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring or methylenedioxyphenyl ring) (hereinafter, for simplicity, $RED_{11}$ is referred to as denoting a monovalent group). These groups may each have a substituent.

The substituent can be, for example, any of a halogen atom, alkyl groups (including, e.g., an aralkyl group, cycloalkyl group, active methine group), an alkenyl group, alkynyl group, aryl group, heterocyclic group (preferably 5- to 7-membered ring having, as a hetero atom, N, O, S and etc., and the substitution position of the heterocyclic group is not questioned), heterocyclic group containing a quaternated nitrogen atom (e.g., pyridinio, imidazolio, quinolinio or isoquinolinio), acyl group, alkoxycarbonyl group, aryloxycarbonyl group, carbamoyl group, carboxyl group or a salt thereof, sulfonylcarbamoyl group, cacylcarbamoyl group, sulfamoylcarbamoyl group, carbazoyl group, oxalyl group, oxamoyl group, cyano group, carbonimidoyl group, thiocarbamoyl group, hydroxyl group, alkoxy groups (including a group containing ethyleneoxy or propyleneoxy repeating units), aryloxy group, heterocyclic oxy- group, acyloxy group, alkoxy- or aryloxy-carbonyloxy group, carbamoyloxy group, sulfonyloxy group, amino group, alkyl-, aryl- or heterocyclic-amino group, acylamino group, sulfonamido group, ureido group, thioureido group, imido group, alkoxy- or aryloxy-carbonylamino group, sulfamoylamino group, semicarbazido group, thiosemicarbazido group, hydrazino group, ammonio group, oxamoylamino group, alkyl- or aryl-sulfonylureido group, acylureido group, acylsulfamoylamino group, nitro group, mercapto group, alkyl-, aryl- or heterocyclic-thio group, alkyl- or aryl-sulfonyl group, alkyl- or aryl-sulfinyl group, sulfo group or a salt thereof, sulfamoyl group, acylsulfamoyl group, sulfonylsulfamoyl group or a salt thereof, and group containing a phosphoramide or phosphoric ester structure. These substituents may be further substituted with these substituents.

In the general formula (A), $L_{11}$ represents a split-off group which can be split off through a bond cleavage only after a one-electron oxidation of the reducing group represented by $RED_{11}$. Specifically, $L_{11}$ represents, for example, a carboxyl group or a salt thereof, silyl group, hydrogen atom, triarylboron anion, trialkylstannyl group, trialkylgermyl group or a group of the formula $—CR_{C1}R_{C2}R_{C3}$.

When $L_{11}$ represents a salt of carboxyl group, as a counter ion for forming a salt, there can be mentioned, for example, an alkali metal ion (e.g., $Li^+$, $Na^+$, $K^+$ or $Cs^+$), an alkaline earth metal ion (e.g., $Mg^{2+}$, $Ca^{2+}$ or $Ba^{2+}$), a heavy metal ion (e.g., $Ag^+$ or $Fe^{2+/3+}$), an ammonium ion or a phosphonium ion. When $L_{11}$ represents a silyl group, specifically, the silyl group is, for example, a trialkylsilyl group, an aryldialkylsilyl group or a triarylsilyl group. The alkyl of these groups can be, for example, methyl, ethyl, benzyl or t-butyl. The aryl of these groups can be, for example, phenyl.

When $L_{11}$ represents a triarylboron anion, the aryl thereof is preferably a substituted or unsubstituted phenyl, wherein the substituent can be any of those which may be had by $RED_{11}$.

When $L_{11}$ represents a trialkylstannyl group or a trialkylgermyl group, the alkyl thereof is a substituted or unsubstituted linear, branched or cyclic alkyl having 1 to 24 carbon atoms, wherein the substituent can be any of those which may be had by $RED_{11}$.

When $L_{11}$ represents a group of the formula $—CR_{C1}R_{C2}R_{C3}$, each of $R_{C1}$, $R_{C2}$ and $R_{C3}$ independently represents any of a hydrogen atom, alkyl group, aryl group, heterocyclic group, alkylthio group, arylthio group, alkylamino group, arylamino group, heterocyclic amino group, alkoxy group, aryloxy group and hydroxyl group. These may be bonded with each other to thereby form a cyclic structure. Each of these may further have a substituent. The substituent can be any of those which may be had by $RED_{11}$. Provided however that, when one of $R_{C1}$, $R_{C2}$ and $R_{C3}$ represents a hydrogen atom or alkyl group, the remaining two do not represent a hydrogen atom or alkyl group. It is preferred that each of $R_{C1}$, $R_{C2}$ and $R_{C3}$ independently represent an alkyl group, aryl group (especially, phenyl), alkylthio group, arylthio group, alkylamino group, arylamino group, heterocyclic group, alkoxy group or hydroxyl group. Specific examples thereof include methyl, ethyl, cyclohexyl, benzyl, phenyl, p-dimethylaminophenyl, p-methoxyphenyl, 2,4-dimethoxyphenyl, p-hydroxyphenyl, methylthio, phenylthio, phenoxy, methoxy, ethoxy, dimethylamino, N-methylanilino, diphenylamino, morpholino, thiomorpholino and hydroxyl. Examples of groups having a cyclic structure formed by mutual bonding of these include 1,3-dithiolan-2-yl, 1,3-dithian-2-yl, N-methyl-1,3-thiazolidin-2-yl and N-benzylbenzothiazolidin-2-yl.

Preferred groups of the formula $—CR_{C1}R_{C2}R_{C3}$ can be, for example, trityl, tri(p-hydroxyphenyl)methyl, 1,1-diphenyl-1-(p-dimethylaminophenyl)methyl, 1,1-diphenyl-1-(methylthio)methyl, 1-phenyl-1,1-(dimethylthio)methyl, 1,3-dithiolan-2-yl, 2-phenyl-1,3-dithiolan-2-yl, 1,3-dithian- 2-yl, 2-phenyl-1,3-dithian-2-yl, 2-methyl-1,3-dithian-2-yl, N-methyl-1,3-thiazolidin-2-yl, 2-methyl-3-methyl-1,3-thiazolidin-2-yl, N-benzylbenzothiazolidin-2-yl, 1,1-diphenyl-1-dimethylaminomethyl and 1,1-diphenyl-1-morpholinomethyl group. It is also preferred that the group of the formula —$CR_{c1}$,$R_{c2}Rc_{c3}$ be the same group as the residue resulting from removal of $L_{11}$ from the general formula (A) as a consequence of selection within the above scopes with respect of the $R_{C1}$, $R_{C2}$ and $R_{c3}$.

In the general formula (A), $R_{112}$ represents a hydrogen atom or substituent capable of substituting on the carbon atom. When $R_{112}$ represents a substituent capable of substituting on the carbon atom, the substituent can be, for example, any of those mentioned as substituent examples with respect to the $RED_{11}$ having a substituent. Provided, however, that $R_{112}$ and $L_{11}$ do not represent the same group.

In the general formula (A), $R_{111}$ represents a group of nonmetallic atoms capable of forming a specific 5-membered or 6-membered cyclic structure together with the carbon atom (C) and $RED_{11}$. Herein, the expression "specific 5-membered or 6-membered cyclic structure" formed by $R_{111}$ means a cyclic structure corresponding to a tetrahydro form, hexahydro form or octahydro form of 5-membered or 6-membered aromatic ring (including an aromatic heterocycle). Herein, the terminology "hydro form" means a cyclic structure resulting from partial hydrogenation of internal carbon to carbon double bonds or carbon to nitrogen double bonds of an aromatic ring (including an aromatic heterocycle). The tetrahydro form refers to a structure resulting from hydrogenation of two carbon to carbon double bonds or carbon to nitrogen double bonds. The hexahydro form refers to a structure resulting from hydrogenation of three carbon to carbon double bonds or carbon to nitrogen double bonds. The octahydro form refers to a structure resulting from hydrogenation of four carbon to carbon double bonds or carbon to nitrogen double bonds. As a result of hydrogenation, the aromatic ring becomes a partially hydrogenated nonaromatic cyclic structure.

Specifically, as examples of 5-membered monocycles, there can be mentioned a pyrrolidine ring, imidazolidine ring, thiazolidine ring, pyrazolidine ring and oxazolidine ring which correspond to tetrahydro forms of aromatic rings including a pyrrole ring, imidazole ring, thiazole ring, pyrazole ring and oxazole ring, respectively. As examples of 6-membered monocycles, there can be mentioned tetrahydro or hexahydro forms of aromatic rings such as a pyridine ring, pyridazine ring, pyrimidine ring and pyrazine ring. Particular examples thereof include a piperidine ring, tetrahydropyridine ring, tetrahydropyrimidine ring and piperazine ring. As examples of 6-membered condensed rings, there can be mentioned a tetralin ring, tetrahydroquinoline ring, tetrahydroisoquinoline ring, tetrahydroquinazoline ring and tetrahydroquinoxaline ring which correspond to tetrahydro forms of aromatic rings including a naphthalene ring, quinoline ring, isoquinoline ring, quinazoline ring and quinoxaline ring, respectively. As examples of tricyclic compounds, there can be mentioned a tetrahydrocarbazole ring, which is a tetrahydro form of a carbazole ring, and an octahydrophenanthridine ring, which is an octahydro form of a phenanthridine ring.

These cyclic structures may further be substituted. As examples of suitable substituents, there can be mentioned those described above with respect to substituents which may be had by the $RED_{11}$. Substituents of these cyclic structures may be further bonded with each other to thereby form a ring. The thus newly formed ring is a nonaromatic carbon ring or heterocycle.

Preferred range of compounds represented by the general formula (A) of the present invention will be described below.

In the general formula (A), $L_{11}$ preferably represents a carboxyl group or a salt thereof, or hydrogen atom. More preferably, $L_{11}$ is a carboxyl group or a salt thereof. As a counter ion of the salt, there can preferably be mentioned an alkali metal ion or an ammonium ion. An alkali metal ion (especially $Li^+$, $Na^+$ or $K^+$ ion) is most preferred.

When $L_{11}$ represents a hydrogen atom, it is preferred that the compound represented by the general formula (A) have an intramolecular base moiety. By virtue of the action of the base moiety, the compound represented by the general formula (A) is oxidized, and thereafter the hydrogen atom represented by $L_{11}$ is deprotonized to thereby enable further release of an electron therefrom.

Herein, the base refers to, for example, a conjugated base of acid exhibiting a pKa value of about 1 to about 10. As the base, there can be mentioned, for example, any of nitrogen-containing heterocycles (pyridines, imidazoles, benzimidazoles, thiazoles, etc.), anilines, trialkylamines, an amino group, carbon acids (active methylene anion, etc.), a thioacetate anion, carboxylate (—$COO^-$), sulfate (—$SO_3^-$) and an amine oxide (>$N^+(O^-)$—). Preferred base is a conjugated base of acid exhibiting a pKa value of about 1 to about 8. Carboxylate, sulfate and an amine oxide are more preferred. Carboxylate is most preferred. When these bases have an anion, a counter cation may be had thereby. The counter cation can be, for example, an alkali metal ion, an alkaline earth metal ion, a heavy metal ion, an ammonium ion or a phosphonium ion.

These bases are linked at an arbitrary position thereof to the compound represented by the general formula (A). The position at which the base moiety is bonded may be any of $RED_{11}$, $R_{111}$ and $R_{112}$ of the general formula (A). Also, the bases may be linked at substituents of these groups.

When $L_{11}$ represents a hydrogen atom, it is preferred that the hydrogen atom and the base moiety be linked to each other through an atomic group consisting of 8 or less atoms. More preferably, the linkage is made by an atomic group consisting of 5 to 8 atoms. Herein, what is counted as a linking atomic group refers to an atomic group which links the hydrogen atom to the central atom of base moiety (namely, an atom having an anion, or an atom having a lone electron pair) by a covalent bond. For example, with respect to carboxylate, two atoms of —C—$O^-$ are counted. With respect to sulfate, two atoms of S—$O^-$ are counted. Also, the carbon atom represented by C in the general formula (A) is included in the count.

In the general formula (A), when $L_{11}$ represents a hydrogen atom and when $RED_{11}$ represents an aniline whose nitrogen atom forms a 6-membered monocyclic saturated ring structure (for example, a piperidine ring, piperazine ring, morpholine ring, thiomorpholine ring or selenomorpholine ring) together with $R_{111}$, it is preferred that the compound have an adsorptive group acting on silver halides in its molecule. It is more preferred that the compound simultaneously have an intramolecular base moiety, the base moiety and the hydrogen atom linked to each other through an atomic group consisting of 8 or less atoms.

In the general formula (A), it is preferred that $RED_{11}$ represents an alkylamino group, arylamino group, heterocyclic amino group, aryl group, or aromatic or nonaromatic heterocyclic group. As the heterocyclic group, preferred group is, for example, tetrahydroquinolinyl, tetrahydroquinoxalinyl, tetrahydroquinazolinyl, indolyl, indolenyl, carbazolyl, phenoxazinyl, phenothiazinyl, benzothiazolinyl, pyrrolyl, imidazolyl, thiazolidinyl, benzimidazolyl, benzimidazolinyl or 3,4-methylenedioxyphenyl-1-yl. More preferred group is an arylamino group (especially an anilino) or aryl group (especially an phenyl). When $RED_{11}$ represents an aryl group, it is preferred that the aryl group has at least one electron-donating group (the number of electron-donating groups is preferably 4 or less, more preferably 1 to 3). Herein, the electron-donating group specifically refers to a hydroxyl group, alkoxy group, mercapto group, sulfonamido group, acylamino group, alkylamino group, arylamino group, heterocyclic amino group, active methine group, electron-excessive aromatic heterocyclic group (e.g., indolyl, pyrrolyl, imidazolyl, benzimidazolyl, thiazolyl, benzthiazolyl or indazolyl), or a nonaromatic nitrogen-containing heterocyclic group that is bonded to the carbon atom of the general formula (A) via its nitrogen atom (e.g., pyrrolidinyl, indolinyl, piperidinyl, piperazinyl or morpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. These two electron-withdrawing groups may be bonded with each other to thereby form a circular structure. When $RED_{11}$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to the carbon atom of the general formula (A) via its nitrogen atom. More preferably, the substituent is an alkylamino group, hydroxyl group, active methine group, or nonaromatic nitrogen-containing heterocyclic group that is bonded to the carbon atom of the general formula (A) via its nitrogen atom. Most preferably, the substituent is an alkylamino group, or nonaromatic nitrogen-containing heterocyclic group that is bonded to the carbon atom of the general formula (A) via its nitrogen atom.

In the general formula (A), $R_{112}$ preferably represents any of a hydrogen atom, alkyl group, aryl group (e.g., phenyl), alkoxy group (e.g., methoxy, ethoxy or benzyloxy), hydroxyl group, alkylthio group (e.g., methylthio or butylthio), amino group, alkylamino group, arylamino group and heterocyclic amino group. More preferably, $R_{112}$ represents any of a hydrogen atom, alkyl group, alkoxy group, phenyl group, alkylamino group.

In the general formula (A), $R_{111}$ preferably represents a group of nonmetallic atoms capable of forming the following specific 5-membered or 6-membered cyclic structure together with the carbon atom (C) and $RED_{11}$. Specifically, the cyclic structure formed by $R_{111}$ may be, for example, either of a pyrrolidine ring and an imidazolidine ring which correspond to tetrahydro forms of monocyclic 5-membered aromatic rings including a pyrrole ring and imidazole ring, respectively. Also, the cyclic structure may be a tetrahydro or hexahydro form of monocyclic 6-membered aromatic ring such as a pyridine ring, pyridazine ring, pyrimidine ring or pyrazine ring. For example, the cyclic structure may be a piperidine ring, tetrahydropyridine ring, tetrahydropyrimidine ring or piperazine ring. Further, the cyclic structure may be any of a tetralin ring, tetrahydroquinoline ring, tetrahydroisoquinoline ring, tetrahydroquinazoline ring and tetrahydroquinoxaline ring which correspond to tetrahydro forms of condensed-ring of 6-membered aromatic rings including a naphthalene ring, a quinoline ring, isoquinoline ring, quinazoline ring and quinoxaline ring, respectively. Still further, the cyclic structure may be a tetrahydrocarbazole ring which is a tetrahydro form of a tricyclic aromatic carbazole ring, or octahydrophenanthridine ring which is an octahydro form of a phenanthridine ring. The cyclic structure formed by $R_{111}$ is more preferably selected from a pyrrolidine ring, imidazolidine ring, piperidine ring, tetrahydropyridine ring, tetrahydropyrimidine ring, piperazine ring, tetrahydroquinoline ring, tetrahydroquinazoline ring, tetrahydroquinoxaline ring and tetrahydrocarbazole ring. Most preferably, the cyclic structure formed by $R_{111}$ is selected from a pyrrolidine ring, piperidine ring, piperazine ring, tetrahydroquinoline ring, tetrahydroquinazoline ring, tetrahydroquinoxaline ring and tetrahydrocarbazole ring. Optimally, the cyclic structure formed by $R_{111}$ is selected from a pyrrolidine ring, piperidine ring and tetrahydroquinoline ring.

Now, the general formula (B) will be described in detail.

With respect to the $RED_{12}$ and $L_{12}$ of the general formula (B), not only the meanings but also the preferred ranges thereof are the same as those of the $RED_{11}$ and $L_{11}$ of the general formula (A), respectively. Provided, however, that $RED_{12}$ represents a monovalent group unless the following cyclic structure is formed thereby. For example, the monovalent group can be any of those mentioned with respect to $RED_{11}$. With respect to $R_{121}$ and $R_{122}$, not only the meanings but also the preferred ranges thereof are the same as those of the $R_{112}$ of the general formula (A). $ED_{12}$ represents an electron-donating group. $R_{121}$ and $RED_{12}$; $R_{121}$ and $R_{122}$; or $ED_{12}$ and $RED_{12}$ may be bonded with each other to thereby form a cyclic structure.

In the general formula (B), the electron-donating group represented by $ED_{12}$ refers to a hydroxyl group, alkoxy group, mercapto group, alkylthio group, arylthio group, heterocyclic thio group, sulfonamido group, acylamino group, alkylamino group, arylamino group, heterocyclic amino group, active methine group, electron-excessive aromatic heterocyclic group (e.g., indolyl, pyrrolyl or indazolyl), a nonaromatic nitrogen-containing heterocyclic group that is bonded to the carbon atom of the general formula (B) via its nitrogen atom (e.g., pyrrolidinyl, piperidinyl, indolinyl, piperazinyl or morpholino), or an aryl group substituted with any of these electron-donating groups (e.g., p-hydroxyphenyl, p-dialkylaminophenyl, an o,p-dialkoxyphenyl or 4-hydroxynaphthyl). Herein, the active methine group is the same as described above as a substituent when $RED_{11}$ represents an aryl group. $ED_{12}$ preferably represents a hydroxyl group, alkoxy group, mercapto group, sulfonamido group, alkylamino group, arylamino group, active methine group, electron-excessive aromatic heterocyclic group, nonaromatic nitrogen-containing heterocyclic group that is bonded to the carbon atom of the general formula (B) via its nitrogen atom, or phenyl group substituted with any of these electron-donating groups. More preferably, $ED_{12}$ represents a hydroxyl group, mercapto group, sulfonamido group, alkylamino group, arylamino group, active methine group, nonaromatic nitrogen-containing heterocyclic group that is bonded to the carbon atom of the general formula (B) via its nitrogen atom, or phenyl group substituted with any of these electron-donating groups (e.g., p-hydroxyphenyl, p-dialkylaminophenyl or o,p-dialkoxyphenyl).

In the general formula (B), $R_{121}$ and $RED_{12}$; $R_{122}$ and $R_{121}$; or $ED_{12}$ and $RED_{12}$ may be bonded with each other to thereby form a cyclic structure. The thus formed cyclic structure is a substituted or unsubstituted cyclic structure of a 5- to 7-membered monocyclic or condensed-ring nonaromatic carbon ring or heterocycle. When $R_{121}$ and $RED_{12}$ form a cyclic structure, the thus formed cyclic structure can be, for example, a pyrrolidine ring, pyrroline ring, imidazolidine ring, imidazoline ring, thiazolidine ring, thiazoline ring, pyrazolidine ring, pyrazoline ring, oxazolidine ring, oxazoline ring, indane ring, piperidine ring, piperazine ring, morpholine ring, tetrahydropyridine ring, tetrahydropyrimidine ring, indoline ring, tetralin ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring or 2,3-dihydrobenzothiophene ring. When $ED_{12}$ and $RED_{12}$ form a cyclic structure, $ED_{12}$ preferably represents an amino group, alkylamino group or arylamino group. The cyclic structure formed thereby can be, for example, a tetrahydropyrazine ring, piperazine ring, tetrahydroquinoxaline ring or tetrahydroisoquinoline ring. When $R_{122}$ and $R_{121}$ form a cyclic structure, the thus formed cyclic structure can be, for example, a cyclohexane ring or cyclopentane ring.

Those which are more preferred among the compounds of the general formula (A) of the present invention are represented by the following general formulae (10) to (12). Those which are more preferred among the compounds of the general formula (B) are represented by the following general formulae (13) and (14).

(10)

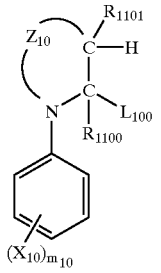

(11)

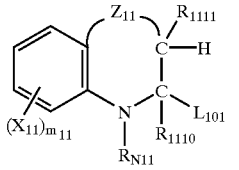

(12)

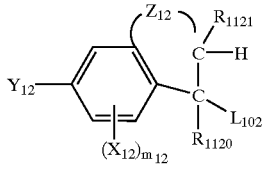

(13)

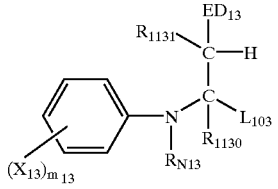

-continued (14)

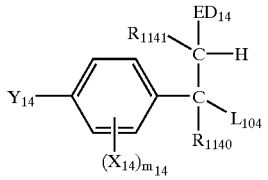

With respect to the $L_{100}$, $L_{101}$, $L_{102}$, $L_{103}$ and $L_{104}$ of the general formulae (10) to (14), not only the meanings but also the preferred ranges thereof are the same as those of the $L_{11}$ of the general formula (A). With respect to $R_{1100}$ and $R_{1101}$; $R_{1110}$ and $R_{1111}$; $R_{1120}$ and $R_{1121}$; $R_{1130}$ and $R_{1131}$; and $R_{1140}$ and $R_{1141}$; not only the meanings but also the preferred ranges thereof are the same as those of the $R_{122}$ and $R_{121}$, respectively of the general formula (B). With respect to the $ED_{13}$ and $ED_{14}$, not only the meanings but also the preferred ranges thereof are the same as those of the $ED_{12}$ of the general formula (B). Each of $X_{10}$, $X_{11}$, $X_{12}$, $X_{13}$ and $X_{14}$ represents a substituent capable of substituting on the benzene ring. Each of $m_{10}$, $m_{11}$, $m_{12}$, $m_{13}$ and $m_{14}$ is an integer of 0 to 3. When it is 2 or more, a plurality of $X_{10}$, $X_{11}$, $X_{12}$, $X_{13}$or $X_{14}$ groups may be the same or different. Each of $Y_{12}$ and $Y_{14}$ represents an amino group, alkylamino group, arylamino group, nonaromatic nitrogen-containing heterocyclic group that is bonded to the benzene ring of the general formula (12) or (14) via its nitrogen atom (e.g., pyrrolyl, piperidinyl, indolinyl, piperazino or morpholino), hydroxyl group or alkoxy group.

Each of $Z_{10}$, $Z_{11}$ and $Z_{12}$ represents a nonmetallic atomic group capable of forming a specific cyclic structure. The specific cyclic structure formed by $Z_{10}$ means a cyclic structure corresponding to a tetrahydro form or hexahydro form of 5- or 6-membered, monocyclic or condensed-ring, nitrogen-containing aromatic heterocycle. As such a cyclic structure, there can be mentioned, for example, a pyrrolidine ring, imidazolidine ring, thiazolidine ring, pyrazolidine ring, piperidine ring, tetrahydropyridine ring, tetrahydropyrimidine ring, piperazine ring, tetrahydroquinoline ring, tetrahydroisoquinoline ring, tetrahydroquinazoline ring or tetrahydroquinoxaline ring. The specific cyclic structure formed by $Z_{11}$, refers to a tetrahydroquinoline ring or tetrahydroquinoxaline ring. The specific cyclic structure formed by $Z_{12}$ refers to a tetralin ring, tetrahydroquinoline ring or tetrahydroisoquinoline ring.

Each of $R_{N11}$ and $R_{N13}$ represents a hydrogen atom or substituent capable of substituting on the nitrogen atom. The substituent can be, for example, any of an alkyl group, alkenyl group, alkynyl group, aryl group, heterocyclic group and acyl group, preferably an alkyl group or aryl group.

The substituents capable of substituting on the benzene ring, represented by $X_{10}$, $X_{11}$, $X_{12}$, $X_{13}$ or $X_{14}$, can be, for example, those which may be had by the $RED_{11}$ of the general formula (A). Preferably, the substituents can be a halogen atom, alkyl group, aryl group, heterocyclic group, acyl group, alkoxycarbonyl group, aryloxycarbonyl group, carbamoyl group, cyano group, alkoxy group (including a group containing ethyleneoxy or propyleneoxy repeating units), alkyl-, aryl- or heterocyclic-amino group, an acylamino group, sulfonamido group, ureido group, thioureido group, imido group, alkoxy- or aryloxy-carbonylamino group, nitro group, alkyl-, aryl- or heterocyclic-thio group, alkyl- or aryl-sulfonyl group, a sulfamoyl group, etc. Each of $m_{10}$, $m_{11}$, $m_{12}$, $m_{13}$ and $m_{14}$ is preferably an integer of 0 to 2, more preferably 0 or 1.

Each of $Y_{12}$ and $Y_{14}$ preferably represents an alkylamino group, arylamino group, nonaromatic nitrogen-containing heterocyclic group that is bonded to the benzene ring of the general formula (12) or (14) via its nitrogen atom, hydroxyl group or alkoxy group. More preferably, each of $Y_{12}$ and $Y_{14}$ represents an alkylamino group, 5- or 6-membered nonaromatic nitrogen-containing heterocyclic group that is bonded to the benzene ring of the general formula (12) or (14) via its nitrogen atom, or hydroxyl group. Most preferably, each of $Y_{12}$ and $Y_{14}$ represents an alkylamino group (especially, dialkylamino) or a 5- or 6-membered nonaromatic nitrogen-containing heterocyclic group that is bonded to the benzene ring of the general formula (12) or (14) via its nitrogen atom.

In the general formula (13), $R_{1131}$ and $X_{13}$; $R_{1131}$ and $R_{N13}$; $R_{1130}$ and $X_{13}$; or $R_{1130}$ and $R_{N13}$ may be bonded with each other to thereby form a cyclic structure. In the general formula (14), $R_{1141}$ and $X_{14}$; or $R_{1141}$ and $R_{1140}$; $ED_{14}$ and $X_{14}$; or $R_{1140}$ and $X_{14}$ may be bonded with each other to thereby form a cyclic structure. The thus formed cyclic structure is a substituted or unsubstituted cyclic structure consisting of a 5- to 7-membered monocyclic or condensed-ring nonaromatic carbon ring or heterocycle. When, in the general formula (13), $R_{1131}$ and $X_{13}$ are bonded with each other to thereby form a cyclic structure, or $R_{1131}$ and $R_{N13}$ are bonded with each other to thereby form a cyclic structure, the resultant compound, like that wherein no cyclic structure is formed, is a preferred example of the compounds of the general formula (13). As the cyclic structure formed by $R_{1131}$ and $X_{13}$ in the general formula (13), there can be mentioned, for example, any of an indoline ring, in which case, $R_{113}$, represents a single bond, tetrahydroquinoline ring, tetrahydroquinoxaline ring, 2,3-dihydrobenzo-1,4-oxazine ring and 2,3-dihydrobenzo-1,4-thiazine ring. Of these, an indoline ring, tetrahydroquinoline ring and tetrahydroquinoxaline ring are especially preferred. As the cyclic structure formed by $R_{1131}$ and $R_{N13}$ in the general formula (13), there can be mentioned, for example, any of a pyrrolidine ring, pyrroline ring, imidazolidine ring, imidazoline ring, thiazolidine ring, thiazoline ring, pyrazolidine ring, pyrazoline ring, oxazolidine ring, oxazoline ring, piperidine ring, piperazine ring, morpholine ring, tetrahydropyridine ring, tetrahydropyrimidine ring, indoline ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring and 2,3-dihydrobenzothiophene ring. Of these, a pyrrolidine ring, piperidine ring, tetrahydroquinoline ring and tetrahydroquinoxaline ring are especially preferred.

When, in the general formula (14), $R_{1141}$ and $X_{14}$ are bonded with each other to thereby form a cyclic structure, or $ED_{14}$ and $X_{14}$ are bonded with each other to thereby form a cyclic structure, the resultant compound, like that wherein no cyclic structure is formed, is a preferred example of the compounds of the general formula (14). As the cyclic structure formed by the bonding of $R_{1141}$ and $X_{14}$ in the general formula (14), there can be mentioned, for example, an indane ring, tetralin ring, tetrahydroquinoline ring, tetrahydroisoquinoline ring or indoline ring. As the cyclic structure formed by the bonding of $ED_{14}$ and $X_{14}$, there can be mentioned, for example, a tetrahydroisoquinoline ring or tetrahydrocinnoline ring.

Now, the general formulae (1) to (3) will be described.

In the general formulae (1) to (3), each of $R_1$, $R_2$, $R_{11}$, $R_{12}$ and $R_{31}$ independently represents a hydrogen atom or substituent. With respect to these, not only the meanings but also the preferred ranges thereof are the same as those of the $R_{112}$ of the general formula (A). Each of $L_1$, $L_{21}$ and $L_{31}$ independently represents a split-off group, which can be any of those mentioned as examples in the above description of the $L_{11}$ of the general formula (A). The preferred ranges thereof are also the same as mentioned there. Each of $X_1$ and $X_{21}$ represents a substituent capable of substituting on the benzene ring. Each thereof independently represents any of those mentioned as the substituent examples with respect to substituted $RED_{11}$ of the general formula (A). Each of $m_1$ and $m_{21}$ is an integer of 0 to 3, preferably 0 to 2, and more preferably 0 or 1.

Each of $R_{N1}$, $R_{N21}$ and $R_{N31}$ represents a hydrogen atom or substituent capable of substituting on the nitrogen atom. The substituent can preferably be any of an alkyl group, aryl group and heterocyclic group. These groups may further have a substituent. This substituent can be any of those which may be had by the $RED_1$ of the general formula (A). Each of $R_{N1}$, $R_{N21}$ and $R_{N31}$ preferably represents a hydrogen atom, alkyl group or aryl group, more preferably a hydrogen atom or alkyl group.

Each of $R_{13}$, $R_{14}$, $R_{32}$, $R_{33}$, $R_a$ and $R_b$ independently represents a hydrogen atom or substituent capable of substituting on the carbon atom. The substituent can be any of those which may be had by the $RED_{11}$ of the general formula (A). The substituent can preferably be, for example, an alkyl group, aryl group, acyl group, alkoxycarbonyl group, carbamoyl group, cyano group, alkoxy group, acylamino group, sulfonamido group, ureido group, thioureido group, alkylthio group, arylthio group, alkylsulfonyl group, arylsulfonyl group or sulfamoyl group.

In the general formula (1), $Z_1$ represents an atomic group capable of forming a 6-membered ring together the nitrogen atom and the two carbon atoms of the benzene ring. The 6-membered ring formed with $Z_1$ is a nonaromatic carbon ring or heterocycle condensed with the benzene ring of the general formula (1). Specifically, the atomic group can be any of a tetrahydroquinoline ring, tetrahydroquinoxaline ring and tetrahydroquinazoline ring, which ring structures include the benzene ring to which the atomic group condenced. These may have a substituent. The substituent can be any of those mentioned as examples when the $R_{112}$ of the general formula (A) represents a substituent, and the preferred range thereof is also the same as mentioned there.

In the general formula (1), $Z_1$ preferably represents an atomic group capable of forming a tetrahydroquinoline ring or tetrahydroquinoxaline ring together with the nitrogen atom and the two carbon atoms of the benzene ring.

In the general formula (2), $ED_{21}$ represents an electron-donating group. With respect to the $ED_{21}$, not only the meaning but also the preferred range thereof is the same as those of the $ED_{12}$ of the general formula (B).

In the general formula (2), any two of $R_{N21}$, $R_{13}$, $R_{14}$, $X_{21}$ and $ED_{21}$ may be bonded with each other to thereby form a cyclic structure. The cyclic structure formed by $R_{N21}$ and $X_{21}$ is preferably a 5- to 7-membered nonaromatic carbon ring or heterocycle condensed with the benzene ring of the general formula (2). For example, it can be a tetrahydroquinoline ring, tetrahydroquinoxaline ring, indoline ring or 2,3-dihydro-5,6-benzo-1,4-thiazine ring. Preferably, it is a tetrahydroquinoline ring, tetrahydroquinoxaline ring or indoline ring.

In the general formula (3), when $R_{N31}$ represents a group other than aryl group, $R_a$ and $R_b$ are bonded with each other to thereby form an aromatic ring. Herein, this aromatic ring is an aryl group. Herein, the aromatic group is an aryl group (e.g., phenyl or naphthyl) or an aromatic heterocyclic group (e.g., a pyridine ring, pyrrole ring, quinoline ring or indole ring). An aryl group is preferred. The aromatic ring group may have a substituent. The substituent can be any of those mentioned when $X_1$ of the general formula (1) represents a substituent, and the preferred range thereof is also the same as mentioned there.

In the general formula (3), it is preferred that $R_a$ and $R_b$ be bonded with each other to thereby form an aromatic ring (especially a phenyl group).

In the general formula (3), $R_{32}$ preferably represents, for example, a hydrogen atom, alkyl group, aryl group, hydroxyl group, alkoxy group, mercapto group or amino group. When $R_{32}$ represents a hydroxyl group, it is a preferred mode that simultaneously $R_{33}$ represent an electron-withdrawing group. This electron-withdrawing group refers to any of an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. Of these, an acyl group, alkoxycarbonyl group, carbamoyl group and cyano group are preferred.

The compound of type 2 will be described below.

The compound of type 2 is a compound capable of undergoing a one-electron oxidation to thereby form a one-electron oxidation product and capable of, only thereafter, undergoing a bond cleavage reaction to thereby further release another electron. That is, the one-electron oxidation product of the compound of type 2 is capable of being oxidized with a further one-electron oxidation. Herein, the expression "bond cleavage reaction" refers to the cleavage of a carbon-carbon bond, carbon-silicon bond, carbon-hydrogen bond, carbon-boron bond, carbon-tin bond, or carbon-germanium bond. Cleavage of carbon-hydrogen bond may accompany the above bond cleavage.

Among the compounds of type 2, those preferred are represented by general formula (C).

(C)

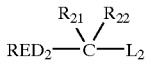

Herein, the compound of the general formula (C) is, after the one-electron oxidation of the reducing group represented by $RED_2$, $L_2$ is spontaneously split off through a bond cleavage reaction, namely, the C (carbon atom)-$L_2$ bond is cleaved, so that further another electron can be released.

Provided that the compound of the general formula (C) is a compound having, in its molecule, two or more (preferably 2 to 6, more preferably 2 to 4) groups adsorptive to silver halide. More preferably, the compound of the general formula (C) is a compound having a nitrogen-containing heterocyclic group substituted with two or more mercapto groups as the adsorptive group. The number of adsorptive groups is preferably in the range of 2 to 6, more preferably 2 to 4. The adsorptive groups will be described later.

With respect to $RED_2$ of the general formula (C), not only the meaning but also the preferred range thereof is the same as those of the $RED_{12}$ of the general formula (B). $L_2$ has the same meaning as described for $L_{11}$ of the general formula (A). The preferable range of $L_2$ is also the same as that of $L_{11}$. When $L_2$ represents a silyl group, the compound of the general formula (C) has, in its molecule, a nitrogen-containing heterocyclic group that is substituted by two or more mercapto groups, as an adsorptive group. Each of $R_{21}$ and $R_{22}$ represents a hydrogen atom or substituent. With respect to these, not only the meanings but also the preferred ranges thereof are the same as those of the $R_{112}$ of the general formula (A). $RED_2$ and $R_{21}$ may be bonded with each other to thereby form a cyclic structure.

The thus formed cyclic structure is preferably a 5- to 7-membered monocyclic or condensed-ring nonaromatic carbon ring or heterocycle, which may have a substituent. Provided however that the cyclic structure is not one corresponding to a tetrahydro form, hexahydro form or octahydro form of an aromatic ring or aromatic heterocycle. The substituent can be any of those mentioned as substituent examples with respect to substituted $RED_{11}$ of the general formula (A). The cyclic structure is preferably a cyclic structure corresponding to a dihydro form of an aromatic or nonaromatic heterocycle. Preferable example of the cyclic structure, for example, is a 2-pyrroline ring, 2-imidazoline ring, 2-thiazoline ring, 1,2-dihydropyridine ring, 1,4-dihydropyridine ring, indoline, ring, benzimidazoline ring, benzothiazoline ring, benzoxazoline ring, 2,3-dihydrobenzothiophene ring, 2,3-dihydrobenzofuran ring, benzo-a-pyran ring, 1,2-dihydroquinoline ring, 1,2-dihydroquinazoline ring and 1,2-dihydroquinoxaline ring.

Of these, a 2-imidazoline ring, 2-thiazoline ring, indoline ring, benzimidazoline ring, benzothiazoline ring, benzoxazoline ring, 1,2-dihydropyridine ring, 1,2-dihydroquinoline ring, 1,2-dihydroquinazoline ring and 1,2-dihydroquinoxaline ring are preferred. An indoline ring, benzimidazoline ring, benzothiazoline ring and 1,2-dihydroquinoline ring are more preferred. An indoline ring is most preferred.

The compound of Type 3 will be described below.

The compound of Type 3 is a compound characterized in that it can undergo a one-electron oxidation to thereby form a one-electron oxidation product, the one-electron oxidation product is capable of releasing further one or more electrons after going through a subsequent bond forming process. The bond forming step refers to the formation of bond between atoms, for example, of carbon-carbon bond, carbon-nitrogen bond, carbon-sulfur bond or carbon-oxygen bond.

The compound of Type 3 is preferably a compound characterized in that it can undergo a one-electron oxidation to thereby form a one-electron oxidation product, the one-electron oxidation product subsequently reacting with a reactive group moiety (a carbon to carbon double bond moiety, a carbon to carbon triple bond moiety, an aromatic group moiety or a benzo-condensed nonaromatic heterocyclic group moiety) which coexists in the molecule to thereby form a bond, followed by further release of one or more electrons.

The one-electron oxidation product formed by the one-electron oxidation of the compound of Type 3 refers to a cation radical species, which may undergo splitting of a proton to thereby form a neutral radical species. This one-electron oxidation product (cation radical species or neutral radical species) reacts with a carbon to carbon double bond moiety, a carbon to carbon triple bond moiety, an aromatic group moiety and a benzo-condensed nonaromatic heterocyclic group moiety which coexists in the molecule, thereby forming interatomic bonds such as carbon-carbon bond, carbon-nitrogen bond, carbon-sulfur bond and carbon-oxygen bond. Thus, a new intramolecular cyclic structure is formed. Simultaneously or thereafter, further one or more electrons are released. The characteristic of the compound of Type 3 resides in this respect.

More specifically, the compound of Type 3 is characterized in that the bond forming reaction after the one-electron oxidation leads to formation of a new radical species of cyclic structure, from which the second electron is further released directly or through splitting of a proton to thereby cause an oxidation thereof.

Furthermore, the compounds of Type 3 include one exhibiting such a capability that the thus formed two-electron oxidation product subsequently undergoes a tautomeric reaction accompanying a transfer of proton either by way of a hydrolytic reaction or directly to thereby further release one or more, generally two or more, electrons, resulting in an oxidation thereof. Still further, the compounds of Type 3 include one exhibiting such a capability that, without undergoing such a tautomeric reaction, further one or more, generally two or more, electrons are directly released from the two-electron oxidation product, resulting in oxidation thereof.

The compound of Type 3 is preferably represented by the general formula (D).

$$RED_3—L_3—Y_3 \quad (D)$$

In the general formula (D), $RED_3$ represents the same meanings as defined for $RED_{12}$ of the general formula (B).

In the general formula (D), $RED_3$ preferably represents an arylamino group, heterocyclic amino group, aryloxy group, arylthio group, aryl group, or aromatic or nonaromatic heterocyclic group (especially preferably a nitrogen-containing heterocyclic group). More preferably, $RED_3$ represents an arylamino group, heterocyclic amino group, aryl group, or aromatic or nonaromatic heterocyclic group. With respect to the heterocyclic group, it is preferred to use, for example, a tetrahydroquinoline ring group, tetrahydroquinoxaline ring group, tetrahydroquinazoline ring group, indoline ring group, indole ring group, carbazole ring group, phenoxazine ring group, phenothiazine ring group, benzothiazoline ring group, pyrrole ring group, imidazole ring group, thiazole ring group, benzimidazole ring group, benzimidazoline ring group, benzothiazoline ring group or 3,4-methylenedioxyphenyl-l-yl ring group.

An arylamino group (especially anilino), an aryl group (especially phenyl) or an aromatic or nonaromatic heterocyclic group is most preferred as $RED_3$.

When $RED_3$ represents an aryl group, it is preferred that the aryl group has at least one electron-donating group. Herein, the electron-donating group specifically refers to a hydroxyl group, alkoxy group, mercapto group, alkylthio group, sulfonamido group, acylamino group, alkylamino group, arylamino group, heterocyclic amino group, active methine group, electron-excessive aromatic heterocyclic group (e.g., indolyl, pyrrolyl or indazolyl), or a nonaromatic nitrogen-containing heterocyclic group that is bonded to $L_3$ via its nitrogen atom (e.g., pyrrolidinyl, indolinyl, piperidinyl, piperazinyl, morpholino or thiomorpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. These two electron-withdrawing groups may be bonded with each other to thereby form a cyclic structure.

When $RED_3$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to $L_3$ via its nitrogen atom. More preferably, the substituent is an alkylamino group, hydroxyl group, active methine group, or nonaromatic nitrogen-containing heterocyclic group that is bonded to $L_3$ via its nitrogen atom. Most preferably, the substituent is an alkylamino group, or nonaromatic nitrogen-containing heterocyclic group that is bonded to $L_3$ via its nitrogen atom.

In the general formula (D), $Y_3$ represents a reactive group capable of reacting with the one-electron oxidation product formed as a result of a one-electron oxidation of $RED_3$ to thereby form a new bond. Specifically, $Y_3$ represents an organic group having a carbon to carbon double bond moiety, carbon to carbon triple bond moiety, aromatic group moiety, or benzo-condensed nonaromatic heterocyclic group moiety. When the reactive group represented by $Y_3$ is an organic group having a carbon to carbon double bond or carbon to carbon triple bond moiety, it may have a substituent. Two of such substituents may be bonded with each other thereby to form a ring. As an organic group comprising a carbon to carbon double bond moiety and carbon to carbon triple bond moiety, a substituted or unsubstituted vinyl group and a substituted or unsubstituted ethynyl group can be mentioned, respectively. The substituent of the substituted organic group can preferably be any of, for example, an alkyl group (preferably having 1 to 8 carbon atoms), aryl group (preferably having 6 to 12 carbon atoms), cyano group, alkoxycarbonyl group (preferably having 2 to 8 carbon atoms), carbamoyl group, acyl group and electron-donating group. Herein, the electron-donating group refers to any of an alkoxy group (preferably having 1 to 8 carbon atoms), hydroxyl group, amino group, alkylamino group (preferably having 1 to 8 carbon atoms), arylamino group (preferably having 6 to 12 carbon atoms), heterocyclic amino group (preferably having 2 to 6 carbon atoms), sulfonamido group, acylamino group, active methine group, mercapto group, an alkylthio group (preferably having 1 to 8 carbon atoms), arylthio group (preferably having 6 to 12 carbon atoms) and aryl group having any of these groups as a substituent (the number of carbon atoms of the aryl moiety is preferably in the range of 6 to 12). The hydroxyl group may be protected with a silyl group, for example, a trimethylsilyloxy group, t-butyldimethylsilyloxy group, triphenylsilyloxy group, triethylsilyloxy group or phenyldimethylsilyloxy group.

When $Y_3$ represents an organic group comprising a carbon to carbon double bond moiety that has a substituent, the substituent thereof is more preferably, for example, an alkyl group, phenyl group, acyl group, cyano group, alkoxycarbonyl group, carbamoyl group or electron-donating group. Herein, the electron-donating group preferably refers to any of an alkoxy group, hydroxyl group, which may be protected with a silyl group, amino group, alkylamino group, arylamino group, sulfonamido group, active methine group, mercapto group, alkylthio group and phenyl group having any of these electron-donating groups as a substituent, among the substituents mentioned above.

When the carbon to carbon double bond moiety has a hydroxyl group as a substituent, $Y_3$ contains a partial structure of the formula $>C_1=C_2(—OH)—$. This may be tautomerized into a partial structure of the formula $>C_1H—C_2(=O)—$. Further, in this structure, it is preferred that the substituent on $C_1$ carbon be an electron-withdrawing group. In this instance, $Y_3$ has a partial structure of "active methylene group" or "active methine group". The electron-withdrawing groups capable of providing this partial structure of active methylene group or active methine group are the same as mentioned in the above description of "active methine groups".

When $Y_3$ represents an organic group having a carbon to carbon triple bond moiety that has a substituent, the substituent is preferably, for example, an alkyl group, phenyl group, alkoxycarbonyl group, carbamoyl group or electron-donating group. Herein, the electron-donating group preferably refers to any of an alkoxy group, amino group, alkylamino group, arylamino group, heterocyclic amino group, sulfonamido group, acylamino group, active methine group, mercapto group, alkylthio group and phenyl group having any of these electron-donating groups as a substituent.

When $Y_3$ represents an organic group having an aromatic group moiety, the aromatic group is preferably an indole ring group or an aryl group (especially preferably a phenyl group) having an electron-donating group as a substituent. Herein, the electron-donating group preferably refers to a hydroxyl group, which may be protected with a silyl group, alkoxy group, amino group, alkylamino group, active methine group, sulfonamido group or mercapto group.

When $Y_3$ represents a benzo-condensed organic group having a nonaromatic heterocyclic group, the benzo-condensed nonaromatic heterocyclic group is preferably one having an aniline structure as an internal partial structure, which can be, for example, an indoline ring group, 1,2,3,4-tetrahydroquinoline ring group, 1,2,3,4-tetrahydroquinoxaline ring group or 4-quinolone ring group.

In the general formula (D), the reactive group represented by $Y_3$ is more preferably an organic group containing a carbon to carbon double bond moiety, aromatic group moiety or benzo-condensed nonaromatic heterocyclic group. Still more preferably, the reactive group is an organic group having a carbon to carbon double bond moiety, phenyl group having an electron-donating group as a substituent, indole ring group, or benzo-condensed nonaromatic heterocyclic group of having an aniline structure as an internal partial structure. Herein, it is more preferred that the carbon to carbon double bond moiety have at least one electron-donating group as a substituent.

When the reactive group represented by $Y_3$ of the general formula (D) has the same partial structure as that of the reducing group represented by $RED_3$ of the general formula (D) as a result of selection within the range described hereinbefore, also, preferred examples of the compounds of the general formula (D) are provided thereby.

In the general formula (D), $L_3$ represents a linking group which links between $RED_3$ and $Y_3$. For example, $L_3$ represents a group consisting of each of, or each of combinations of, a single bond, alkylene group, arylene group, heterocyclic group, —O—, —S—, —$NR_N$—, —C(=O)—, —$SO_2$—, —SO— and —P(=O)—. Herein, $R_N$ represents a hydrogen atom, alkyl group, aryl group or heterocyclic group. The linking group represented by $L_3$ may have a substituent. The substituent can be any of those mentioned hereinbefore as substituents which may be had by $RED_{11}$ of the general formula (A). The linking group represented by $L_3$ can engage in linkage by replacing one arbitrary hydrogen atom of each of the groups represented by $RED_3$ and $L_3$ at an arbitrary position thereof.

The linking group represented by $L_3$ of the general formula (D) is preferably such that, when the cationic radical species ($X^{+}$•) formed as a result of oxidation of $RED_3$ of the general formula (D) or radical species (X•) formed through splitting of proton therefrom reacts with the reactive group represented by $Y_3$ of the general formula (D) to thereby form a bond, the relevant atomic groups engaging therein can form a 3- to 7-membered cyclic structure including $L_3$. From this viewpoint, it is preferred that the radical species ($X^{+}$• or X•), the reactive group represented by $Y_3$ and the group $L_3$ be linked to each other by a group of 3 to 7 atoms.

As a preferred example of $L_3$, there can be mentioned a divalent linking group selected from a single bond, alkylene group (especially methylene, ethylene or propylene), an arylene group (especially phenylene), —C(=O)— group, —O— group, —NH— group, —N(alkyl group)- group and combinations thereof. Among the compounds of the general formula (D), preferred compounds are represented by the following general formulae (D-1) to (D-4):

(D-1)

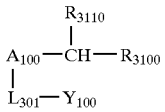

(D-2)

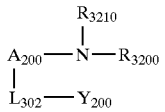

(D-3)

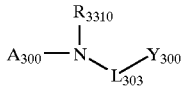

(D-4)

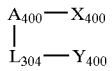

In the general formulae (D-1) to (D-4), each of $A_{100}$, $A_{200}$ and $A_{400}$ represents an arylene group or divalent heterocyclic group, and $A_{300}$ represents an aryl group or a heterocyclic group. The preferred range thereof is the same as that of $RED_3$ of the general formula (D). Each of $L_{301}$, $L_{302}$, $L_{303}$ and $L_{304}$ represents a linking group. With respect to these, not only the meanings but also the preferred ranges thereof are the same as those of $L_3$ of the general formula (D). Each of $Y_{100}$, $Y_{200}$, $Y_{300}$ and $Y_{400}$ represents a reactive group. With respect to these, not only the meanings but also the preferred ranges thereof are the same as those of $Y_3$ of the general formula (D). Each of $R_{3100}$, $R_{3110}$, $R_{3200}$, $R_{3210}$ and $R_{3310}$ represents a hydrogen atom or substituent. Each of $R_{3100}$ and $R_{3110}$ preferably represents a hydrogen atom, alkyl group or aryl group. Each of $R_{3200}$ and $R_{3310}$ preferably represents a hydrogen atom. $R_{3210}$ preferably represents a substituent. This substituent is preferably an alkyl group or aryl group. $R_{3110}$ and $A_{100}$; $R_{3210}$ and $A_{200}$; and $R_{3310}$ and $A_{300}$ may be bonded with each other to thereby form a cyclic structure. The thus formed cyclic structure is preferably, for example, a tetralin ring, indane ring, tetrahydroquinoline ring or indoline ring. $X_{400}$ represents a hydroxyl group, mercapto group or alkylthio group, preferably represents a hydroxyl group or mercapto group, and more preferably represents a mercapto group.

Among the compounds of the general formulae (D-1) to (D-4), the compounds of the general formulae (D-2), (D-3) and (D-4) are preferred. The compounds of the general formulae (D-2) and (D-3) are more preferred. The compound of Type 4 will be described below. The compound of Type 4 is a compound having a circular structure substituted with a reducing group, which compound can undergo a one-electron oxidation of the reducing group and thereafter a cleavage reaction of the circular structure to thereby further release one or more electrons.

In the compound of Type 4, the cyclic structure is cleaved after a one-electron oxidation. Herein, the cyclic cleavage reaction refers to the following scheme of reaction:

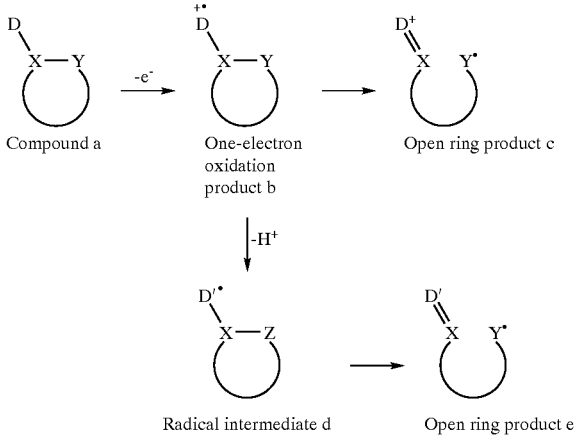

In the formulae, the compound a represents a compound of Type 4. In the compound a, D represents a reducing group, and X and Y represent atoms forming a bond of the circular structure which is cleaved after a one-electron oxidation. First, the compound a undergoes a one-electron oxidation to thereby form a one-electron oxidation product b. Then, the D-X single bond is converted to a double bond, and simultaneously the X-Y bond is cleaved to thereby form an open-ring product c. An alternative route wherein a proton is split from the one-electron oxidation product b to thereby form a radical intermediate d, from which an open-ring product e is similarly formed, may be taken. One or more electrons are further released from the thus formed open-ring product c or e. The characteristic of this compound of the present invention resides in this respect.

The cyclic structure of the compound of Type 4 refers to a nonaromatic, saturated or unsaturated, monocyclic or condensed-ring, 3- to 7-membered carbon ring or heterocycle. A saturated cyclic structure is preferred, and a 3- or 4-membered ring is more preferred. As preferred cyclic structures, there can be mentioned a cyclopropane ring, cyclobutane ring, oxirane ring, oxetane ring, aziridine ring, azetidine ring, episulfide ring and thietane ring. Of these, a cyclopropane ring, cyclobutane ring, oxirane ring, oxetane ring and azetidine ring are preferred. A cyclopropane ring, cyclobutane ring and azetidine ring are more preferred. The cyclic structure may have a substituent.

The compound of type 4 is preferably represented by the general formula (E) or (F).

(E)

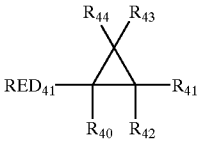

-continued (F)

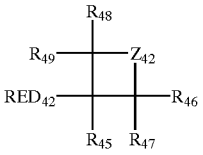

With respect to $RED_{41}$ and $RED_{42}$ of the general formulae (E) and (F), not only the meanings but also the preferred ranges thereof are the same as those of $RED_{12}$ of the general formula (B). Each of $R_{40}$ to $R_{44}$ and $R_{45}$ to $R_{49}$ represents a hydrogen atom or substituent. The substituent can be any of those which may be had by $RED_{12}$. In the general formula (F), $Z_{42}$ represents —$CR_{420}R_{421}$—, —$NR_{423}$— or —. Each of $R_{420}$ and $R_{421}$ represents a hydrogen atom or substituent, and $R_{423}$ represents a hydrogen atom, alkyl group, aryl group or heterocyclic group.

In the general formula (E), $R_{40}$ preferably represents any of a hydrogen atom, alkyl group, alkenyl group, alkynyl group, aryl group, heterocyclic group, alkoxy group, amino group, alkylamino group, arylamino group, heterocyclic amino group, alkoxycarbonyl group, acyl group, carbamoyl group, cyano group and sulfamoyl group. Of these, a hydrogen atom, alkyl group, aryl group, heterocyclic group, alkoxy group, alkoxycarbonyl group, acyl group and carbamoyl group are more preferred. A hydrogen atom, alkyl group, aryl group, heterocyclic group, alkoxycarbonyl group and carbamoyl group are most preferred.

With respect to $R_{41}$ to $R_{44}$, it is preferred that a case wherein at least one thereof be a donating group. It is also preferred that a case wherein $R_{41}$ and $R_{42}$; or $R_{43}$ and $R_{44}$ be simultaneously electron-withdrawing groups. More preferably, at least one of $R_{41}$ to $R_{44}$ is a donating group. Most preferably, at least one of $R_{41}$ to $R_{44}$ is a donating group while, a group(s) that is not a donating group among $R_{41}$ to $R_{44}$, is (are) a hydrogen atom or alkyl group. The electron-withdrawing groups are the same as those mentioned in the above description of active methine group.

Herein, the donating group refers to a hydroxyl group, alkoxy group, aryloxy group, mercapto group, acylamino group, sulfonylamino group, active methine group, or group selected from preferred examples of the $RED_{41}$ and $RED_{42}$ groups. As the donating group, there can preferably be used any of an alkylamino group, arylamino group, heterocyclic amino group, 5-membered aromatic heterocyclic group having one nitrogen atom in its ring, which may be monocyclic or in the form of condensed rings, a nonaromatic nitrogen-containing heterocyclic group that is bonded to the carbon atom of the general formula (E) via its nitrogen atom and phenyl group substituted with at least one electron-donating group, wherein the electron-donating group refers to a hydroxyl group, alkoxy group, aryloxy group, amino group, alkylamino group, arylamino group, heterocyclic amino group or nonaromatic nitrogen-containing heterocyclic group that is bonded to the carbon atom of the general formula (E) via its nitrogen atom). Of these, an alkylamino group, arylamino group, 5-membered aromatic heterocyclic group having one nitrogen atom in its ring, wherein the aromatic heterocycle refers to an indole ring, pyrrole ring or carbazole ring, and a phenyl group substituted with at least one electron-donating group, in particular, a phenyl group substituted with three or more alkoxy groups or a phenyl group substituted with a hydroxyl group, alkylamino group or arylamino group, are more preferred. An arylamino group, 5-membered aromatic heterocyclic group having one nitrogen atom in its ring, wherein the 5-membered aromatic heterocyclic group represents a 3-indolyl group, and a phenyl group substituted with at least one electron-donating group, in particular, a trialkoxyphenyl group or a phenyl group substituted with an alkylamino group or arylamino group, are most preferred.

In the general formula (F), the preferred range of $R_{45}$ is the same as described above with respect to $R_{40}$ of the general formula (E). Each of $R_{46}$ to $R_{49}$ preferably represents any of a hydrogen atom, alkyl group, alkenyl group, alkynyl group, aryl group, heterocyclic group, hydroxyl group, alkoxy group, amino group, alkylamino group, arylamino group, heterocyclic amino group, mercapto group, arylthio group, alkylthio group, acylamino group and sulfonamino group. Of these, a hydrogen atom, alkyl group, aryl group, heterocyclic group, alkoxy group, alkylamino group, arylamino group and heterocyclic amino group are more preferred. Most preferably, each of $R_{46}$ to $R_{49}$ represents a hydrogen atom, alkyl group, aryl group, heterocyclic group, alkylamino group or arylamino group when $Z_{42}$ represents a group of the formula —$CR_{420}R_{421}$—; represents a hydrogen atom, alkyl group, aryl group or heterocyclic group when $Z_{42}$ represents a —$NR_{423}$—; and represents a hydrogen atom, alkyl group, aryl group or heterocyclic group when $Z_{42}$ represents —O—.

$Z_{42}$ preferably represents —$CR_{420}R_{421}$— or —$NR_{423}$—, and more preferably represents —$NR_{423}$—. Each of $R_{420}$ and $R_{421}$preferably represents any of a hydrogen atom, alkyl group, alkenyl group, alkynyl group, aryl group, heterocyclic group, hydroxyl group, alkoxy group, amino group, mercapto group, acylamino group and sulfonamino group. Of these, a hydrogen atom, alkyl group, aryl group, heterocyclic group, alkoxy group and amino group are more preferred. $R_{423}$ preferably represents a hydrogen atom, alkyl group, aryl group or aromatic heterocyclic group, and more preferably represents methyl, ethyl, isopropyl, t-butyl, t-amyl, benzyl, diphenylmethyl, allyl, phenyl, naphthyl, 2-pyridyl, 4-pyridyl or 2-thiazolyl.

When each of $R_{40}$ to $R_{49}$, $R_{420}$, $R_{421}$ and $R_{423}$ represents a substituent, the total number of carbon atoms of each thereof is preferably 40 or less, more preferably 30 or less, and most preferably 15 or less. These substituents may be bonded with each other or bonded with other moieties (e.g., $RED_{41}$, $RED_{42}$ or $Z_{42}$) of the molecule to thereby form rings.

It is preferred that the compounds of types 1, 3 and 4 according to the present invention be "compounds each having, in its molecule, an adsorptive group acting on silver halides" or "compounds each having, in its molecule, a partial structure of spectral sensitizing dye". More preferably, the compounds of types 1, 3 and 4 according to the present invention are "compounds each having, in its molecule, an adsorptive group acting on silver halides". The compound of Type 2 is a "compound having, in its molecule, two or more adsorptive groups acting on silver halides". The compounds of types 1 to 4 are more preferably "compounds each having a nitrogen-containing heterocyclic group substituted with two or more mercapto groups as an adsorptive group".

With respect to the compounds of types 1 to 4 according to the present invention, the adsorptive group acting on silver halides refers to a group directly adsorbed onto silver halides or a group capable of promoting the adsorption onto silver halides. For example, the adsorptive group is a mercapto group (or a salt thereof), thione group (—C(=S)—), heterocyclic group containing at least one atom selected from a nitrogen atom, sulfur atom, selenium atom and tellurium atom, sulfido group, cationic group or ethynyl group. Provided however that, with respect to the compound of Type 2 according to the present invention, a sulfido group is not included in the adsorptive groups thereof.

The terminology "mercapto group (or a salt thereof)" as the adsorptive group means not only a mercapto group (or a salt thereof) per se but also, preferably, a heterocyclic, aryl or alkyl group substituted with at least one mercapto group (or a salt thereof). Herein, the heterocyclic group refers to a 5- to 7-membered, monocyclic or condensed-ring, aromatic or nonaromatic heterocycle. As the heterocyclic group, there can be mentioned, for example, an imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group or triazine ring group. The heterocyclic group may be one containing a quaternary nitrogen atom, which may become a mesoion as a result of dissociation of a substituted mercapto group. This heterocyclic group can be, for example, any of an imidazolium ring group, pyrazolium ring group, thiazolium ring group, triazolium ring group, tetrazolium ring group, thiadiazolium ring group, pyridinium ring group, pyrimidinium ring group and triazinium ring group. Of these groups, a triazolium ring group (e.g., 1,2,4-triazolium-3-thiolate ring group) is preferred. The aryl group can be, for example, a phenyl group or naphthyl group. The alkyl group can be a linear, or branched, or cyclic alkyl group having 1 to 30 carbon atoms. When the mercapto group forms a salt, as the counter ion, there can be mentioned, for example, a cation of alkali metal, alkaline earth metal or heavy metal (e.g., $Li^+$, $Na^+$, $K^+$, $Mg^{2+}$, $Ag^+$ or $Zn^{2+}$), an ammonium ion, a heterocyclic group containing a quaternary nitrogen atom, or a phosphonium ion.

The mercapto group as the adsorptive group may further be tautomerized into a thione group. As such, there can be mentioned, for example, a thioamido group (herein a —C(=S)—NH— group) or a group containing a partial structure of the thioamido group, namely, a linear or cyclic thioamido group, thioureido group, thiourethane group or dithiocarbamic acid ester group. As examples of suitable cyclic groups, there can be mentioned, for example, a thiazolidine-2-thione group, oxazolidine-2-thione group, 2-thiohydantoin group, rhodanine group, isorhodanine group, thiobarbituric acid group and 2-thioxo-oxazolidin-4-one group. The thione groups as the adsorptive group include not only the above thione groups resulting from tautomerization of mercapto groups but also a linear or cyclic thioamido group, thioureido group, thiourethane group and dithiocarbamic acid ester group which cannot be tautomerized into mercapto groups, i.e., not having any hydrogen atom at the a-position of thione group.

The heterocyclic group containing at least one atom selected from a nitrogen atom, sulfur atom, selenium atom and tellurium atom as the adsorptive group is a nitrogen-containing heterocyclic group having an —NH— group capable of forming an iminosilver (>NAg) as a partial structure of the heterocycle, or a heterocyclic group having an "—S—" group or "—Se—" group or "—Te—" group or "=N—" group capable of coordinating to silver ion by coordinate bond as a partial structure of the heterocycle. The former heterocyclic group can be, for example, a benzotriazole group, triazole group, indazole group, pyrazole group, tetrazole group, benzimidazole group, imidazole group or purine group. The latter heterocyclic group can be, for example, a thiophene group, thiazole group, oxazole group, benzothiazole group, benzoxazole group, thiadiazole group, oxadiazole group, triazine group, selenoazole group, benzoselenoazole group, tellurazole group or benzotellurazole group. The former heterocyclic group is preferred.

As the sulfido group as the adsorptive group, there can be mentioned all the groups having a partial structure of "—S—". Preferably, the sulfido group is a group having a partial structure of alkyl (or alkylene) —S— alkyl (or alkylene), aryl (or arylene) —S— alkyl (or alkylene), or aryl (or arylene) —S-aryl (or arylene). This sulfido group may be in the form of a cyclic structure or —S—S— group. As examples of sulfido groups forming a cyclic structure, there can be mentioned groups containing a thiolane ring, 1,3-dithiolane ring, 1,2-dithiolane ring, thiane ring, dithiane ring, tetrahydro-1,4-thiazine ring (thiomorpholine ring) or the like. Among the sulfido groups, groups having a partial structure of alkyl (or alkylene) —S-alkyl (or alkylene) are especially preferred.

The cationic group as the adsorptive group refers to a group containing a quaternary nitrogen atom. For example, it is a group containing an ammonio group or a nitrogen-containing heterocyclic group containing a quaternary nitrogen atom. However, the cationic group does not become part of an atomic group forming a dye structure (for example, cyanine chromophore). Herein, the ammonio group is, for example, a trialkylammonio group, dialkylarylammonio group or alkyldiarylammonio group. For example, as such, there can be mentioned benzyldimethylammonio group, trihexylammonio group or phenyldiethylammonio group. The nitrogen-containing heterocyclic group containing a quaternary nitrogen atom can be, for example, any of pyridinio group, quinolinio group, isoquinolinio group and imidazolio group. Of these, pyridinio group and imidazolio group are preferred. A pyridinio group is most preferred. The nitrogen-containing heterocyclic group containing a quaternary nitrogen atom may have an arbitrary substituent. However, when the nitrogen-containing heterocyclic group is a pyridinio group or imidazolio group, the substituent is preferably selected from, for example, an alkyl group, aryl group, acylamino group, chlorine atom, alkoxycarbonyl group and carbamoyl group. When the nitrogen-containing heterocyclic group is a pyridinio group, the substituent is most preferably a phenyl group.

The ethynyl group as the adsorptive group refers to a —C≡CH group, whose hydrogen atom may be replaced by a substituent.

The above adsorptive groups may have an arbitrary substituent.

Furthermore, examples of suitable adsorptive groups include those listed on pages 4 to 7 of Jpn. Pat. Appln. KOKAI Publication No. (hereinafter referred to as JP-A-) 11-95355, (U.S. Pat. No. 6,054,260, the entire contents of which is incorporated herein by reference).

In the present invention, it is preferred that the adsorptive group be a nitrogen-containing heterocyclic group substituted with mercapto (e.g., a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazolium-3-thiolate group), or a nitrogen-containing heterocyclic group having an —NH— group capable of forming an iminosilver (>NAg) as a partial structure of the heterocycle (e.g., a benzotriazole group, benzimidazole group or indazole group). More preferably, the adsorptive group is a 5-mercaptotetrazole group, 3-mercapto-1,2,4-triazole group or benzotriazole group. Most preferably, the adsorptive group is a 3-mercapto-1,2,4-triazole group or 5-mercaptotetrazole group.

Among the compounds of the present invention, those having, in its molecule, two or more mercapto groups as partial structures are also especially preferred. Herein, the mercapto group (—SH) may become a thione group when it can be tautomerized. Examples of such compounds may include a compound possessing in its molecule two or more adsorptive groups having the above mercapto group or thione group as a partial structure (e.g., a ring forming thioamido group, alkylmercapto group, arylmercapto group or heterocyclic mercapto group), and a compound possessing at least one adsorptive group having, in the adsorptive group per se, two or more mercapto groups or thione groups as a partial structure (e.g., a dimercapto-substituted nitrogen-containing heterocyclic group).

As examples of adsorptive groups having two or more mercapto groups as a partial structure (e.g., dimercapto-substituted nitrogen-containing heterocyclic groups), there can be mentioned a 2,4-dimercaptopyrimidine group, 2,4-dimercaptotriazine group, 3,5-dimercapto-1,2,4-triazole group, 2,5-dimercapto-1,3-thiazole group, 2,5-dimercapto-1,3-oxazole group, 2,7-dimercapto-5-methyl-s-triazolo[1,5-a]pyrimidine group, 2,6,8-trimercaptopurine group, 6,8-dimercaptopurine group, 3,5,7-trimercapto-s-triazolotriazine group, 4,6-dimercaptopyrazolopyrimidine group and 2,5-dimercaptoimidazole group. Of these, a 2,4-dimercaptopyrimidine group, 2,4-dimercaptotriazine group and 3,5-dimercapto-1,2,4-triazole group are especially preferred.

Although substitution with the adsorptive group may be effected at any position of the general formulae (A) to (F) and general formulae (1) to (3), it is preferred that the substitution be effected at $RED_{11}$, $RED_{12}$, $RED_2$ and $RED_3$ in the general formulae (A) to (D); at $RED_{41}$, $R_{41}$, $RED_{42}$ and $R_{46}$ to $R_{48}$ in the general formulae (E) and (F); and at any arbitrary position except $R_1$, $R_2$, $R_{11}$, $R_{12}$, $R_{31}$, $L_1$, $L_{21}$ and $L_{31}$ in the general formulae (1) to (3). It is more preferred that, in all the general formulae (A) to (F), the substitution be effected at $RED_{11}$ to $RED_{42}$.

The partial structure of spectral sensitizing dye refers to a group containing a chromophore of spectral sensitizing dye, and refers to a residue resulting from removal of an arbitrary hydrogen atom or substituent from a spectral sensitizing dye compound. Although substitution with the partial structure of spectral sensitizing dye may be effected at any position of the general formulae (A) to (F) and general formulae (1) to (3), it is preferred that the substitution be effected at $RED_{11}$, $RED_{12}$, $RED_2$ and $RED_3$ in the general formulae (A) to (D); at $RED_{41}$, $R_{41}$, $RED_{42}$ and $R_{46}$ to $R_{48}$ in the general formulae (E) and (F); and at any arbitrary position except $R_1$, $R_2$, $R_{11}$, $R_{12}$, $R_{31}$, $L_1$, $L_{21}$ and $L_{31}$ in the general formulae (1) to (3). It is more preferred that, in all the general formulae (A) to (F), the substitution be effected at $RED_{11}$ to $RED_{42}$. Preferred spectral sensitizing dyes are those typically employed in color sensitization techniques, which include, for example, cyanine dyes, composite cyanine dyes, merocyanine dyes, composite merocyanine dyes, homopolar cyanine dyes, styryl dyes and hemicyanine dyes. Representative spectral sensitizing dyes are disclosed in Research Disclosure, item 36544, September 1994, the entire contents of which are incorporated herein by reference. These spectral sensitizing dyes can be synthesized by persons skilled in the art to which the invention pertains in accordance with the procedure described in the above Research Disclosure or F. M. Hamer "The Cyanine Dyes and Related Compounds", Interscience Publishers, New York, 1964. Further, all the dyes described on pages 7 to 14 of JP-A-11-95355 (U.S. Pat. No. 6,054,260, entire contents of which are incorporated herein by reference) per se are applicable.

With respect to the compounds of types 1 to 4 according to the present invention, the total number of carbon atoms is preferably in the range of 10 to 60, more preferably 10 to 50, most preferably 11 to 40, and optimally 12 to 30.

With respect to the compounds of types 1 to 4 according to the present invention, a one-electron oxidation thereof is induced upon exposure of the silver halide photographic photosensitive material using the compounds. After the subsequent reaction, another electron, or two or more electrons depending on the type of compound are released to thereby cause further oxidation. The oxidation potential with respect to the first electron is preferably about 1.4 V or below, more preferably 1.0 V or below. This oxidation potential is preferably higher than 0 V, more preferably higher than 0.3 V. Thus, the oxidation potential is preferably in the range of about 0 to about 1.4 V, more preferably about 0.3 to about 1.0 V. Herein, the oxidation potential can be measured in accordance with the cyclic voltammetry technique. For example, a sample compound is dissolved in a solution consisting of a 80% :20% (vol. %) mixture of acetonitrile and water (containing 0.1 M lithium perchlorate), and nitrogen gas is passed through the solution for 10 min. Thereafter, the oxidation potential is measured at 25° C. and at a potential scanning rate of 0.1 V/sec with the use of a glassy carbon disk as a working electrode, a platinum wire as a counter electrode and a calomel electrode (SCE) as a reference electrode. The oxidation potential vs. SCE is determined at the peak potential of cyclic voltammetry wave.

With respect to, among the compounds of types 1 to 4 according to the present invention, those which undergo a one-electron oxidation and, after a subsequent reaction, further release another electron, the oxidation potential at the latter stage is preferably in the range of −0.5 to −2 V, more preferably −0.7 to −2 V, and most preferably −0.9 to −1.6 V.

With respect to, among the compounds of types 1 to 4 according to the present invention, those which undergo a one-electron oxidation and, after a subsequent reaction, further release two or more electrons to thereby effect oxidation, the oxidation potential at the latter stage is not particularly limited. The reason is that the oxidation potential with respect to the second electron cannot be clearly distinguished from the oxidation potential with respect to the third electron et seqq., so that it is often difficult to practically accomplish accurate measuring and distinguishing thereof.

Specific examples of the compounds of types 1 to 4 according to the present invention will be listed below, which however in no way limit the scope of the present invention.

1

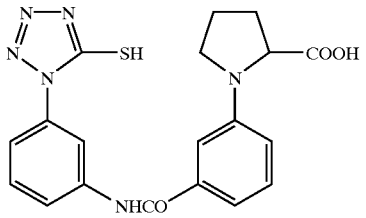

2

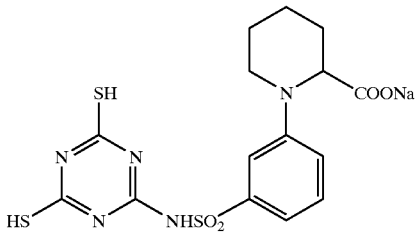

3

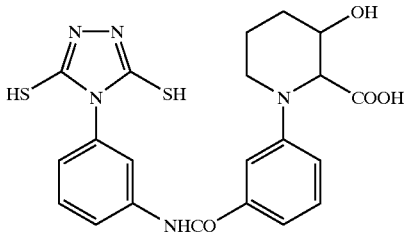

4

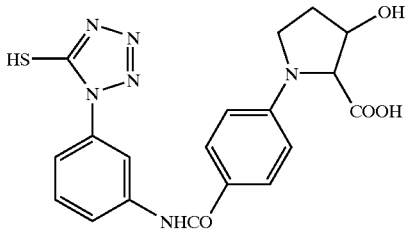

5

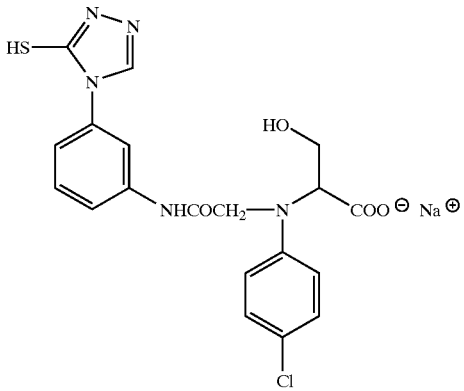

6

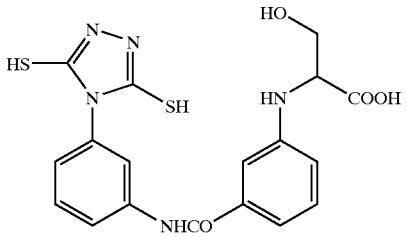

-continued
7
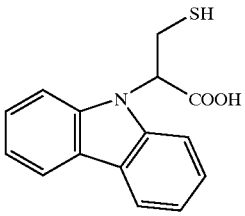
8
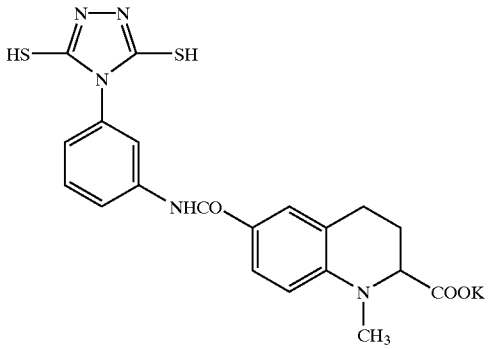
9
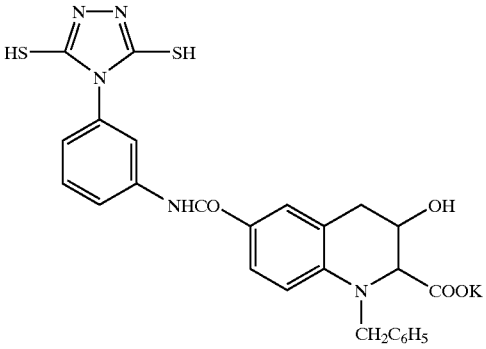
10
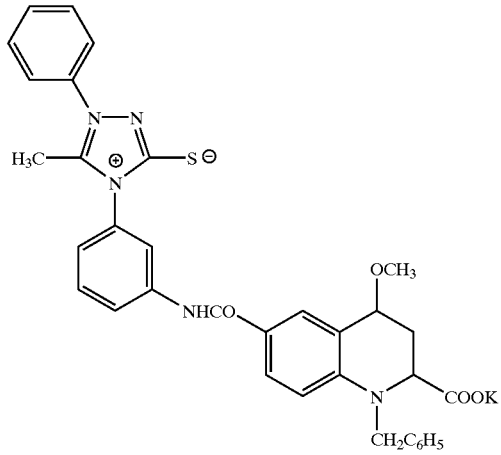
11
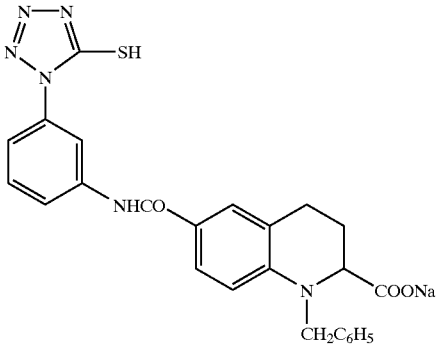
12
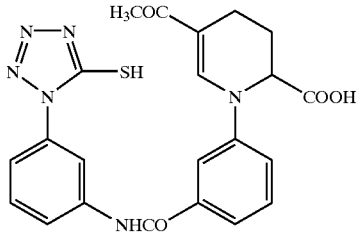
13
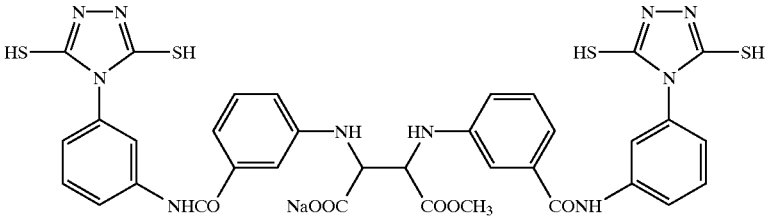
14
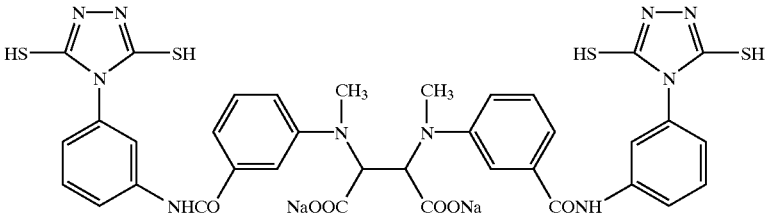

-continued
15
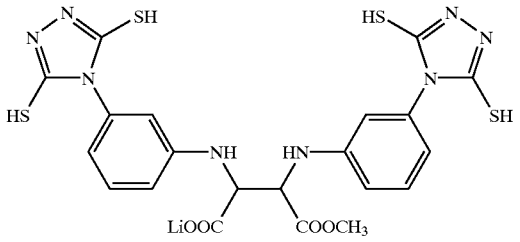
16
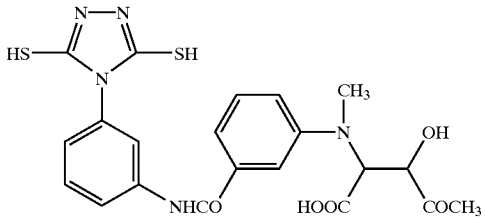
17
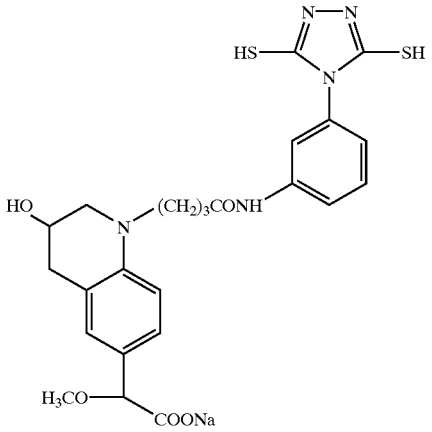
18
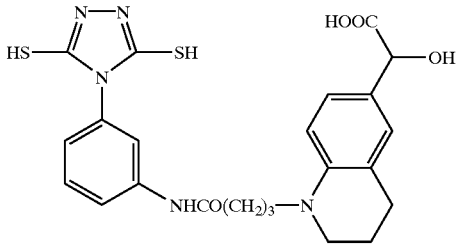
19
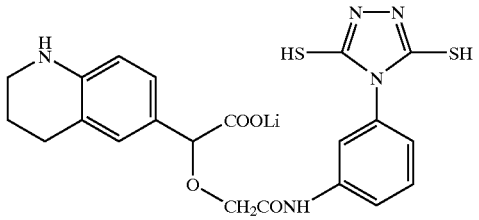
20
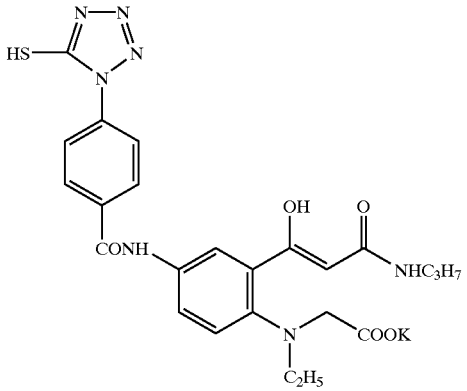
21
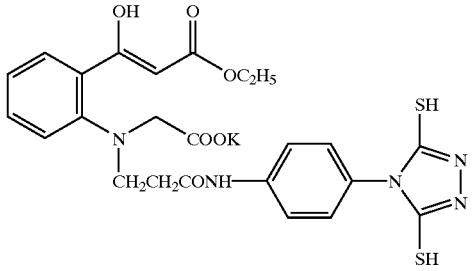
22
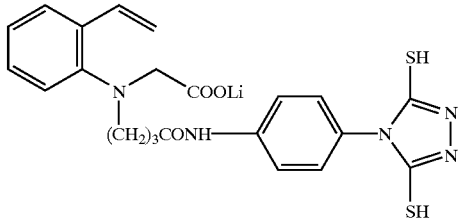

-continued
23
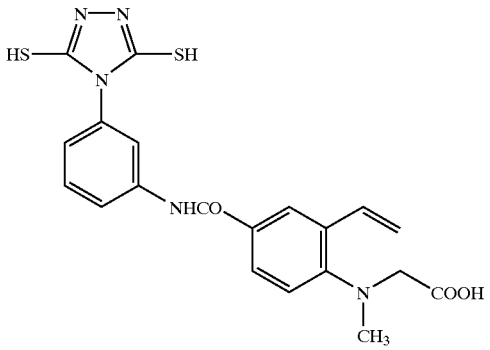
24
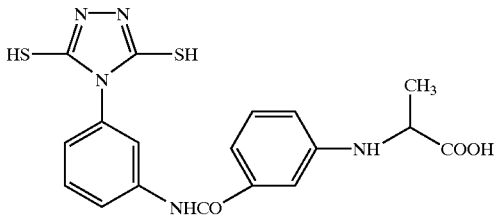
25
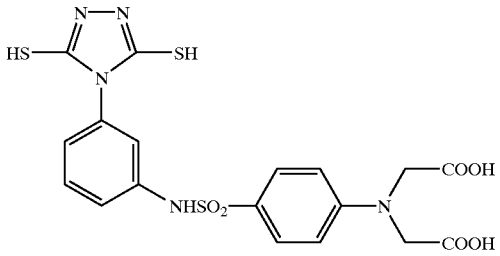
26
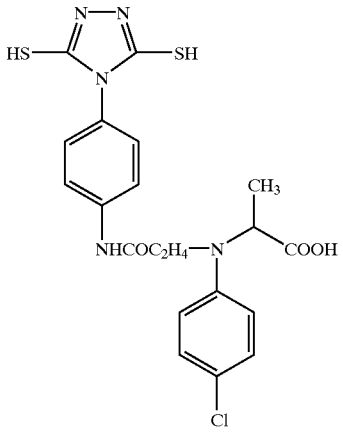
27
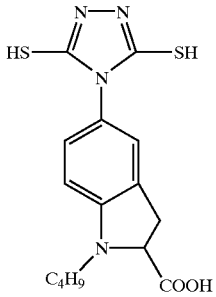
28
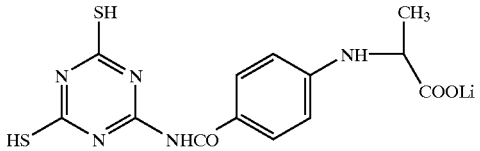
29
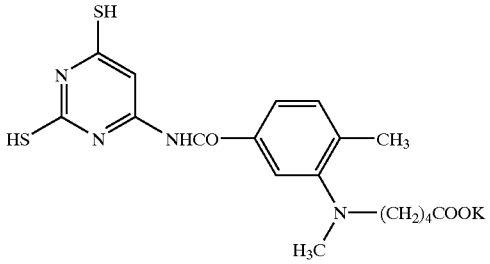
30
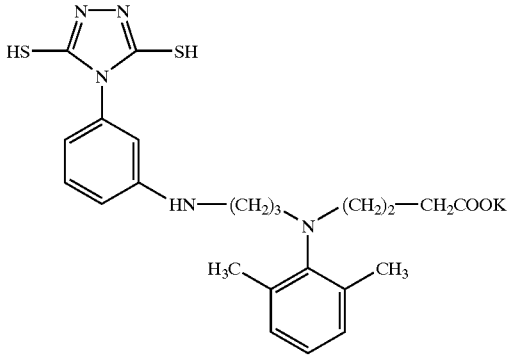

-continued
31
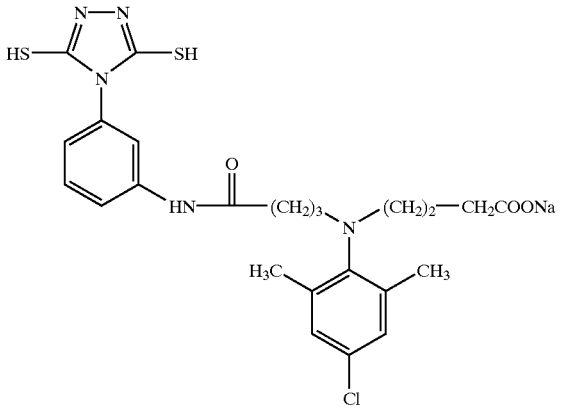
32
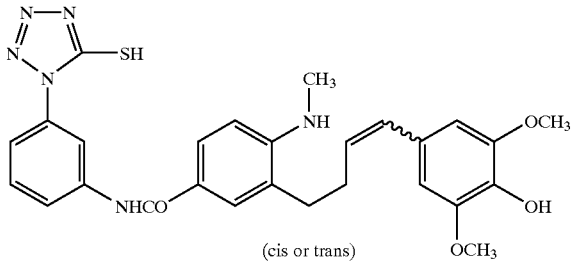
33
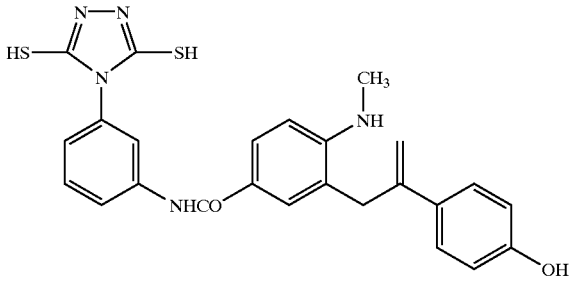
34
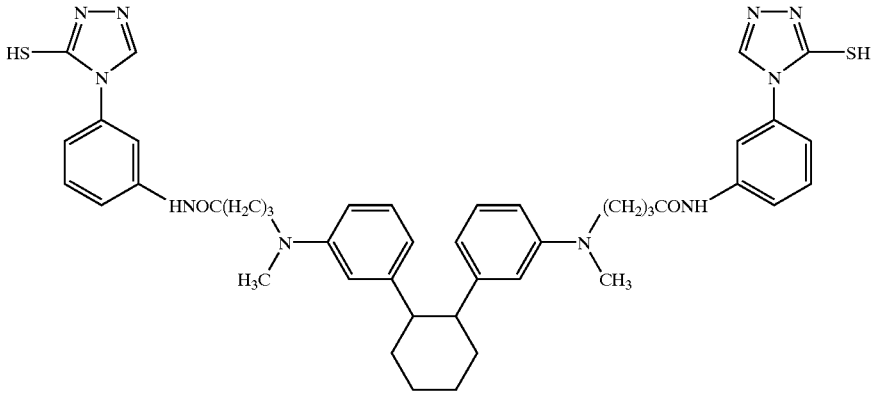
35
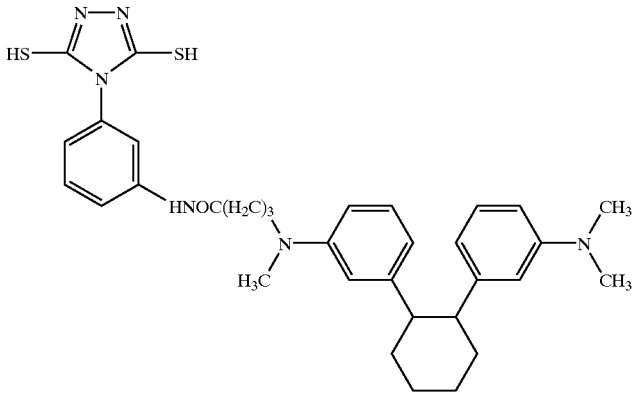

-continued
36
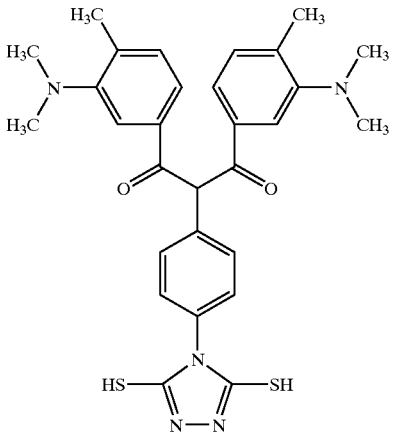
37
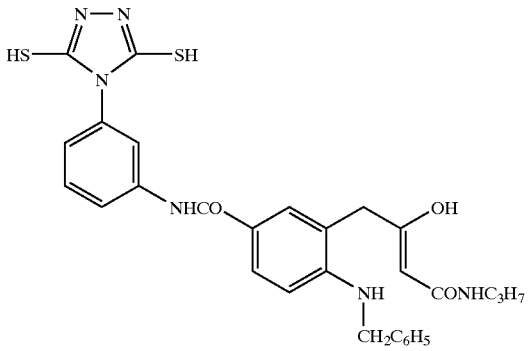
38
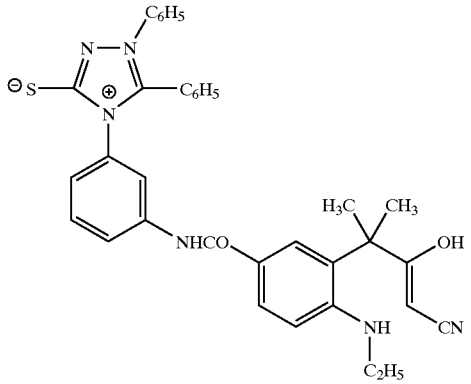
39
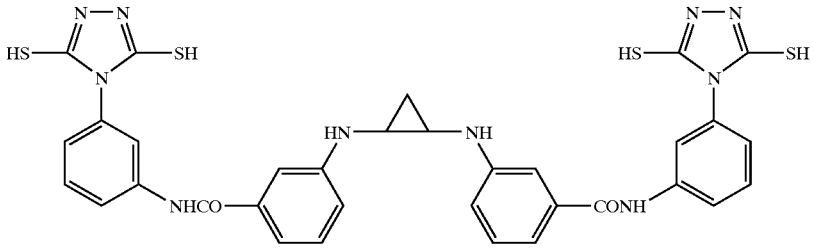
40
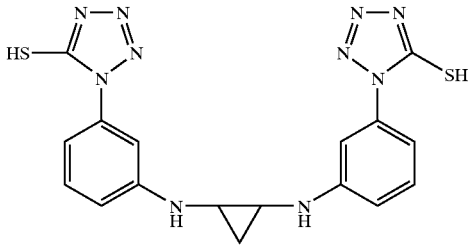
42
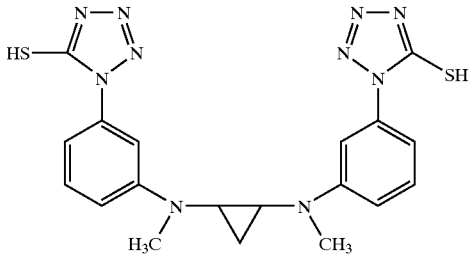

-continued
41
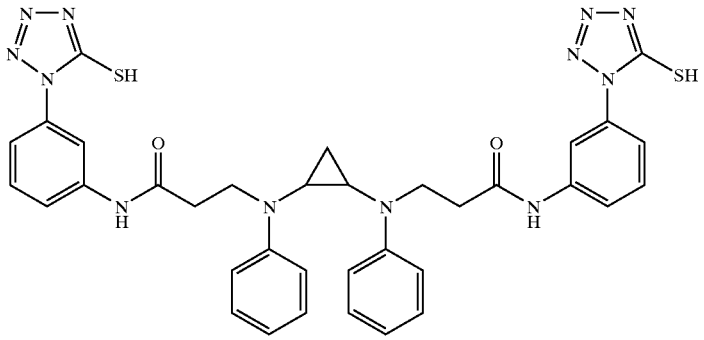
43
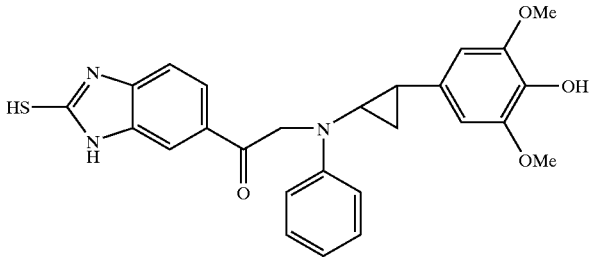
44
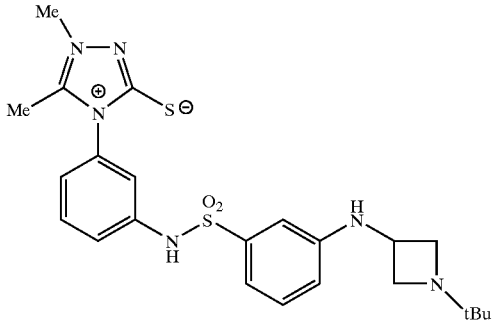
45
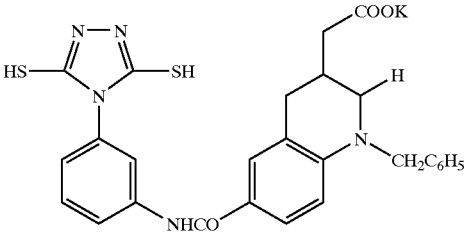
46
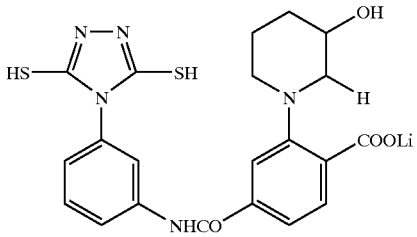
47
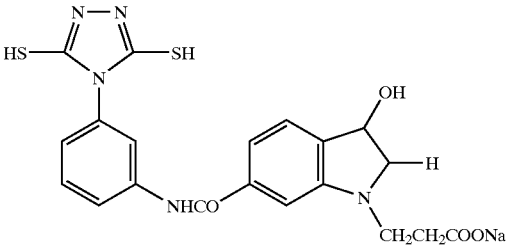
48
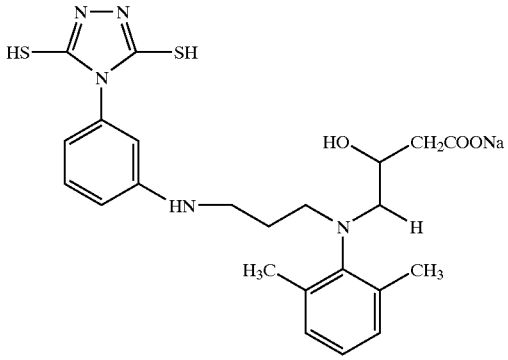
49
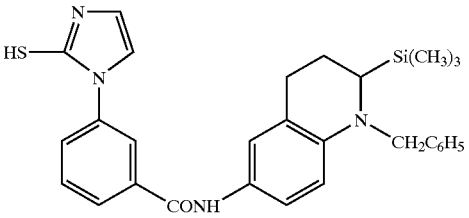

-continued
50
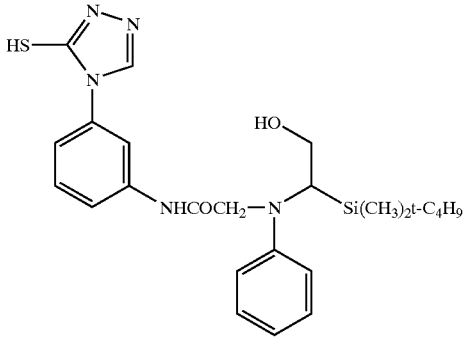
51
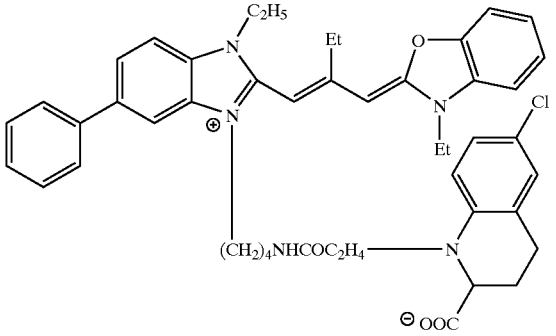
52
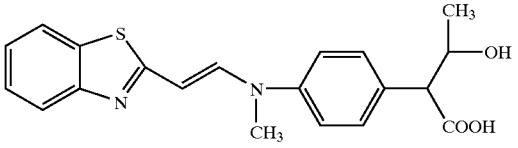
53
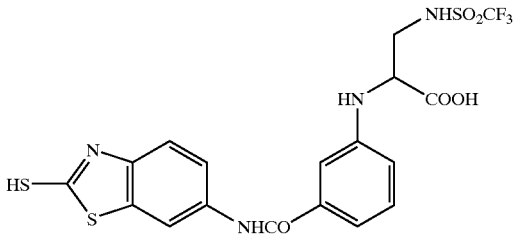
54
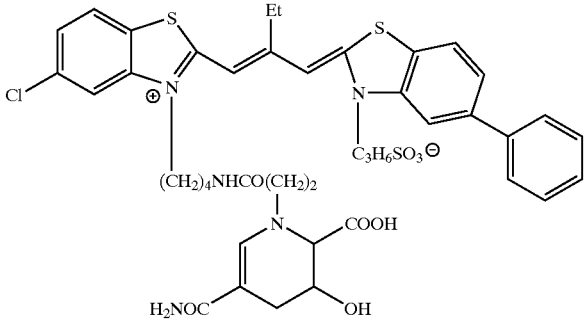
55
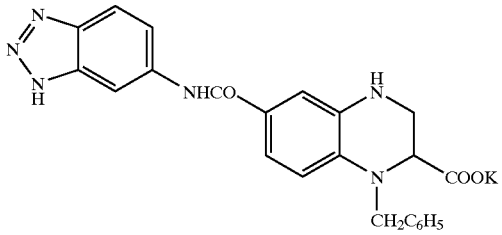
56
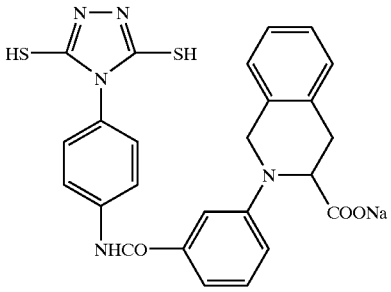

-continued

57

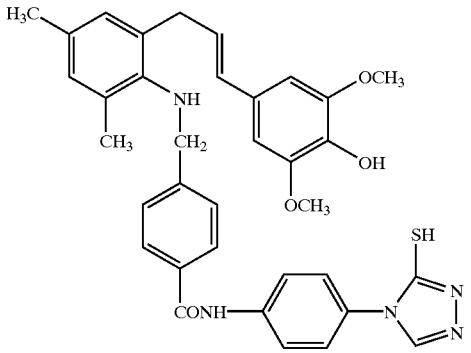

58

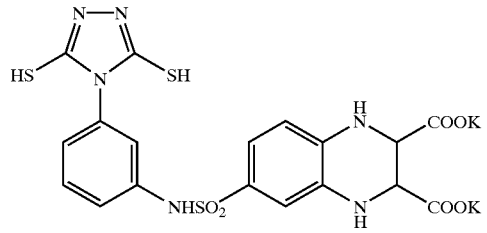

The compounds of types 1 to 4 according to the present invention are the same as those described in detail in Japanese Patent Applications Nos. 2001-272137, 2002-188536, 2002-188537 and 2002-192373, the entire contents of the Publications of which are incorporated herein by references. The specific compounds disclosed in the specifications of these patent applications can also be mentioned as specific examples of the compounds of types 1 to 4 according to the present invention. Further, examples of synthesis of the compounds of types 1 to 4 according to the present invention are also the same as those described in these patent applications.

The compound of types 1 to 4 may be used at any time during emulsion preparation or in photosensitive material manufacturing step, for example, during grain formation, at desalting step, at the time of chemical. sensitization, or before coating. The compound may be added separately in a plurality of times during the steps. Preferable addition timing is from the completion of grain formation to before a desalting step, at the time of chemical sensitization (immediately before the initiation of chemical sensitization to immediately after the completion thereof), or before coating. More preferable addition timing is at chemical sensitization or before coating.

The compound of types 1 to 4 according to the present invention may preferable be added by dissolving it to a water or water-soluble solvent such as methanol, ethanol or a mixture of solvents. When the compound is added to water, if the solubility of the compound increases in a case where pH is raised or lowered, the compound may be added to the solvent by raising or lowering the pH thereof.

It is preferable that the compound of types 1 to 4 according to the present invention is used in an emulsion layer, but the compound may be added in a protective layer or interlayer together with the emulsion layer, thereby making the compound diffuse during coating. The addition time of the compound of the invention is irrespective of before or after the addition time of a sensitizing dye. Each of the compounds is preferably contained in a silver halide emulsion layer in an amount of $1\times10^{-9}$ to $5\times10^{-2}$ mol, more preferably $1\times10^{-8}$ to $2\times10^{-3}$ mol pre mol of silver halide.

Next, the reducing compounds according to the present invention will now be described.

The term "reducing compound" in the present invention indicates a compound selected from hydroxylamines, hydroxamic acids, hydroxyureas, hydroxyurethanes, hydroxysemicarbazides, reductons (including reducton derivatives), anilines, phenols (including chroman-6-ols, 2,3-dihydrobenzofuran-5-ols, aminophenols, sulfonamidophenols, and polyphenols such as hydroquinones, catechols, resorcinols, benzenetriols and bisphenols), hydrazines, hydrazides, and Phenidons.

Hydroxylamines are compounds represeented by general formula ($B_1$), hydroxamic acids are compounds represented by general formula ($B_2$), hydroxyureas are compounds represented by general formula ($B_3$), hydroxyurethanes are compounds represented by general formula ($B_4$), hydroxysemicarbazides are compounds represented by general formula ($B_5$), reductons are compounds represented by general formula ($B_6$), anilines are compounds represented by general formula ($B_7$), phenols are compounds represented by general formulae ($B_8$), ($B_9$) and ($B_{10}$), hydrazines are compounds represented by general formula ($B_{11}$), hydrazides are compounds represented by general formula ($B_{12}$), and Phenidons are compounds represented by general formula ($B_{13}$).

($B_1$)

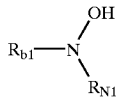

($B_2$)

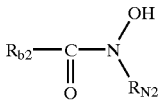

($B_3$)

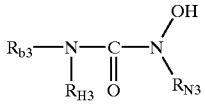

($B_4$)

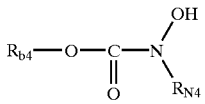

($B_5$)

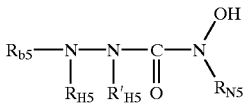

($B_6$)

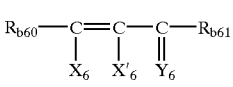

-continued (B7)

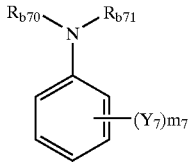

(B8)

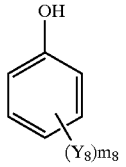

(B9)

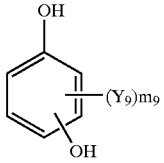

(B10)

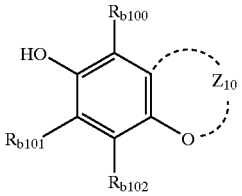

(B11)

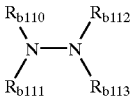

(B12)

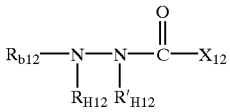

(B13)

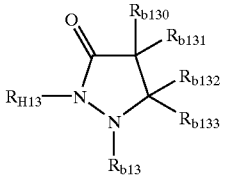

In the general formulae ($B_1$) to ($B_{13}$), each of $R_{b1}$, $R_{b2}$, $R_{b3}$, $R_{b4}$, $R_{b5}$, $R_{b70}$, $R_{b71}$, $R_{b110}$ $R_{b111}$, $R_{b112}$, $R_{b113}$, $R_{b12}$, $R_{b13}$, $R_{N1}$, $R_{N2}$, $R_{N3}$, $R_{N4}$, and $R_{N5}$ represents a hydrogen atom, alkyl group, aryl group, or heterocyclic group, each of $R_{H3}$, $R_{H5}$, $R'_{H5}$, $R_{H12}$, $R'_{H12}$, and $R_{H13}$ represents a hydrogen atom, alkyl group, aryl group, acyl group, alkylsulfonyl group or arylsulfonyl group, and among them $R_{H3}$ may further represent a hydroxy group. Each of $R_{b100}$, $R_{b101}$, $R_{b102}$, and $R_{b130}$ to $R_{b133}$ represents a hydrogen atom or a substituent. Each of $Y_7$ and $Y_8$ represents a substituent excluding a hydroxy group, $Y_9$ represents a substituent, $m_7$ represents an integer of 0 to 5, $m_8$ represents an integer of 1 to 5, and mg represents an integer of 0 to 4. If $m_7$, $m_8$ and $m_9$ represent 2 or greater, each pair of two adjacent $Y_7$'s, $Y_8$'s and $Y_9$'s may bind to each other to form an aryl group condensed to the benzene ring (for example, a benzene-condensed ring), and it may further have a substituent. $Z_{10}$ represents a nonmetallic atomic group which can form a ring, and $X_{12}$ represents a hydrogen atom, alkyl group, aryl group, heterocyclic group, alkoxy group, amino group (including alkylamino group, arylamino group, heterocyclic amino group, and cyclic amino group), or carbamoyl group.

In the general formula ($B_6$), each of $X_6$ and $X'_6$ represents a hydroxy group, alkoxy group, mercapto group, alkylthio group, amino group (including an alkylamino group, arylamino group, heterocyclic amino group, and a cyclic amino group), acylamino group, sulfonamido group, alkoxycarbonylamino group, ureido group, acyloxy group, acylthio group, alkylaminocarbonyloxy group, or arylaminocarbonyloxy group. Each of $R_{b60}$, $R_{b61}$ represents an alkyl group, aryl group, amino group, alkoxy group, or aryloxy group, and $R_{b60}$ and $R_{b61}$ may bind to each other to form a ring structure. $Y_6$ represents an oxygen atom or sulfur atom.

In the above explanation of each group in the general formulae ($B_1$) to ($B_{13}$), the term "alkyl group" (including an alkyl group of a group having an alkyl group moiety, such as an alkylsulfonyl group) indicates a substituted or unsubstituted, linear, branched or cyclic alkyl having 1 to 30 carbon atoms, the term "aryl group" (including an aryl group of a group having an aryl group moiety, such as an arylsulfonyl group) indicates a substituted or unsubstituted, monocyclic or condensed-ring aromatic hydrocarbon ring such as a phenyl group and naphthyl group, and the term "heterocyclic group" (including a heterocyclic group of a group having a heterocyclic group moiety, such as a heterocyclic amino group) indicates an aromatic or non-aromatic, monocyclic or condensed-ring, substituted or unsubstituted heterocyclic group containing at least one hetero atom.

Further, examples of the substituents herein are a halogen atom (fluorine atom, chlorine atom, bromine atom, or iodine atom), alkyl group (linear, branched or cyclic alkyl group, including bicycloalkyl group and active methine group), alkenyl group, alkynyl group, aryl group, heterocyclic group (regardless of position of substitution), acyl group, alkoxycarbonyl group, aryloxycarbonyl group, heterocyclicoxycarbonyl group, carbamoyl group, N-hydroxycarbamoyl group, N-acylcarbamoyl group, N-sulfonylcarbamoyl group, N-carbamoylcarbamoyl group, thiocarbamoyl group, N-sulfamoylcarbamoyl group, carbazoyl group, carboxy group or its salt, oxalyl group, oxamoyl group, cyano group, carbonimidoyl group, formyl group, hydroxy group, alkoxy group (including a group containing repeated ethyleneoxy group or propyleneoxy group units), aryloxy group, heterocyclicoxy group, acyloxy group, alkoxy- or aryloxycarbonyloxy group, carbamoyloxy group, sulfonyloxy group, amino group, alkyl-, aryl- or heterocyclic-amino group, acylamino group, sulfonamido group, ureido group, thioureido group, N-hydroxyureido group, imido group, alkoxy- or aryloxy-carbonylamino group, sulfamoylamino group, semicarbazido group, thiosemicarbazido group, hydrazino group, ammonio group, oxamoylamino group, N-alkyl- or N-aryl-sulfonylureido group, N-acylureido group, N-acylsulfamoylamino group, hydroxyomino group, nitro group, heterocyclic group containing a quaternized nitrogen atom (such as pyridinio group, imidazolio group, quinolinio group, and isoquinolinio group), isocyano group, imino group, mercapto group, alkyl-, aryl- or heterocyclic-thio group, alkyl-, aryl- or heterocyclic-dithio group, alkyl- or aryl-sulfonyl group, alkyl- or aryl-sulfinyl group, sulfo group or a salt thereof, sulfamoyl group, N-acylsulfamoyl group, N-sulfonylsulfamoyl group or a salt thereof, phosphino group, phosphinyl group, phosphinyloxy group, phosphinylamino group, and silyl group. The term "active methine group" herein indicates a methine group substituted by two electron-withdrawing groups, and the term "electron-withdrawing group" herein indicates an acyl group, alkoxycarbonyl group, aryloxycarbonyl group, carbamoyl group, alkylsulfonyl group, arylsulfonyl group, sulfamoyl group, trifluoromethyl group, cyano group, nitro group, and carbonimidoyl group. The two electron-withdrawing groups may bind to each other to form a ring structure. Further, the term "salt" indicates salt with a cation such as an alkaline metal, alkaline-earth metal or heavy metal, or with an organic cation such as an ammonium ion or phosphonium ion.

These substituents may be further substituted by the substituents.

In the general formulae ($B_1$) to ($B_5$), each of $R_{N1}$, $R_{N2}$, $R_{N3}$, $R_{N4}$, and $R_{N5}$ is preferably a hydrogen atom or alkyl group. The alkyl group is preferably a linear, branched or cyclic, substituted or unsubstituted alkyl group preferably having 1 to 12 carbon atoms, more preferably a linear or branched, substituted or unsubstituted alkyl group having 1 to 6 carbon atoms. Examples of such an alkyl group are a methyl group, ethyl group, propyl group, and benzyl group, etc. In the general formula ($B_1$), $R_{b1}$ is preferably an alkyl group or heterocyclic group. The alkyl group is a linear, branched or cyclic, substituted or unsubstituted alkyl group, preferably having 1 to 30 carbon atoms, more preferably having 1 to 18 carbon atoms. The heterocyclic group is 5- or 6-membered, monocyclic or condensed-ring, aromatic or non-aromatic heterocyclic group, which may have a substituent. The heterocyclic group is preferably an aromatic heterocyclic group, such as a pyridine ring group, pyrimidine ring group, triazine ring group, thiazole ring group, benzothiazole ring group, oxazole ring group, benzoxazole ring group, imidazole ring group, benzimidazole ring group, pyrazole ring group, indazole ring group, indole ring group, purine ring group, quinoline ring group, isoquinoline ring group, or quinazoline ring group. Especially preferable aromatic heterocyclic group is a triazine ring group or benzothiazole ring group. The alkyl group or heterocyclic group represented by $R_{b1}$ further having at least one or two —N($R_{N1}$)OH group as its substituent is also a preferable example of the compound represented by the general formula ($B_1$).

In the general formula ($B_2$), $R_{b2}$ is preferably an alkyl group, aryl group, or heterocyclic group, more preferably an alkyl group or aryl group. A preferable range of the alkyl group is the same as that in the description of $R_{b1}$. The aryl group is preferably a phenyl group or naphthyl group, especially preferably a phenyl group. The aryl group may have a substituent. The group represented by $R_{b2}$ further having at least one or two —CON($R_{N2}$)OH group as its substituent is also a preferable example of the compound represented by the general formula ($B_2$).

In the general formula ($B_3$), $R_{b3}$ is preferably an alkyl group or an aryl group, and their preferable ranges are the same as those described with respect to $R_{b1}$ and $R_{b2}$. $R_{H3}$ is preferably a hydrogen atom, alkyl group, or hydroxy group, more preferably a hydrogen atom. The group represented by $R_{b3}$, further having at least one or two —N($R_{H3}$)CON($R_{N3}$)OH group as its substituent is also a preferable example of the compound represented by the general formula ($B_3$). Further, $R_{b3}$ and $R_{N3}$ may bind to each other to form a ring structure (preferably a 5- or 6-membered saturated heterocycle).

In the general formula ($B_4$), $R_{b4}$ is preferably an alkyl group, and its preferable range is the same as that described with respect to $R_{b1}$. The group represented by $R_{b4}$, further having at least one or two —OCON($R_{N4}$)OH group as its substituent is also a preferable example of the compound represented by the general formula ($B_4$).

In the general formula ($B_5$), $R_{b5}$ is preferably an alkyl group or aryl group, more preferably an aryl group, and their preferable ranges are the same as those described with respect to $R_{b1}$ and $R_{b2}$. Each of $R_{H5}$ and $R'_{H5}$ are preferably a hydrogen atom or alkyl group, more preferably a hydrogen atom.

In the general formula ($B_6$), $R_{b60}$ and $R_{b61}$ preferably bind to each other to form a ring structure. The ring structure formed by the above bonding is a 5- to 7-membered non-aromatic carbon ring or heterocycle, and may be a monocycle or condensed ring. Preferable specific examples of the ring structure are 2-cyclopentene-1-one ring, 2,5-dihydrofurane-2-one ring, 3-pyrroline-2-one ring, 4-pyrazoline-3-one ring, 2-cyclohexene-1-one ring, 5,6-dihydro-2H-pyran-2-one ring, 5,6-dihydro-2-pyridone ring, 1,2-dihydronaphthalene-2-one ring, coumarin ring (benzo-α-pyran-2-one ring), 2-quinolone ring, 1,4-dihydronaphthalene-1-one ring, chromone ring (benzo-γ-pyran-4-one ring), 4-quinolone ring, indene-1-one ring, 3-pyrroline-2,4-dione ring, uracil ring, thiouracil ring, and dithiouracil ring, more preferably, 2-cyclopentene-1-one ring, 2,5-dihydrofuran-2-one ring, 3-pyrroline-2-one ring, 4-pyrazoline-3-one ring, 1,2-dihydronaphthalene-2-one ring, coumarin ring (benzo-α-pyran-2-one ring), 2-quinolone ring, 1,4-dihydronaphthalene-1-one ring, chromone ring (benzo-γ-pyran-4-one ring), 4-quinolone ring, indene-1-one ring, and dithiouracil ring, and further preferably 2-cyclopentene-1-one ring, 2,5-dihydrofuran-2-one ring, 3-pyrroline-2-one ring, indene-1-one ring, and 4-pyrazoline-3-one ring.

When each of $X_6$ and $X'_6$ represents a cyclic amino group, the cyclic amino group is a non-aromatic nitrogen-containing heterocyclic group which binds to the carbon atom of the general formula ($B_6$) via its nitrogen atom, such as a pyrrolidino group, piperidino group, piperazino group, morpholino group, 1,4-thiazine-4-yl group, 2,3,5,6-tetrahydro-1,4-thiazine-4-yl group, or indolyl group.

Preferable examples of $X_6$ and $X'_6$ are a hydroxy group, mercapto group, amino group (including alkylamino group, arylamino group, and cyclic amino group), acylamino group, sulfonamido group, acyloxy group, or acylthio group, more preferably a hydroxy group, mercapto group, amino group, alkylamino group, cyclic amino group, sulfonamido group, acylamino group, and acyloxy group, and especially preferably a hydroxy group, amino group, alkylamino group, and cyclic amino group. Further, at least one of $X_6$ and $X'_6$ is preferably a hydroxy group.

$Y_6$ represents preferably an oxygen atom.

In the general formula ($B_7$), each of $R_{70}$ and $R_{b71}$ represents preferably a hydrogen atom, alkyl group or aryl group, more preferably an alkyl group. A preferable range of the alkyl group is the same as that described with respect to $R_{b1}$. $R_{b70}$ and $R_{b71}$ may bind to each other to form a ring structure (such as a pyrrolidine ring, piperidine ring, morpholino ring or thiomorpholino ring). Preferable examples of a substituent represented by $Y_7$ are an alkyl group (its preferable range is the same as that described with respect to $R_{b1}$), alkoxy group, acylamino group, sulfonamide group, ureido group, acyl group, alkoxycarbonyl group, carbamoyl group, sulfamoyl group, chlorine atom, sulfo group or a salt thereof, carboxy group or a salt thereof. $m_7$ represents preferably an integer of 0 to 2.

In the general formula ($B_8$), $m_8$ represents preferably an integer of 1 to 4, and plural $Y_8$'s may be the same or different. When m8 is 1, $Y_8$ is preferably an amino group (including alkylamino group, and arylamino group), sulfonamido group, or acylamino group. Also, when $m_8$ is 2 or more, at least one of plural $Y_8$'s is preferably an amino group (including alkylamino group, and arylamino group), sulfonamido group, or acylamino group, and each of the remaining $Y_8$'s is preferably a sulfonamido group, acylamino group, ureido group, alkyl group, alkylthio group, acyl group, alkoxycarbonyl group, carbamoyl group, sulfo group or a salt thereof, carboxy group or a salt thereof or chlorine atom. If a o'-(or p'-) hydroxyphenylmethyl group (which may further have a substituent) serving as a substituent represented by $Y_8$ is substituted at a ortho or para position of the hydroxy group in the general formula ($B_8$), the general formula $B_8$ represents a compound generally called bisphenols, which is also a preferable example of a compound represented by the general formula ($B_8$).

In the general formula ($B_9$), the positions of substitution of the two hydroxy groups may be ortho positions (catechols), meta positions (resorcinols) or para positions (hydroquinones). $m_9$ is preferably 1 to 2, and a plurality of $Y_9$'s may be the same or different. Preferable examples of the substituent represented by $Y_9$ are a chlorine atom, acylamino group, ureido group, sulfonamido group, alkyl group, alkylthio group, alkoxy group, acyl group, alkoxycarbonyl group, carbamoyl group, sulfo group or a salt thereof, carboxy group or a salt threreof, hydroxy group, alkylsulfonyl group, and arylsulfonyl group, etc. It is also a preferable example that two adjacent $Y_9$'s are bonded to each other to form a condensed benzene ring and consequently the general formula ($B_9$) represents 1,4-naphthohydroquinones. When the general formula ($B_9$) represents catechols, $Y_9$ especially preferably represents a sulfo group or a salt thereof, or hydroxy group.

In the general formula ($B_{10}$), when each of $R_{b100}$, $R_{b101}$ and $R_{b102}$ represents a substituent, preferable examples of the substituents are the same as the preferable examples of $Y_9$. Among them, an alkyl group (in particular, methyl) is especially preferable. Preferable examples of a ring structure formed by $Z_{10}$ are a chroman ring and 2,3-dihydrobenzofuran ring. The ring structure may have a substituent, and may form a spiro ring.

In the general formula ($B_{11}$), preferable examples of $R_{b110}$, $R_{b111}$, $R_{b112}$ and $R_{b113}$ are an alkyl group, aryl group, and heterocyclic group, and their preferable ranges are the same as those described with respect to $R_{b1}$ and $R_{b2}$. Among them, an alkyl group is especially preferable, and two alkyl groups among $R_{b110}$ to $R_{b113}$ may be bonded to each other to form a ring structure. The ring structure is a 5- or 6-membered non-aromatic heterocycle, such as a pyrrolidine ring, piperidine ring, morpholino ring, thiomorpholino ring, or hexahydropyridazine ring, etc.

In the general formula ($B_{12}$), $R_{b12}$ preferably represents an alkyl group, aryl group or heterocyclic group, and their preferable ranges are the same as those describeed with respect to $R_{b1}$and $R_{b2}$. $X_{12}$ preferably represents an alkyl group, aryl group (in particular, phenyl), heterocyclic group, alkoxy group, amino group (including alkylamino group, arylamino group, heterocyclic amino group and a cyclic amino group), or carbamoyl group, more preferably an alkyl group (especially preferably an alkyl group having 1 to 8 carbon atoms), aryl group (especially preferably phenyl), or amino group (including alkylamino group, arylamino group and cyclic amino group). Each of $R_{H12}$ and $R'_{H12}$ preferably represents a hydrogen atom or alkyl group, more preferably a hydrogen atom.

In the general formula ($B_{13}$), $R_{b13}$ preferably represents an alkyl group or aryl group, and their preferable ranges are the same as those described with respect to $R_{b1}$and $R_{b2}$. Each of $R_{b130}$, $R_{b131}$, $R_{b132}$ and $R_{b133}$ preferably represents a hydrogen atom, alkyl group (especially preferably having 1 to 8 carbon atoms), or aryl group (especially preferably phenyl). RH13 preferably represents a hydrogen atom or acyl group, more preferably a hydrogen atom.

The reducing compound according to the present invention may be that in which a ballast group or polymer chain, commonly used in an immobilized photographic additive such as a coupler, is incorporated. In particular, a reducing compound including a ballast group is a preferable example of the reducing compounds according to the present invention. The term "ballast group" indicates a group having, as its partial structure, a linear, branched, or cyclic alkyl group (or alkylene group) having 6 or more carbon atoms. The group may be substituted or unsubstituted. Further, the alkyl group (or alkylene group) can be bound, with a linking group, to any position of each reducing compound according to the present invention. The term "linking group" indicates a linking group formed by a single group such as an alkylene group, arylene group, heterocyclic group, single bond, —O—, —$NR_N$—, —S—, —C═O—, —$SO_2$—, —C═S—, —SO—, and —P═O—, or a multivalent linking group formed by a combination of the above groups. Herein, $R_N$ represents a hydrogen atom, alkyl group, aryl group, or a heterocyclic group. The linking group may have a further arbitral substituent.

More preferably, the ballast group has, as its partial structure, a linear or branched alkyl group (or alkylene group) having 8 to 24 carbon atoms.

Further, examples of the polymer are those described in JP-A-1-100530, the entire contents of which are incorporated herein by reference.

Each of the reducing compounds according to the present invention may have at least one group adsorptive to silver halide in any position in its molecule. The adsorptive group is the same as those in the description of the compounds of types 1 to 4 according to the present invention, and its preferable range is also the same.

An oxidation potential of each of the reducing compounds according to the present invention can be measured by using measuring methods described in "DENKIKAGAKU SOKUTEIHOU (Electrochemical Measuring method)" (pp. 150–208, GIHODO SHUPPAN Co. Ltd.) and "JIKKEN KAGAKU KOUZA (Experimental chemical Course)" the 4th Edition, edited and written by Chemical Society of Japan (Vol. 9, pages 282 to 344, published by Maruzen Co., Ltd.). For example, there is a method of rotary disc voltammetry. Specifically, a sample is dissolved in a solution of "methanol:Britton-Robinson buffer (pH 6.5)=10%:90% (volume %)", a nitrogen gas is passed therethrough for 10 minutes, and thereafter the oxidation potential can be measured at 25° C., 1000 rotation per minute, and a sweep speed of 20 mV/s, by using a rotary disc electrode (RDE) made of glassy carbon as a working electrode, a platinum wire as a counter electrode, and a saturated calomel electrode as a reference electrode. A half-wave potential (E½) can be determined based on the obtained voltammogram.

The oxidation potential of the reducing compounds according to the present invention preferably falls within, if measured by the above method, the range of about −0.3 V to 1.0 V, more preferably about −0.1 V to 0.8 V, especially preferably about 0 to 0.7 V. The reducing compounds of the present invention are preferably compounds selected from hydroxylamines, hydroxamic acids, hydroxyureas, hydroxyurethanes, hydroxysemicarbazides, phenols (including chroman-6-ols, hydroquinones, catechols, resorcinols, and bisphenols), Phenidons, reductons (including a reducton derivative), and hydrazides, further preferably compounds selected from hydroxylamines, hydroxamic acids, hydroxyureas, hydroxyurethanes, hydroxysemicarbazides, phenols, and reductons, more preferably compounds selected from hydroxylamines, hydroxamic acids, hydroxyureas, hydroxyurethanes, hydroxysemicarbazides and phenols, and especially preferably compounds selected from hydroxylamines, and hydroxamic acids. The following are examples of the reducing compounds according to the present invention, however, the present invention is not limited to them.

$B_1$-1

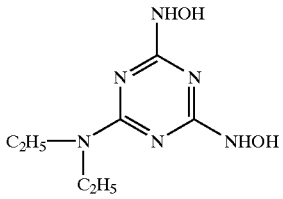

$B_1$-2

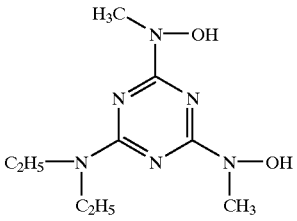

$B_1$-3

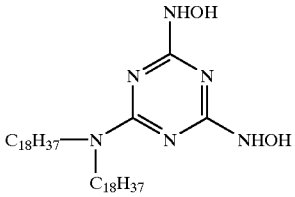

$B_1$-4

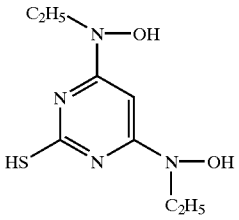

$B_1$-5

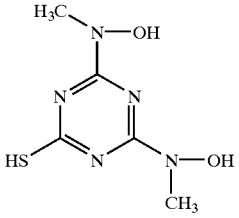

-continued $B_1$-6

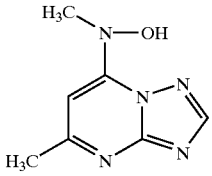

$B_1$-7

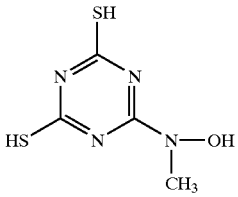

$B_1$-8

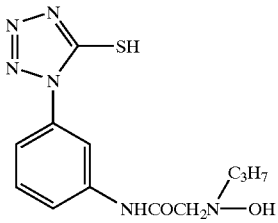

$B_1$-9

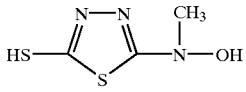

$B_1$-10

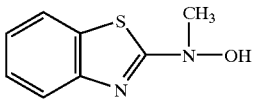

$B_1$-11

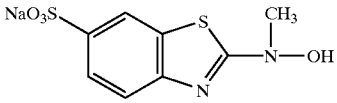

$B_1$-12

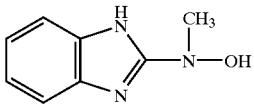

$B_1$-13

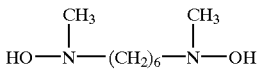

$B_1$-14

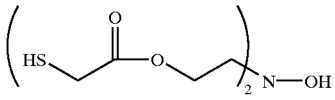

$B_1$-15

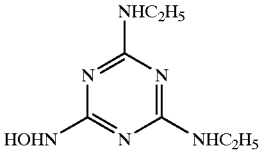

$B_1$-16

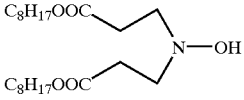

-continued
$B_1$-17
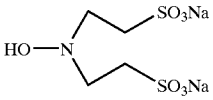
$B_1$-18
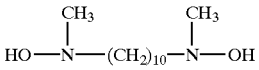
$B_2$-1
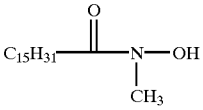
$B_2$-2
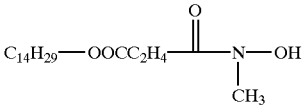
$B_2$-3
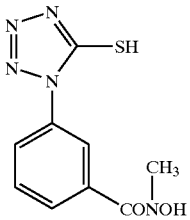
$B_2$-4
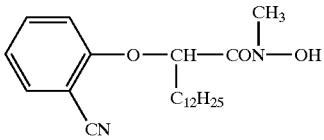
$B_2$-5
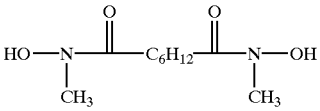
$B_2$-6
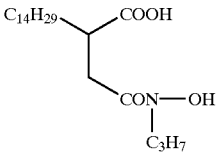
$B_2$-7
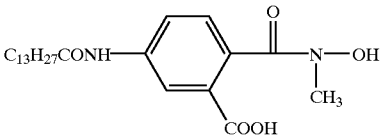
$B_2$-8
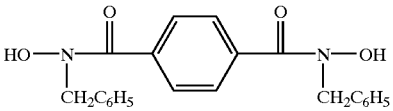
$B_2$-9
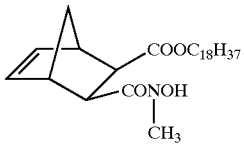
-continued
$B_2$-10
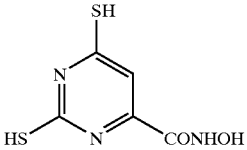
$B_2$-11
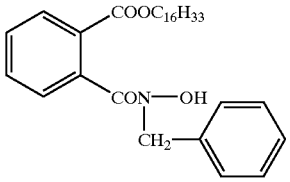
$B_2$-12
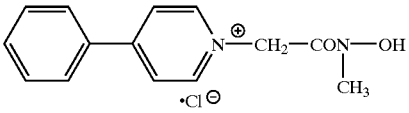
$B_2$-13
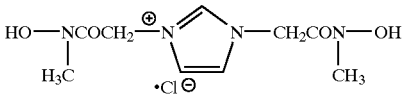
$B_3$-1
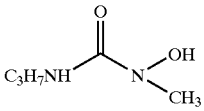
$B_3$-2
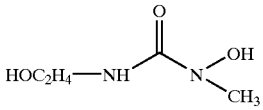
$B_3$-3
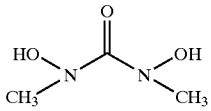
$B_3$-4
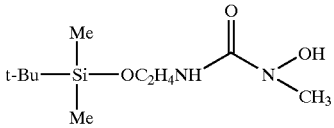
$B_3$-5
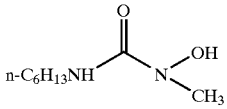
$B_3$-6
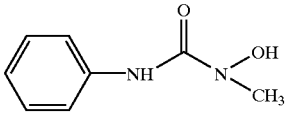
$B_3$-7
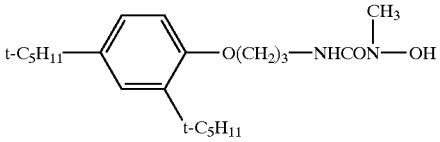
$B_3$-7
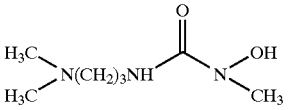

-continued
$B_3$-8
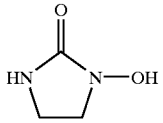
$B_3$-9
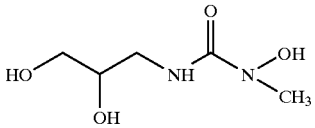
$B_3$-10
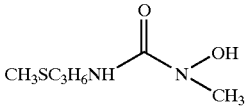
$B_3$-11
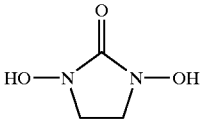
$B_3$-12
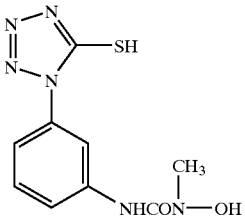
$B_3$-13
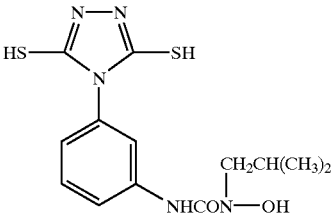
$B_3$-14
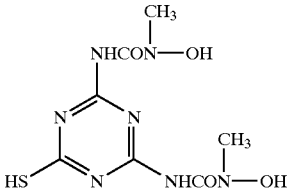
$B_3$-15
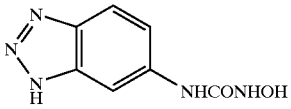
$B_3$-16
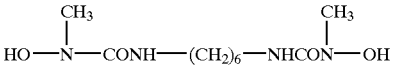
$B_3$-17
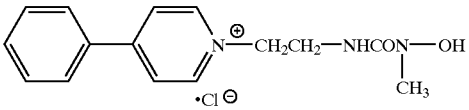
$B_3$-18
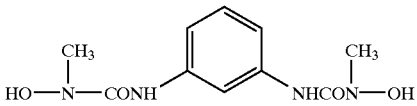
-continued
$B_4$-1
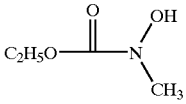
$B_4$-2
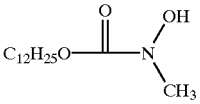
$B_4$-3
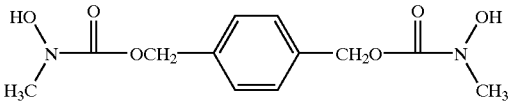
$B_4$-4
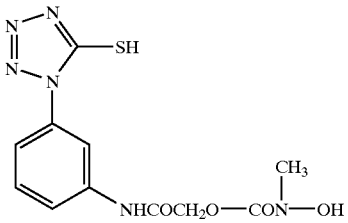
$B_7$-1
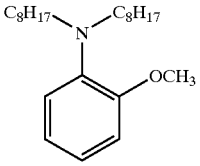
$B_7$-2
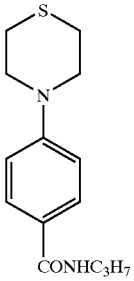
$B_{10}$-1
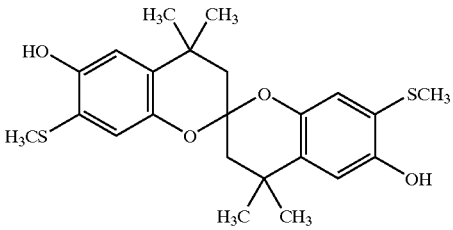
$B_{10}$-2
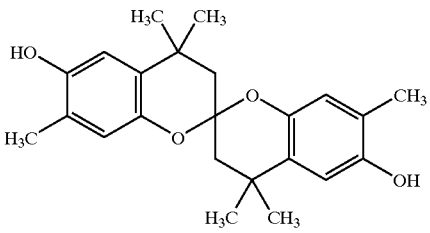

-continued
$B_{10}$-3
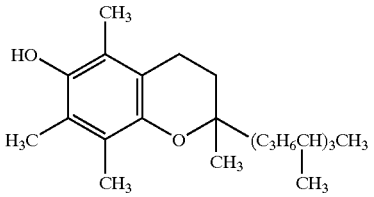
$B_{10}$-4
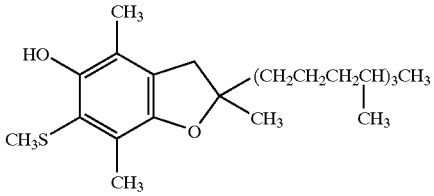
$B_5$-1
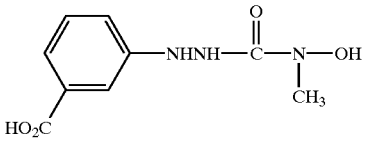
$B_5$-2
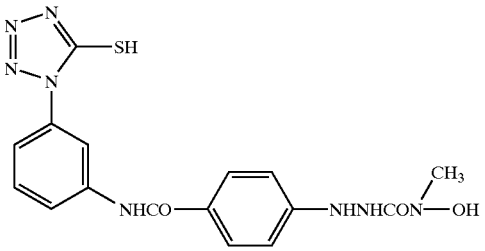
$B_5$-3
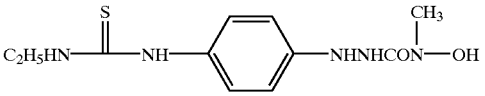
$B_5$-4
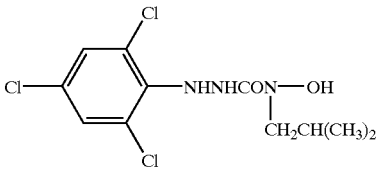
$B_5$-5
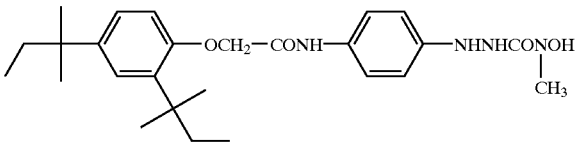
$B_5$-6
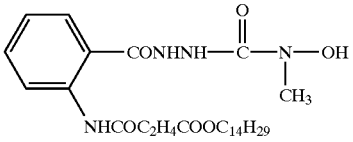
-continued
$B_{12}$-1
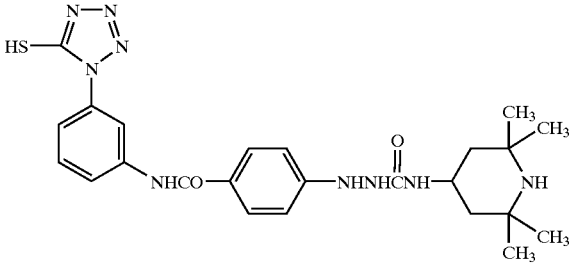
$B_{12}$-2
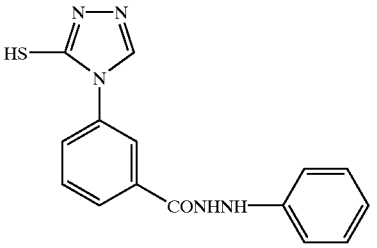
$B_{12}$-3
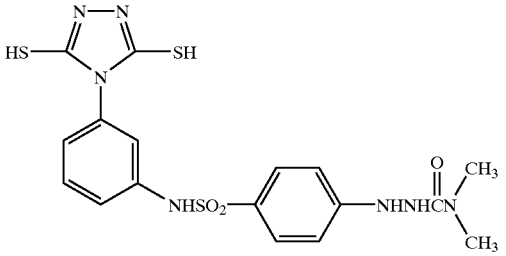
$B_{12}$-4
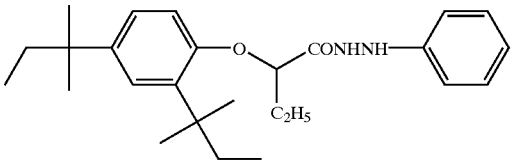
$B_6$-1
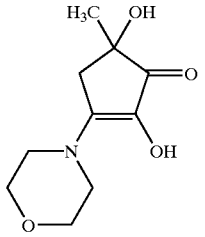
$B_6$-2
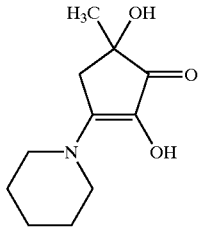

-continued
$B_6$-3
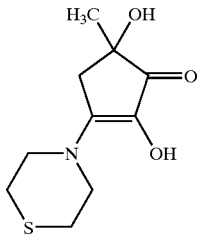
$B_6$-4
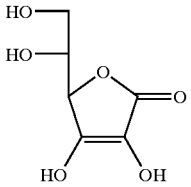
$B_6$-5
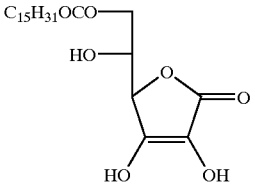
$B_6$-6
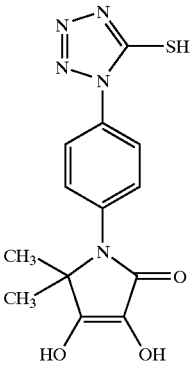
$B_6$-7
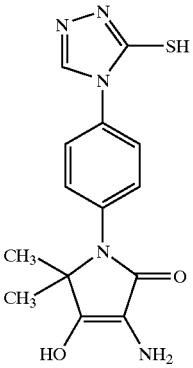
-continued
$B_6$-8
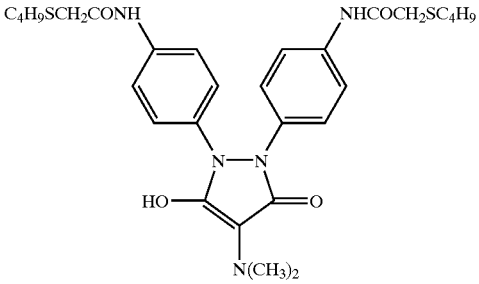
$B_6$-9
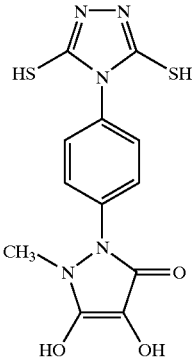
$B_6$-10
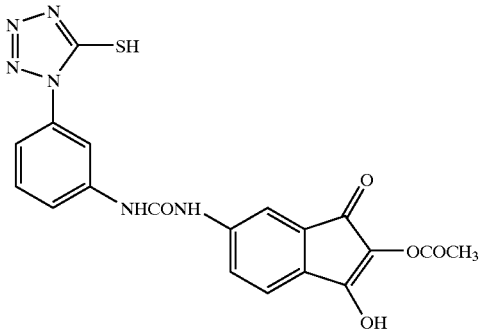
$B_6$-11
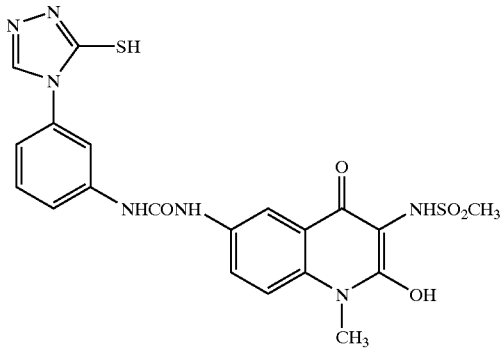
$B_8$-1
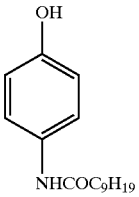

-continued
$B_8$-2
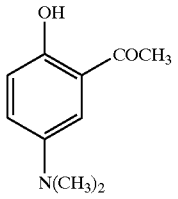
$B_8$-3
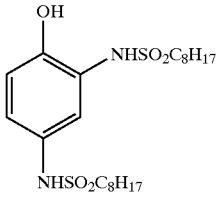
$B_8$-4
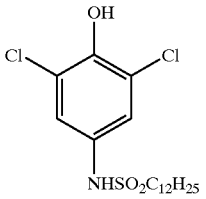
$B_8$-5
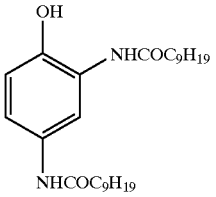
$B_8$-6
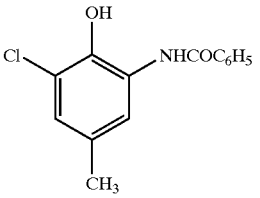
$B_8$-9
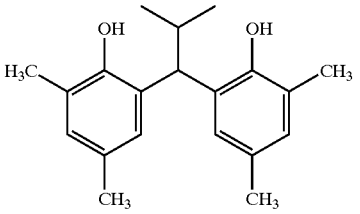
$B_8$-10
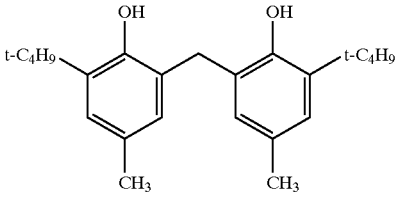
-continued
$B_8$-11
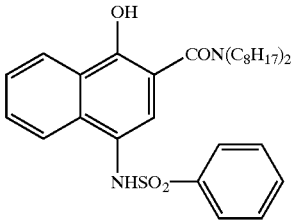
$B_8$-12
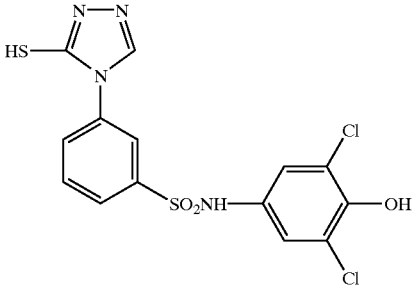
$B_9$-1
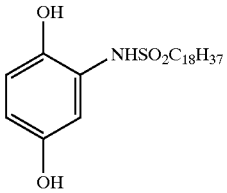
$B_9$-2
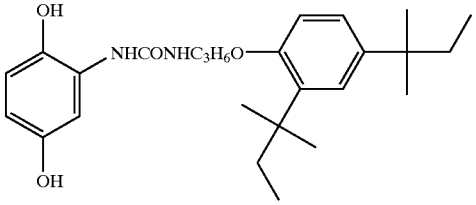
$B_9$-3
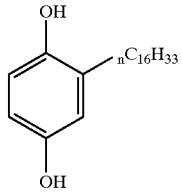
$B_9$-4
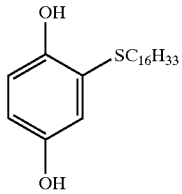
$B_9$-5
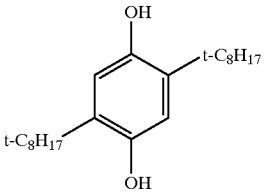

-continued
$B_9$-6
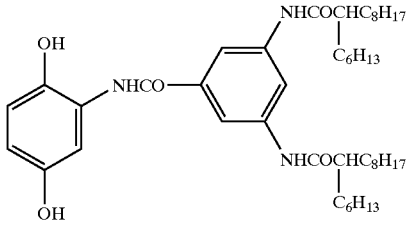
$B_9$-7
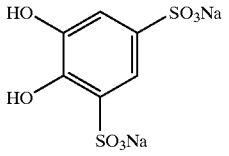
$B_9$-8
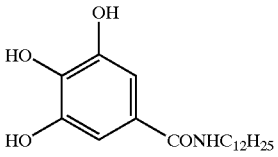
$B_9$-9
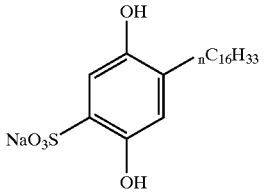
$B_9$-10
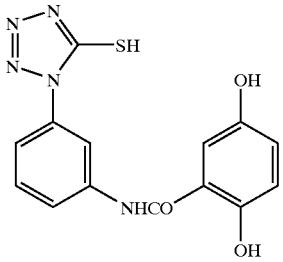
$B_9$-11
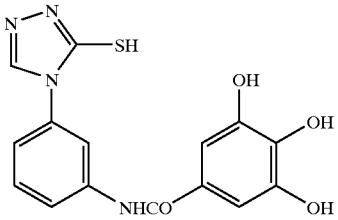
$B_9$-12
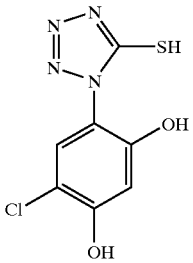
-continued
$B_9$-13
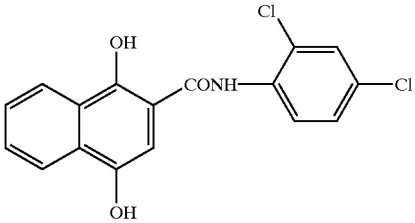
$B_9$-14
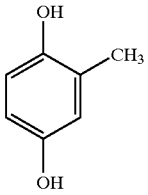
$B_{11}$-1
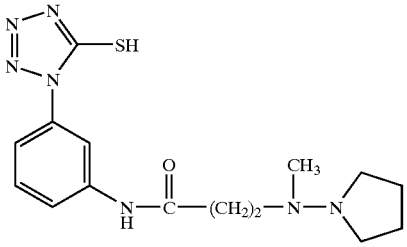
$B_{11}$-2
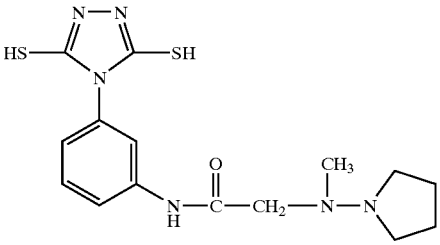
$B_{11}$-3
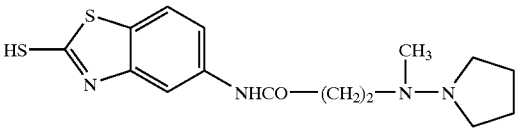
$B_{11}$-4
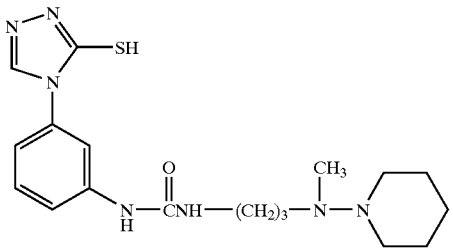
$B_{11}$-5
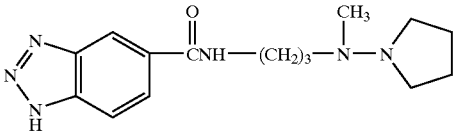

-continued
$B_{11}$-6
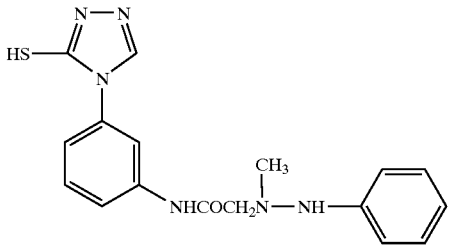
$B_{11}$-7
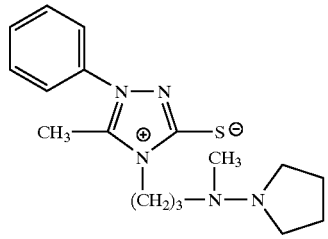
$B_{11}$-8
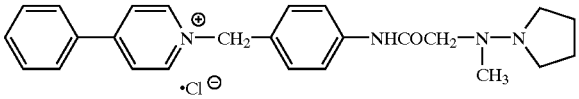
$B_{11}$-9
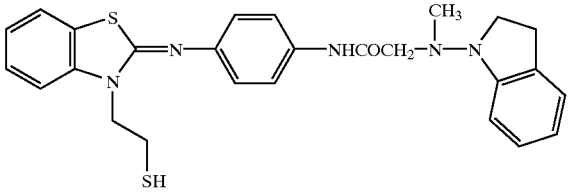
$B_{11}$-10
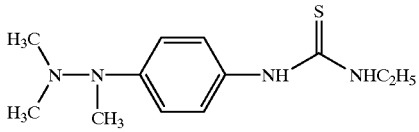
$B_{11}$-11
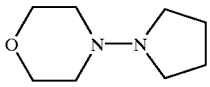
$B_{11}$-12
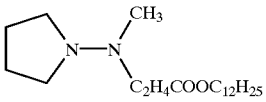
$B_{13}$-1
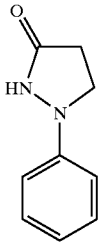
-continued
$B_{13}$-2
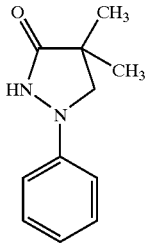
$B_{13}$-3
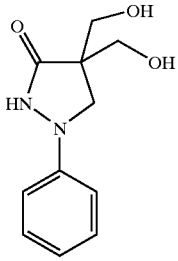
$B_{13}$-4
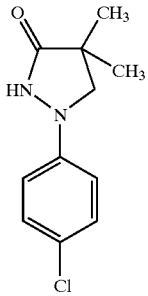
$B_{13}$-5
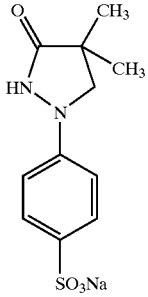
$B_{13}$-6
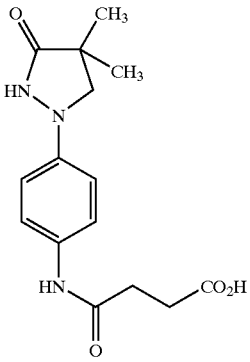

-continued $B_{13}$-7

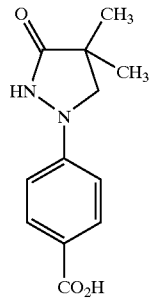

$B_{13}$-8

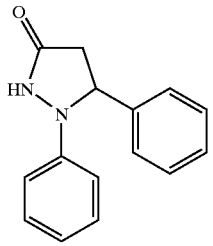

$B_{13}$-9

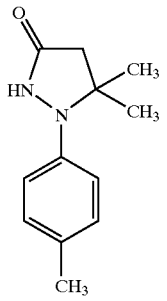

$B_{13}$-10

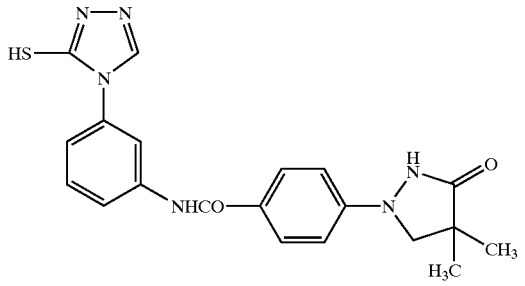

$B_{13}$-11

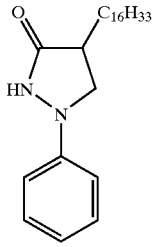

Most of the reducing compounds according to the present invention are publicly known in the field of photographs, and the following patent applications disclose examples thereof: JP-A-2001-42466 (compounds represented by general formulae (II)–(VI) and examples of the compounds); JP-A-8-114884; JP-A-8-314051; JP-A-8-333325; JP-A-9-133983; JP-A-11-282117; JP-A-10-246931; JP-A-10-90819; JP-A-9-54384; JP-A-10-171060; and JP-A-7-77783, entire contents of all of which are incorporated herein by reference. Further, the compounds disclosed in U.S. Pat. No. 6,054,260, the entire contents of which are incorporated herein by reference (especially the general formulae shown in columns 60–63 and examples of the compounds) can be mentioned as examples of the phenols.

In the present invention, although one compound selected from the reducing compounds according to the present invention may be used, it is also preferable to use two or more compounds selected from the reducing compounds. In this case, any two or more compounds can be selected from the reducing compounds according to the present invention. When the reducing compounds according to the present invention are classified into three classes: (1) a reducing compound having an adsorptive group; (2) a reducing compound having a ballast group; and (3) a reducing compound having none of the above groups (it is referred to as "diffusive reducing compounds" hereinafter in the present invention), it is also possible to use compounds of two or three classes among the three classes. This is also a preferable use of the reducing compounds according to the present invention. If two or more classes of compounds are to be used, they may be added to the same layer or different layers, and their adding methods may be different.

Among the reducing compounds according to the present invention, a compound of class (1) (having an adsorptive group) is preferably added to the same silver halide emulsion layer as the compounds of types 1 to 4 according to the invention were added to, more preferably the reducing compound is added at the time of preparation of the emulsion. If a reducing compound of class (1) is added when the emulsion is prepared, it can be added in any part of the preparing process, e.g., at formation step of silver halide grains, before initiation of desalting step, during desalting step, before initiation of chemical ripening, during chemical ripening, before preparation of a finished emulsion, and the like. Further, the reducing compound can be added plural times during the process. Further, although the reducing compound is preferably used for an emulsion layer, it may also be added, together with the emulsion layer, to a protective layer or an interlayer adjacent to the emulsion layer, and diffused into the emulsion layer at the time of coating.

Preferable addition amount of the reducing compound of class (1) greatly depends on the above addition methods and the kind of the compound to be added. Generally, preferable addition amount is $1\times10^{-8}$ to $5\times10^{-2}$ mol per mol of lightsensitive silver halide, more preferably $1\times10^{-7}$ to $1\times10^{-3}$ mol.

Among the reducing compounds of the present invention, compounds of class (3) (diffusive reducing compound) can be added to the same silver halide emulsion layer as the compounds of types 1 to 4 were added to, or another layer such as a non-lightsensitive layer. Although a reducing compound of class (3) is preferably used for an emulsion layer, it may also be added to a protective layer or an interlayer adjacent to the emulsion layer, together with the emulsion layer, and diffused at the time of coating. Although it can be added before, during, or after chemical ripening in the preparation of the emulsion, it is preferably added before or during coating of a coating solution.

A preferable addition amount of the reducing compound of class (3) greatly depends on the above addition methods and the kind of the compound to be added. Generally, the preferable addition amount is $5\times10^{-6}$ to $5\times10^{-2}$ mol per mol of lightsensitive silver halide, more preferably $1\times10^{-5}$ to $1\times10^{-2}$ mol.

Among the reducing compounds of the present invention, compounds of class (2) (having a ballast group) can be added to the same silver halide emulsion layer as the compounds of types 1 to 4 were added to, or another layer such as a non-lightsensitive layer. Although a reducing compound of class (2) is preferably used for an emulsion layer, it may also be added to a protective layer or an interlayer adjacent to the emulsion layer, and diffused at the time of coating. Although it can be added in the preparation of the emulsion, it is preferably added in the last step of the emulsion preparation by emulsification dispersion.

A preferable addition amount of the reducing compound of class (2) greatly depends on the above addition methods and the kind of the compound to be added. Generally, preferable addition amount is $5\times10^{-5}$ to $5\times10^{-1}$ mol per mol of lightsensitive silver halide, more preferably $1\times10^{-4}$ to $1\times10^{-1}$ mol.

The reducing compounds according to the present invention can be added by dissolving it in water or a water-soluble solvent, such as methanol or ethanol, or a mixed solvent thereof. When dissolving the compounds, the pH of such a solution may be properly adjusted by adding acid or base, and a surfactant may coexist with the compounds. Further, the compounds may be dissolved in a high-boiling organic solvent and added as an emulsified dispersion. Furthermore, the compounds may be added as a solid dispersion (fine crystalline dispersion) by a publicly-known method.

The silver halide grains of a photographic emulsion may have a crystal shape of cube, octahedron, tetradecahedron, rhombododecahedron, sphere, or plate. In addition, the silver halide grains may have a face of a high order ((hkl) face), or may be a mixture of grains having these crystal shapes. Preferably the silver halide grains are tabular grains, which will be detailed below.

The photosensitive material of the present invention preferably contains a lightsensitive silver halide emulsion containing tabular grains (silver halide grains each having two parallel main planes, hereinafter referred to as "tabular grains"). The silver halide grains will be described in detail below. The aspect ratio of each silver halide grain of the present invention is defined as a value obtained by dividing an equivalent circle diameter of the two facing parallel main planes (a diameter of a circle having the same projected area as that of the main plane) of each grain by a distance between the main planes (that is, the thickness of the grain).

In order to attain the advantages of the present invention, the average aspect ratio of the tabular grains is preferably 5 to 100, more preferably 8 to 80, especially preferably 10 to 50. Average aspect ratios less than 2 or those greater than 100 are undesirable because if the average aspect ratio is less than 2, the merit of the tabular grains cannot be fully used and because if the average aspect ratio exceeds 100, the pressure resistance deteriorates. Further, as for the emulsion used in the present invention, the ratio occupied by the tabular grains is preferably 60% or more, more preferably 80% or more, and particularly preferably 90% or more of the total projected area of the emulsion grains. The average grain thickness in the present invention is an arithmetical average of the thickness of all the tabular grains. The average grain thickness of the tabular grains of the present invention is preferably 0.01 to 0.3 $\mu$m, more preferably 0.01 to 0.12 $\mu$m, and particularly preferably 0.01 to 0.07 $\mu$m.

In the present invention, the diameter (equivalent circle diameter) of the tabular grains may be selected arbitrary, but is preferably 0.3 to 20 $\mu$m, and more preferably 0.5 to 10 $\mu$m. The grain diameter and the grain thickness can be obtained from an electron micrograph according to the method disclosed in U.S. Pat. No. 4,434,226. One example of an aspect ratio measurement method comprises taking a transmission electron micrograph by a replica method and obtaining the diameter of a circle whose area is the same as the projected area of each grain (the equivalent circle diameter) and the thickness of each grain. In this method, the thickness can be calculated from the length of a shadow of replica.

It is preferable that the tabular grains used in the present invention be monodisperse. The variation coefficient of the grain diameter distribution of all the silver halide grains is preferably 35% or less, more preferably 25% or less, and particularly preferably 20% or less. When exceeding 35%, it is not undesirable from the viewpoint of uniformity among grains. The variation coefficient of grain diameter distribution is a value obtained in such a manner that a distribution (standard deviation) of the equivalent sphere diameters of the silver halide grains is divided by the average equivalent sphere diameter and the resulting value is multiplied by 100.

There are known the tabular grains whose main planes are (100) planes and the tabular grains whose main planes are (111) planes, to both of which the technique of the present invention can be applied. The tabular grains of the former type made of silver bromide are disclosed in U.S. Pat. No. 4,063,951 and JP-A-5-281640, the entire contents of both of which are incorporated herein by reference, while the tabular grains of the former type made of silver chloride are disclosed in EP 534395 A1 and U.S. Pat. No. 5,264,337, the entire contents of both of which are incorporated herein by reference. The tabular grains of the latter type can have various shapes wherein at least one above mentioned twin plane is present, and those of silver chloride are described in U.S. Pat. Nos. 4,399,215, 4,983,508 and 5,183,732, and JP-A's-3-137632 and 3-116113, the entire contents of all of which are incorporated herein by reference.

As a method for forming the tabular grains, various methods can be used and, for example, the grain forming method disclosed in U.S. Pat. No. 5,494,789 can be used. In order to form tabular grains having a high aspect ratio, it is important to grow twin nuclei of small sizes. For this purpose, it is preferable to grow the nuclei at low temperature, high pBr and low pH, using a small amount of gelatin in a short time. As the kind of gelatin, gelatin with a low molecular weight, gelatin with a low methionine content, gelatin that has been phthalated, and the like are preferred. After the formation of the nuclei, physical ripening is carried out to grow only tabular grain nuclei (parallel, multiple-layered twin nuclei) by eliminating other nuclei, i.e., nuclei of normal crystal habit, single-layered twin nuclei and non-parallel, multiple-layered twin nuclei, thereby causing the parallel, multiple-layered twin nuclei to remain selectively. Then, a soluble silver salt and a soluble halogen salt are added to the obtained nuclei to promote grain growth, and an emulsion comprising tabular grains is prepared. It is also preferable to grow grains by supplying silver and halide through the addition of silver halide fine grains that have been prepared separately in advance or that are simultaneously prepared in another reaction vessel.

The tabular grains in the present invention may have dislocation lines. When tabular grains in the present invention have dislocation lines, the dislocation lines may be formed, for example, on the apex portion or fringe portion of grains or on the main plane of gains. As used herein, the fringe portion is the periphery of a tabular grain. More specifically, in the distribution of silver iodide from the edge to the center of a tabular grain, the fringe portion is a region outside a certain point at which the silver iodide content exceeds or becomes lower than the average silver iodide content of the whole grain for the first time when viewed from the edge.

When tabular grains have dislocation lines, the density of the dislocation lines is optional and any density may be selected, for example, 10 lines or more, 30 lines or more, 50 lines or more, per grain. Dislocation lines in tabular grains can be observed by, for example, a direct method using a transmission electron microscope at low temperature. The tabular grains used in the present invention may have dislocation lines inside the grains. The technique of introducing dislocations into silver halide grains under control is disclosed in JP-A-63-220238. In this reference, the tabular grains into which dislocation lines have been introduced attain more advantages, compared to those free from dislocation lines, including improvement in photographic characteristics such as speed and reciprocity law, improvement in storability, a rise in latent image stability and reduction in pressure mark.

As the silver halide grains used in the present invention, silver bromide, silver chlorobromide, silver iodobromide, silver iodochloride, silver chloride, silver chloroiodobromide and the like can be used. It is preferable to use silver bromide, silver iodobromide, and silver chloroiodobromide. It is also preferable, in respect of rapid processing property, to use silver chlorobromide, silver chloroiodide, silver chloroiodobromide, containing 50 mol % or more of silver chloride, or silver chloride, and having an aspect ratio of 2 or more. Although the upper limit of the silver chloride content is not specifically set, the silver chloride content is preferably 99.6% or less. When the silver halide grains have a phase containing iodide or chloride, the phase may be uniformly distributed within the grain or they may be localized. Other silver salts, such as silver rhodanide, silver sulfide, silver selenide, silver carbonate, silver phosphate and silver salts of organic acids, may be contained as separate grains or as part of the silver halide grains.

The preferable range of silver iodide content in the tabular grains of the present invention is preferably 0.1 to 20 mol %, more preferably 0.1 to 15 mol %, and particularly preferably 0.2 to 10 mol %. A silver iodide content less than 0.1 mol % is undesirable because it is difficult to obtain the advantages of enhancing dye adsorption and increasing the intrinsic sensitivity. A silver iodide content exceeding 20 mol % is also undesirable because the developing speed generally lowers. Although tabular grains containing 50 mol % or more of silver chloride and having an aspect ratio of 2 or more may contain silver iodide, its silver iodide content is preferably 6 mol % or less, more preferably 2 mol % or less.

The variation coefficient of distribution of silver iodide contents among grains of the tabular grains used in the present invention is preferably 30% or less, more preferably 25% or less, and particularly preferably 20% or less. If it exceeds 30%, it is not preferable from the viewpoint of uniformity among grains. The silver iodide content of individual tabular grain can be measured by analyzing the composition of the grain one by one with an X-ray microanalyzer. The coefficient of variation of distribution of silver iodide content used herein is a value obtained by dividing the standard deviation of the silver iodide content of individual grain by the average silver iodide content.

The tabular grains in the present invention may be epitaxial silver halide grains comprising host tabular grains having, on surfaces thereof, at least one kind of silver salt epitaxy. In the present invention, a silver salt epitaxy may be formed in selected portions in the surface of a host tabular grain, and alternatively, may be formed restrictedly in corners or edges of the host tabular grain. In the case of forming a silver salt epitaxy, it is preferable to form the silver salt epitaxy in selected sites in the surfaces of host tabular grains uniformly in individual grain and between the grains. As a concrete site-direct method of a silver salt epitaxy, there are known a method, which is disclosed in U.S. Pat. No. 4,435,501, of causing host grains to adsorb a spectral sensitizing dye (for example, a cyanine dye) or an aminoazaindene (for example, adenine) before the formation of the silver salt epitaxy, a method of causing host grains to contain silver iodide, and the like. These methods may be employed. Further, it is also possible to add iodide ions before the formation of the silver salt epitaxy, thereby precipitating them on host grains. These site-directing methods may be chosen case by case and may be employed in combination of them.

In the case of forming a silver salt epitaxy, the ratio of the area occupied by the silver salt epitaxy with respect to the surface area of the host tabular grain on which the silver salt epitaxy is formed is preferably 1 to 50%, more preferably 2 to 40%, and particularly preferably 3 to 30%. In the case of forming a silver salt epitaxy, the amount of silver in the silver salt epitaxy relative to the total amount of silver in the silver halide tabular grains is preferably 0.3 to 50 mol %, more preferably 0.3 to 25 mol %, and particularly preferably 0.5 to 15 mol %. The composition of the silver salt epitaxy can be selected according to circumstances, and the silver salt may be silver halide containing any one of chloride ion, bromide ion, and iodide ion.

In the photosensitive material of the present invention, two or more kinds of emulsions being different in at least one characteristic, such as grain size, grain size distribution, halogen composition, grain shape, and speed of the photosensitive silver halide emulsion, can be used as a mixture in the same layer.

The lightsensitive silver halide emulsion for use in the present invention may contain, for various purposes, a heavy metal such as iridium, rhodium, platinum, cadmium, zinc, thallium, lead, iron and osmium. These compounds may be used individually or in combination of two or more thereof. The addition amount varies depending on the purpose of use, however, it is generally on the order of from $10^{-9}$ to $10^{-3}$ mol per mol of silver halide. The heavy metal may be incorporated uniformly into the grain or may be localized in the inside or on the surface of the grain, or in silver salt epitaxially grown on the surface of the grain. Specifically, emulsions described in JP-A's-2-236542, 1-116637 and the like are preferably used. At the stage of forming grains of the lightsensitive silver halide emulsion of the present invention, a rhodanate, an ammonia, a tetra-substituted thiourea compound, an organic thioether derivative described in Jpn. Pat Appln. KOKOKU Publication No. (hereinafter referred to as JP-B-) 47-11386, a sulfur-containing compound described in JP-A-53-144319 and the like may be used as a silver halide solvent.

With respect to other conditions, description in P. Glafkides, Chimie et Phisigue Photographique, Paul Montel (1967), G. F. Duffin, Photographic Emulsion Chemistry, The Focal Press (1966), and V. L. Zelikman et al, Making and Coating Photographic Emulsion, The Focal Press (1964) may be referred to. More specifically, any of an acid process, a neutral process and an ammonia process may be used, and as a method of reacting a soluble silver salt with a soluble halogen salt, any of a single jet method, a double jet method and a combination thereof may be used. In order to obtain a monodisperse emulsion, a double jet method is preferably used.

The lightsensitive silver halide emulsion is usually a silver halide emulsion subjected to chemical sensitization (other than chemical sensitizations caused by the compounds of types 1 to 4 according to the present invention). In the chemical sensitization of the lightsensitive silver halide emulsion for use in the present invention, chalcogen sensitization such as sulfur sensitization, selenium sensitization and tellurium sensitization, noble metal sensitization using gold, platinum, palladium or the like, and reduction sensitization, which are all known to the emulsion for normal type photosensitive materials, may be used individually or in combination (see, JP-A-3-110555). The chemical sensitization may also be performed in the presence of a nitrogen-containing heterocyclic compound (see, JP-A-62-253159). Further, an antifoggant that will be described later may be added after completion of the chemical sensitization. Specifically, the methods described in JP-A's-5-45833 and 62-40446 may be used.

At the time of chemical sensitization, the pH is preferably from 5.3 to 10.5, more preferably from 5.5 to 8.5, and the pAg is preferably from 6.0 to 10.5, more preferably from 6.8 to 9.0.

The lightsensitive silver halide emulsion for use in the present invention may be spectrally sensitized with a methine dye or the like so that the lightsensitive silver halide emulsion can have color sensitivity such as green sensitivity and red sensitivity. Further, spectral sensitization in the blue region may be applied to the blue-sensitive emulsion, if desired. Examples of the dye used include a cyanine dye, a merocyanine dye, a complex cyanine dye, a complex merocyanine dye, a holopolar cyanine dye, a hemicyanine dye, a styryl dye and a hemioxonol dye.

These sensitizing dyes may be used individually or in combination and the combination of sensitizing dyes is often used for the purpose of supersensitization or for controlling the wavelength of spectral sensitization.

In combination with a sensitizing dye, a dye which itself has no spectral sensitization effect or a compound which absorbs substantially no visible light, but which exhibits supersensitization, may be contained in the emulsion. With respect to the timing when the spectral sensitizing dye is added to the emulsion, it may be added before, during or after chemical ripening or may be added before or after nucleation of silver halide grains according to U.S. Pat. Nos. 4,183,756 and 4,225,666. The sensitizing dye or the supersensitizing dye may be added as a solution in an organic solvent such as methanol, a dispersion, for example, in gelatin, or a solution in a surface active agent. The addition amount is generally in the order of from $10^{-8}$ to $10^{-2}$ mol per mol of silver halide.

Further, the present invention is preferably used together with a technique of increasing light absorptivity by a spectrum sensitizing dye. For example, there is a method, by utilizing an intermolecular force, of causing more sensitizing dyes to adsorb to silver halide grain surfaces in comparison with those in a single-layer saturated absorption (that is, one-layer adsorption), or a method of adsorbing, to silver halide grains, a coupling dye having two or more chromophores which are not separately conjugated but coupled by a covalent bond. Among them, the present invention is preferably used together with the techniques disclosed in the following patent documents: JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173, and 2001-356442, and E.P. Nos. 985965A, 985964A, 985966A, 985967A, 1085372A, 1085373A, 1172688A, 1199595A, and 887700A1, the entire contents of which are incorporated herein by reference. In particular, the present invention is preferably used together with the following patent documents: JP-A's-10-239789, 2001-75222, and 10-171058.

Photographic additives usable in the present invention are also described in RD's, the entire contents of which are incorporated herein by reference, and the relevant portions are summarized in the following table.

| Types of Additives | RD17643 (Dec. 1978) | RD18716 (Nov. 1979) | RD307105 (Nov.1989) |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23–24 | page 648, right column to page 649, right column | pages 866–868 |
| 4. Brighteners | page 24 | page 647, right column | page 868 |
| 5. Light absorbents, filter dyes, ultraviolet absorbents | pages 25–26 | page 649, right column to page 650, left column | page 873 |
| 6. Binders | page 26 | page 651, left column | pages 873–874 |
| 7. Plasticizers, lubricants | page 27 | page 650, right column | page 876 |
| 8. Coating aids, surfactants | pages 26–27 | page 650, right column | pages 875–876 |
| 9. Antistatic agents | page 27 | page 650, right column | pages 876–877 |
| 10. Matting agents | | | pages 878–879 |

The present invention can also be applied to a heat development photosensitive material. In such a case, as an oxidizer, an organic metal salt is preferably used together with a lightsensitive silver halide emulsion. Among such organic metal salts, an organic silver salt is especially preferably used. An organic silver salt which can be used in the present invention is a silver salt which is relatively stable against light but forms a silver image when heated to 80° C. or more under the presence of an exposed photocatalyst (a latent image of lightsensitive silver halide or the like) and a reducing agent. The organic silver salt may be an any organic substance including a source which can reduce a silver ion, and is preferably a silver salt of an organic acid, especially preferably a silver salt of a long-chain fatty carboxylic acid (having 10 to 30 carbon atoms, preferably 15 to 28 carbon atoms). It is also preferably a complex of an organic or inorganic silver salt having a ligand having a complex stability constant of 4.0 to 10.0. Such silver-supplying substances can preferably constitute about 5 to 30 w % of an image forming layer. As the organic silver salt, a silver salt of a compound containing a mercapto group or a thione group, or a derivative thereof, can be used. Further, a compound containing an imino group can also be used, and various silver acetylide compounds can be used. Two or more kinds of organic silver salts may be used together.

The above organic silver salt may be added to any layer. The above organic silver salt may be added to one layer or may be added to plural layers. It is also preferable to add the organic silver salt to a hydrophilic colloidal layer which is provided on the side of a support having silver halide emulsion layers, such as a protective layer, interlayer or a so-called subbing layer that is provided between a support and an emulsion layer, and in which no lightsensitive silver halide emulsion is contained, in view of improvement in storability. The above organic silver salt can be used in an amount of 0.01 to 10 mol, preferably 0.05 to 1 mol, per mol of lightsensitive silver halide. It is appropriate for the total coating amount of lightsensitive silver halide and organic silver salt to be in the range of 0.02 to 20 g/m$^2$, preferably 0.1 to 12 g/m$^2$, in terms of silver.

The silver halide emulsion and/or organic silver salt used in the present invention can be protected against additional fogging and can be stabilized so as to be free from sensitivity change during storage by the use of an antifoggant, a stabilizer and a stabilizer precursor. As a suitable antifoggant, stabilizer and stabilizer precursor which can be used individually or in combination, there can be mentioned thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechols described in U.S. Pat. No. 3,235,652; oximes, nitrons and nitroindazoles described in GB No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogenated organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

Antifoggants preferably used for the heat development photosensitive material are organic halides, e.g. compounds disclosed in JP-A's-50-119624, 50-120328, 51-121332, 54-58022, 56-70543, 56-99335, 59-90842, 61-129642, 62-129845, 6-208191, 7-5621, 7-2781, and 25 8-15809, and U.S. Pat. Nos. 5,340,712, 5,369,000, and 5,464,737. Further, it may contain a benzoic acid for the purpose of increasing speed and preventing fog. Examples of a preferable structure of the antifoggant are compounds described in U.S. Pat. Nos. 4,784,939 and 4,152,160.

The photosensitive material of the present invention can be loaded with a mercapto compound, a disulfide compound and a thione compound in order to control development through development inhibition or acceleration, to enhance spectral sensitization efficiency and to prolong storage life before and after development. When a mercapto compound is used in the present invention, although the structure thereof is not limited, compounds of the formula Ar—SM or Ar—S—S—Ar can preferably be employed. In the formula, M represents a hydrogen atom or an alkali metal atom. Ar represents an aromatic ring group or condensed aromatic ring group containing at least one nitrogen, sulfur, oxygen, selenium or tellurium atom. The addition amount of these mercapto compounds is preferably in the range of 0.001 to 1.0 mol, more preferably 0.01 to 0.3 mol, per mol of lightsensitive silver halide.

In the photosensitive material of the present invention, a silver halide solvent can be used. Preferable examples of the silver halide solvent are a thiosulfate, sulfite, thiocyanate, thioether compound described in JP-B-47-11386, the compound having a 5- or 6-membered imido group, such as uracil and hydantoin, described in JP-A-8-179458, the compound having a double bond of carbon-sulfur described in JP-A-53-144319, and the methoionthiolate compound, such as trimethyltriazoliumthiolate, described in Analytica Chimica Acta, Vol.248, pp. 604–614 (1991). Further, the compound described in JP-A-8-69097, which can fix and stabilize silver halide, can also be used as a silver halide solvent. The amount of the silver halide solvent contained in the photosensitive material is 0.01 to 100 mmol/m$^2$, preferably 0.1 to 50 mmol/m$^2$, more preferably 10 to 50 mmol/m$^2$. The silver halide solvent of a single kind may be used, or plural kinds of silver halide solvents are preferably used together.

A hydrophilic binder is preferably used as a binder of constituent layers in the photosensitive material of the present invention. Examples of such a binder are those described in the above RD's and JP-A-64-13546, pages 71 to 75. Specifically, transparent or semitransparent hydrophilic binders are preferable. Examples thereof are natural compounds, such as protein including gelatin and gelatin derivative or polysaccaride including cellulose derivative, starch, gum arabic, dextran and pulluran, and synthetic high polymer compounds, such as polyvinyl alcohol, denatured polyvinyl alcohol (i.e. terminal alkyl denatured povals MP103 and MP203 manufactured by Kuraray Co., Ltd.), polyvinyl pyrrolidone, and acrylamide polymer, etc. Further, there can be used are high water absorbent polymers described in U.S. Pat. No. 4,960,681 and JP-A-62-245260, that is, a hono polymer of vinyl monomer having —COOM or —$SO_3$M (M represents a hydrogen atom or alkaline metal), or copolymer of the vinyl monomers or copolymer of the vinyl monomer with another vinyl monomer (i.e. sodium methacrylate, ammonium methacrylate, and Sumica Gel L-5H manufactured by Sumitomo Chemical Co., Ltd.). Two or more kinds of the binders may be used in combination. In particular, a combination of gelatin and the above binder is preferable. Further, the gelatin is selected from limed gelatin, acid-treated gelatin, and decalcified gelatin with a reduced content of calcium and the like, according to purposes, and the gelatins are preferably used in combination.

A polymer latex is preferably used as the binder in the present invention. The polymer latex is a material in which a hydrophobic polymer being insoluble in water is dispersed as fine particles in a water-soluble dispersion medium. The state of dispersion thereof may be any of those where the polymer is emulsified in the dispersion medium, the polymer has undergone emulsion polymerization, the polymer has undergone micelle dispersion, and each polymer molecule has a partially hydrophilic structure and the molecular chain itself has been dispersed as a molecular state. The average grain size of dispersed grains is preferably about 1 to 50000 nm, more preferably about 5 to 1000 nm. Examples of kinds of polymers used for the polymer latex are an acryl resin, vinyl acetate resin, polyester resin, polyurethane resin, rubber resin, vinyl chloride resin, vinylidene chloride resin, and polyolefin resin, etc. The molecular weight of the polymer is 5,000 to 1,000,000 in terms of number average molecular weight, Mn, preferably 10,000 to 500,000.

The photosensitive material of the present invention preferably contains a dye-forming coupler. Examples of couplers preferably used are compounds generically named as active methylene, 5-pyrazolone, pyrazoloazole, phenol, naphthol, and pyrrolotriazole. The compounds cited in RD No. 38957 (September 1996), pages 616–624, the entire contents of which are incorporated herein by reference, can be preferably used as the couplers. The couplers can be divided into two equivalent couplers and four equivalent couplers, and either type can be used. In addition to the compounds described in RD No. 38957, the following couplers can be preferably used.

As active methylene couplers, there can be employed couplers represented by the formulae (I) and (II) of EP No. 502,424A; couplers represented by the formulae (1) and (2) of EP No. 513,496A; couplers represented by the formula (I) of claim 1 of EP No. 568,037A; couplers represented by the general formula (I) of column 1, lines 45–55, of U.S. Pat. No. 5,066,576; couplers represented by the general formula (I) of paragraph 0008 of JP-A-4-274425; couplers recited in claim 1 of page 40 of EP No. 498,381A1; couplers represented by the formula (Y) of page 4 of EP No. 447,969A1; and couplers represented by the formulae (II) to (IV) of column 7, lines 36–58, of U.S. Pat. No. 4,476,219.

As 5-pyrazolone magenta couplers, there can preferably be employed compounds described in JP-A's 57-35858 and 51-20826. As pyrazoloazole couplers, there can preferably be employed imidazo[1,2-b] pyrazoles described in U.S. Pat. No. 4,500,630; pyrazolo[1,5-b][1,2,4]triazoles described in U.S. Pat. No. 4,540,654; and pyrazolo[5,1-c][1,2,4]triazoles described in U.S. Pat. No. 3,725,067. Of these, pyrazolo[1,5-b][1,2,4]triazoles are most preferred from the viewpoint of light fastness. Also, there can preferably be employed pyrazoloazole couplers comprising a pyrazolotriazole group having a branched alkyl group directly bonded to 2-, 3- or 6-position thereof as described in JP-A-61-65245; pyrazoloazole couplers having a sulfonamido group in molecules thereof as described in JP-A-61-65245; pyrazoloazole couplers having an alkoxyphenylsulfonamido balast group as described in JP-A-61-147254; pyrazolotriazole couplers having an alkoxy or aryloxy group at 6-position thereof as described in JP-A's 62-209457 and 63-307453; and pyrazolotriazole couplers having a carbonamido group in molecules thereof as described in JP-A-2-201443.

As preferred examples of phenol couplers, there can be mentioned, for example, 2-alkylamino-5-alkylphenol couplers described in U.S. Pat. Nos. 2,369,929, 2,801,171, 2,772,162, 2,895,826 and 3,772,002; 2,5-diacylaminophenol couplers described in U.S. Pat. Nos. 2,772,162, 3,758,308, 4,126,396, 4,334,011 and 4,327,173, DE No. 3,329,729 and JP-A-59-166956; and 2-phenylureido-5-acylaminophenol couplers described in U.S. Pat. Nos. 3,446,622, 4,333,999, 4,451,559 and 4,427,767. As preferred examples of naphthol couplers, there can be mentioned, for example, 2-carbamoyl-1-naphthol couplers described in U.S. Pat. Nos. 2,474,293, 4,052,212, 4,146,396, 4,228,233 and 4,296,200; and 2-carbamoyl-5-amido-1-naphthol couplers described in U.S. Pat. No. 4,690,889.

As preferred examples of pyrrolotriazole couplers, there can be mentioned those described in EP Nos. 488,248A1, 491,197A1 and 545,300. Moreover, use can be made of couplers with the condensed ring phenol, imidazole, pyrrole, 3-hydroxypyridine, active methine, 5,5-condensed heterocycle and 5,6-condensed heterocycle structures. As condensed ring phenol couplers, there can be employed those described in, for example, U.S. Pat. Nos. 4,327,173, 4,564,586 and 4,904,575.

As imidazole couplers, there can be employed those described in, for example, U.S. Pat. Nos. 4,818,672 and 5,051,347. As pyrrole couplers, there can be employed those described in, for example, JP-A's 4-188137 and 4-190347. As 3-hydroxypyridine couplers, there can be employed those described in, for example, JP-A-1-315736. As active methine couplers, there can be employed those described in, for example, U.S. Pat. Nos. 5,104,783 and 5,162,196.

As 5,5-condensed heterocycle couplers, there can be employed, for example, pyrrolopyrazole couplers described in U.S. Pat. No. 5,164,289 and pyrroloimidazole couplers described in JP-A-4-174429. As 5,6-condensed heterocycle couplers, there can be employed, for example, pyrazolopyrimidine couplers described in U.S. Pat. No. 4,950,585, pyrrolotriazine couplers described in JP-A-4-204730 and couplers described in EP No. 556,700.

In the present invention, besides the above couplers, use can also be made of couplers described in, for example, DE's 3,819,051A and 3,823,049, U.S. Pat. Nos. 4,840,883, 5,024,930, 5,051,347 and 4,481,268, EP's 304,856A2, 329,036, 354,549A2, 374,781A2, 379,110A2 and 386,930A1, JP-A's 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731 and 4-204732. These couplers are used in an amount of 0.05 to 10 mmol/$m^2$, preferably 0.1 to 5 mmol/$m^2$, for each color.

Furthermore, the following functional couplers may be contained. As couplers for forming a colored dye with appropriate diffusibility, there can preferably be employed those described in U.S. Pat. No. 4,366,237, GB 2,125,570, EP 96,873B and DE 3,234,533. As couplers for correcting any unneeded absorption of a colored dye, there can be mentioned yellow colored cyan couplers of formulae (CI), (CII), (CIII) and (CIV) described in EP 456,257A1 (especially YC-86 on page 84); yellow colored magenta couplers ExM-7 (page 202), EX-1 (page 249) and EX-7 (page 251) described in the same EP; magenta colored cyan couplers CC-9 (column 8), CC-13 (column 10) described in U.S. Pat. No. 4,833,069; colorless masking couplers represented by the formula (2) described in column 8 of U.S. Pat. No. 4,837,136 and represented by the formula (A) of claim 1 of WO 92/11575 (especially, compound examples of pages 36 to 45).

As compounds (including couplers) capable of reacting with a developing agent in an oxidized form to thereby release photographically useful compound residues, there can be mentioned the following:

Development inhibitor-releasing compounds: compounds represented by the formulae (I)–(IV) of page 11 of EP 378,236A1 (especially T-101 (page 30), T-104 (page 31), T-113 (page 36), T-131 (page 45), T-144 (page 51) and T-158 (page 58)), compounds represented by the formula (I) of page 7 of EP 436,938A2 (especially D-49 (page 51)), compounds represented by the formula (1) of EP 568,037A (especially (23) (page 11)), and compounds represented by the formulae (I), (II) and (III) of pages 5–6 of EP 440,195A2 (especially I-(1) on page 29);

Bleaching accelerator-releasing compounds: compounds represented by the formulae (I) and (I') of page 5 of EP 310,125A2 (especially (60) and (61) on page 61), and compounds represented by the formula (I) of claim 1 of JP-A-6-59411 (especially (7) on page 7);

Ligand-releasing compounds: compounds represented by LIG-X described in claim 1 of U.S. Pat. No. 4,555,478 (especially compounds described in lines 21–41 of column 12);

Leuco dye-releasing compounds: compounds 1–6 of columns 3–8 of U.S. Pat. No. 4,749,641;

Fluorescent dye-releasing compounds: compounds represented by COUP-DYE of claim 1 of U.S. Pat. No. 4,774,181 (especially compounds 1–11 in columns 7–10);

Development accelerator or fogging agent-releasing compounds: compounds represented by the formulae (1), (2) and (3) of column 3 of U.S. Pat. No. 4,656,123 (especially (I-22) of column 25) and ExZK-2 of page 75, lines 36–38, of EP 450,637A2; and Compounds which release a group becoming a dye only after splitting off: compounds represented by the formula (I) of claim 1 of U.S. Pat. No. 4,857,447 (especially Y-1 to Y-19 of columns 25–36).

Preferable additives other than the couplers are as follows:

Dispersion mediums for oil-soluble organic compounds: P-3, 5, 16, 19, 25, 30, 42, 49, 54, 55, 66, 81, 85, 86 and 93 (pages 140–144) of JP-A-62-215272;

Latexes for impregnation of oil-soluble organic compounds: latexes described in U.S. Pat. No. 4,199,363; Scavengers for oxidized developing agent: compounds of the formula (I) of column 2, lines 54–62, of U.S. Pat. No. 4,978,606 (especially, I-(1), -(2), -(6) and -(12) (columns 4–5)), and formula of column 2, lines 5–10, of U.S. Pat. No. 4,923,787 (especially, compound 1 (column 3));

Anti-stain agents: formulae (I) to (III) of page 4, lines 30–33, of EP 298321A, especially I-47 and -72 and III-1 and -27 (pages 24–48);

Discoloration preventives: A-6, -7, -20, -21, -23, -24, -25, -26, -30, -37, -40, -42, -48, -63, -90, -92, -94 and -164 (pages 69–118) of EP 298321A, II-1 to III-23 of columns 25–38 of U.S. Pat. No. 5,122,444, especially III-10, I-1 to III-4 of pages 8–12 of EP 471347A, especially II-2, and A-1 to -48 of columns 32–40 of U.S. Pat. No. 5,139,931, especially A-39 and -42;

Materials for reducing the use amount of color enhancer and color mixing inhibitor: I-1 to II-15 of pages 5 to 24 of EP No. 411324A, especially I-46;

Formalin scavengers: SCV-1 to -28 of pages 24 to 29 of EP 477932A, especially SCV-8;

Film hardeners: H-1, -4, -6, -8 and -14 of page 17 of JP-A-1-214845, compounds (H-1 to -54) of formulae (VII) to (XII) of columns 13–23 of U.S. Pat. No. 4,618,573, compounds (H-1 to -76) of the formula (6) of page 8, right lower column, of JP-A-2-214852, especially H-14, and compounds of claim 1 of U.S. Pat. No. 3,325,287;

Development inhibitor precursors: P-24, -37 and -39 (pages 6–7) of JP-A-62-168139, and compounds of claim 1 of U.S. Pat. No. 5,019,492, especially 28 and 29 of column 7;

Antiseptics and mildewproofing agents: I-1 to III-43 of columns 3–15 of U.S. Pat. No. 4,923,790, especially II-1, -9, -10 and -18 and III-25;

Stabilizers and antifoggants: I-1 to (14) of columns 6 to 16 of U.S. Pat. No. 4,923,793, especially I-1, 60, (2) and (13), and compounds 1-65 of columns 25 to 32 of U.S. Pat. No. 4,952,483, especially 36;

Chemical sensitizers: triphenylphosphine selenides, and compound 50 of JP-A-5-40324;

Dyes: a-1 to b-20, especially a-1, -12, -18, -27, -35, -36 and b-5, of pages 15–18, and V-1 to -23, especially V-1, of pages 27 to 29 of JP-A-3-156450, F-I-1 to F-II-43, especially F-I-11 and F-II-8, of pages 33–55 of EP No. 445627A, III-1 to -36, especially III-1 and -3, of pages 17–28 of EP 457153A, microcrystalline dispersions of dye-1 to 124 of pages 8–26 of WO 88/04794, compounds 1–22, especially compound 1, of pages 6 to 11 of EP 319999A, compounds D-1 to -87 (pages 3–28) of formulae (1) to (3) of EP 519306A, compounds 1–22 (columns 3–10) of formula (I) of U.S. Pat. No. 4,268,622, and compounds (1)–(31) (columns 2 to 9) of formula (I) of U.S. Pat. No. 4,923,788; and UV absorbents: compounds (18b) to (18r) and 101 to 427 (pages 6–9) of formula (1) of JP-A-46-3335, compounds (3)–(66) of formula (I) (pages 10–44) and compounds HBT-1 to -10 of formula (III) (page 14) of EP 520938A, and compounds (1)–(31) of formula (1) (columns 2 to 9) of EP 521823A.

These functional couplers and additives are preferably used in a molar amount of 0.05 to 10 times, more preferably 0.1 to 5 times of the aforementioned couplers which contribute to coloring.

Hydrophobic additives such as couplers and color developing agents can be introduced in layers of photosensitive materials by known methods such as the method described in U.S. Pat. No. 2,322,027. In the introduction, use can be made of high-boiling organic solvents described in, for example, U.S. Pat. Nos. 4,555,470, 4,536,466, 4,536,467, 4,587,206, 4,555,476 and 4,599,296 and JP-B-3-62256, optionally in combination with low-boiling organic solvents having a boiling point of 50 to 160° C.

In the photosensitive material of the present invention, it is only required that at least one silver halide emulsion layer be formed on a support. A typical example is a silver halide photosensitive material having, on its support, at least one lightsensitive layer constituted by a plurality of silver halide emulsion layers which are sensitive to essentially the same color but have different speeds. This lightsensitive layer includes a unit lightsensitive layer which is sensitive to one of blue light, green light and red light. In a multilayered silver halide color photosensitive material, these unit lightsensitive layers are generally arranged in the order of red-, green- and blue-sensitive layers from a support. However, according to the intended use, this arrangement order may be reversed, or light-sensitive layers sensitive to the same color can sandwich another lightsensitive layer sensitive to a different color. Various non lightsensitive layers such as an interlayer can be formed between the silver halide lightsensitive layers and as the uppermost layer and the lowermost layer. These interlayers may contain, e.g., couplers described above, developing agents, DIR compounds, color-mixing inhibitors and dyes. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045. Also, as described in JP-A's-57-112751, 62-200350, 62-206541 and 62-206543, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH. In addition, as described in JP-B-55-34932 layers can be arranged from the farthest side from a support in the order of blue-sensitive layer/GH/RH/GL/RL. Furthermore, as described in JP-A's-56-25738 and 62-63936 layers can be arranged from the farthest side from a support in the order of blue-sensitive layer/GL/RL/GH/RH.

As described in JP-B-49-15495 three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464. In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed. In order to improve color reproduction, an inter layer effect-donating layer (CL), whose spectral sensitivity distribution is different from those of the main light-sensitive layers of BL, GL and RL, can be arranged adjacent to the main light-sensitive layer or near the main light-sensitive layer, as described in U.S. Pat. Nos. 4,663,271, 4,705,744 and 4,707,436, and JP-A's-62-160448 and 63-89850.

Various layer constructions and arrangements may be selected depending on the purposes of respective photosensitive materials.

In the present invention, the silver halide emulsion and the dye-forming coupler and color developer and/or its precursor may be contained in the same layer or, if they are in reactable states, may be added to different layers. For example, if the color developing agent and the silver halide emulsion are added to different layers, the raw storability of the photosensitive material is increased. The relation between the spectral sensitivity and the hue of coupler in each layer can be determined at discretion. If a cyan coupler, magenta coupler, and yellow coupler are used in a red sensitive layer, green sensitive layer and blue sensitive layer, respectively, it is possible to perform projection exposure directly on a conventional color paper or the like. In the photosensitive material, various non-lightsensitive layers, such as a protective layer, substratum, interlayer, yellow filter layer, and antihalation layer, can be provided on, under, and between the above silver halide emulsion layers, and various auxiliary layers such as a back layer can be provided on the other side of a support.

The dyes capable of using in a yellow filer layer or antihalation layer are preferably those that become colorless or that are removed at the time of development, thereby that do not contribute to density after processing. Specifically, there can be mentioned dyes described in EP No. 549,489A and ExF2 to 6 dyes described in JP-A-7-152129. Also, use can be made of solid-dispersed dyes as described in JP-A-8-101487. The dye can be mordanted in advance with the use of a mordanting agent and a binder. As the mordanting agent and dye, there can be employed those known in the art of photography. For example, use can be made of mordanting agents described in U.S. Pat. No. 4,500,626 columns 58–59, JP-A-61-88256 pages 32–41, and JP-A's 62-244043 and 62-244036.

Further, use can be made of a compound capable of reacting with a reducing agent to thereby release a diffusive dye together with a reducing agent, so that a mobile dye can be released by an alkali at the time of development, transferred to the processing material and removed. Relevant descriptions are found in U.S. Pat. Nos. 4,559,290 and 4,783,396, EP 220,746A2, JIII Journal of Technical Disclosure No. 87-6119. A decolorizable leuco dye or the like can also be employed. For example, JP-A-1-150132 discloses a silver halide photosensitive material containing a leuco dye which has been colored in advance by the use of a developer of a metal salt of organic acid. The complex of leuco dye and developer is decolorized by heating or reaction with an alkali agent.

The coating layers of the photosensitive material of the present invention are preferably hardened by film hardeners. Examples of film hardeners include column 41 and 4,791,042, and JP-A's 59-116655, 62-245261, 61-18942 and 4-218044. More specifically, use can be made of aldehyde film hardeners (e.g., formaldehyde), aziridine film hardeners, epoxy film hardeners, vinylsulfone film hardeners (e.g., N,N'-ethylene-bis(vinylsulfonylacetamido)ethane), N-methylol film hardeners (e.g., dimethylolurea), and boric acid, metaboric acid or polymer film hardeners (compounds described in, for example, JP-A-62-234157). These film hardeners are used in an amount of 0.001 to 1 g, preferably 0.005 to 0.5 g, per g of hydrophilic binder.

In the photosensitive material, various surfactants can be used for the purpose of coating aid, frilling amelioration, sliding improvement, static electricity prevention, development acceleration, etc. Examples of surfactants are described in, for example, Public Technology No. 5 (Mar. 22, 1991, issued by Aztek) pages 136–138 and JP-A's 62-173463 and 62-183457. An organic fluorocompound may be incorporated in the photosensitive material for the purpose of sliding prevention, static electricity prevention, frilling amelioration, etc. As representative examples of organic fluorocompounds, there can be mentioned fluorinated surfactants described in, for example, JP-B-57-9053 columns 8–17 and JP-A's 61-20944 and 62-135826, and hydrophobic fluorocompounds including an oily fluorocompound such as fluoroil and a solid fluorocompound resin such as ethylene tetrafluoride resin. Fluorinated surfactants having a hydrophilic group can also preferably be employed for the purpose of reconciling the wettability and static electricity prevention of photosensitive material.

The photosensitive material preferably has a lubricity. The lubricant-containing layer is preferably provided on both the lightsensitive layer side and the back side. The lubricant which can be used in the present invention, for example, is a polyorganosiloxane, a higher fatty acid amide, a higher fatty acid metal salt or an ester of higher fatty acid and higher alcohol. Examples of polyorganosiloxanes include polydimethylsiloxane, polydiethylsiloxane, polystyrylmethylsiloxane and polymethylphenylsiloxane. The lubricant is preferably added to the back layer or the outermost layer on the emulsion layer side. Especially, poly(dimethylsiloxane) and an ester having a long chain alkyl group are preferred. Silicon oil and paraffin chloride are preferably used to prevent pressure marks and desensitization.

Further, an antistatic agent is preferably used in the present invention. Examples of suitable antistatic agents include such compounds as carboxylic acids and carboxylate, sulfonate-containing polymers, cationic polymers and ionic surfactant. Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 μm or a composite oxide thereof (Sb, P, B, In, S, Si, C, etc.) and fine grains of sol form metal oxides or composite oxides thereof. The content thereof in the photosensitive material is preferably in the range of 5 to 500 mg/m$^2$. The ratio of amount of conductive crystalline oxide or composite oxide thereof to binder is preferably in the range of 1:300 to 100:1. On the back of the support of the photosensitive material is preferably coated with a water resistant polymer described in JP-A-8-292514. The photosensitive material or later described processing material constitution (including back layer) can be loaded with various polymer latexes for the purpose of film property improvements, such as dimension stabilization, curling prevention, sticking prevention, film cracking prevention and pressure increase desensitization prevention. For example, use can be made of any of polymer latexes described in JP-A's 62-245258, 62-136648 and 62-110066. In particular, when a polymer latex of low glass transition temperature (40° C. or below) is used in a mordant layer, the cracking of the mordant layer can be prevented. Further, when a polymer latex of high glass transition temperature is used in a back layer, a curling preventive effect can be exerted.

In the photosensitive material of the present invention, a matting agent is preferably contained. The matting agent, although can be contained in the emulsion side or the back side, is most preferably incorporated in an outermost layer of the emulsion side. The matting agent may be soluble, or insoluble, in processing solutions. It is preferred that soluble and insoluble matting agents be used in combination. For example, polymethyl methacrylate, polymethyl methacrylate/methacrylic acid (9/1 or 5/5 in molar ratio) and polystyrene particles are preferred. The particle diameter is preferably in the range of 0.8 to 10 μm, and a narrow particle diameter distribution is preferred. It is preferred that 90% or more of all the particles have diameters which fall within 0.9 to 1.1 times the average particle diameter. For enhancing matting properties, it is also preferred to simultaneously add fine particles of up to 0.8 μm. As such fine particles, there can be mentioned, for example, polymethyl methacrylate (0.2 μm), polymethyl methacrylate/methacrylic acid (9/1 in molar ratio, 0.3 μm), polystyrene particles (0.25 μm) and colloidal silica (0.03 μm).

In the present invention, as the support of the photosensitive material, there can be employed a transparent one capable of resisting processing temperatures. Generally, use can be made of photographic supports of paper, synthetic polymers (films), etc. as described in pages 223 to 240 of "Shashinkogaku no Kiso—Gin-en Shashin Hen—(Fundamental of Photographic Technology—Silver Salt Photography—)" edited by The Society of Photographic Science and Technologh of Japan and published by CMC Co., Ltd. (1979). For example, use can be made of supports of polyethylene terephthalate, polyethylene naphthalate, polycarbonate, polyvinyl chloride, polystyrene, polypropylene, polyimide and cellulose (e.g., triacetylcellulose). Also, use can be made of supports described in, for example, JP-A-62-253159, pages 29 to 31, JP-A-1-161236, pages 14 to 17, JP-A's-63-316848, 2-22651 and 3-56955 and U.S. Pat. No. 5,001,033. In order to improve optical properties and physical properties, these supports can be subjected to, for example, heat treatment (crystallization degree and orientation control), monoaxial or biaxial drawing (orientation control), blending of various polymers and surface treatment. When requirements on heat resistance and curling properties are especially strict, supports described in JP-A's-6-41281, 6-43581, 6-51426, 6-51437 and 6-51442 can preferably be employed as the support of the lightsensitive material. Moreover, a support of a styrene polymer of mainly syndiotactic structure can preferably be employed. The thickness of the supports is preferably in the range of 5 to 200 μm, more preferably 40 to 120 μm.

Examples of the polyester support that is preferably used in the present invention will be described below. Particulars thereof together with the below mentioned photosensitive material, processing, cartridge and working examples are specified in Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to-200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). An ultraviolet absorbent may be kneaded into this polyester. Moreover, a commercially available dye or pigment for polyester may be kneaded in order to prevent light piping. It is preferable that a surface of a support is processed in order to adhere a support to a photographic constituting layer. Examples of surface activation treatment include chemical treatment, mechanical treatment, corona discharge treatment, flame treatment, ultraviolet light treatment, high-frequency wave treatment, grow-discharge treatment, active plasma treatment, Laser treatment, mixed acid treatment and ozone oxidation treatment. Preferable surface treatments are ultraviolet light treatment, flame treatment, corona discharge treatment and grow-discharge treatment.

Next, a subbing layer will be described. The subbing layer may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose, gelatin, polyvinyl alcohol and denatured polymers of these. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 μm) may be incorporated therein as a matting agent. The supports provided, for example, with a magnetic recording layer such as described in JP-A's-4-124645, 5-40321, 6-35092, 6-317875 are preferably used as a support to record photographing records.

The magnetic recording layer is obtained by coating on a support with a water-base or organic solvent coating liquid having magnetic material grains dispersed in a binder. Suitable magnetic material grains can be composed of any of ferromagnetic iron oxides such as γ $Fe_2O_3$, Co coated γ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated γ $Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$. The saturation magnetization (σs) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652. The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred.

The thickness of the magnetic recording layer ranges from 0.1 to 10 μm, preferably 0.2 to 5 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15.

The film patrone employed in the present invention will be described below. The main material composing the patrone for use in the present invention may be a metal or a synthetic plastic. Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538.

The photosensitive material of the present invention described above can be preferably used for lens-equipped film units disclosed in JP-B-2-32615 and Jpn. U.M. Appln. KOKOKU Pub. No. 3-39784. The lens-equipped film unit is a unit made by containing a sheet-like or rolled unexposed color photosensitive material directly, or in casing, in a package unit main body provided, in advance, with a taking lens and a shutter, bonding the main body to seal light out, and further casing it. The package case main body further comprises a finder, a frame advance mechanism for the photosensitive material, and a mechanism for receiving and taking an exposed color photosensitive material. The finder can be provided with a parallax correction support, and the photographic mechanism can be provided with an assistant lighting mechanism disclosed in Jpn. U.M. Appln. KOKAI Pub. Nos. 1-93723, 1-57738 and 1-57740, JP-A-'s 1-93723 and 1-152437.

The photosensitive material of the present invention can be developed by conventional methods described in the above RD's No. 17643, pages 28–29, 18716, left and right column of page 651, and 307105, pages 880–881. A C-41 development of Eastman Kodak Co. and a CN-16 development of Fuji Photo Film Co., Ltd. can be used as development for color negative films used in the present invention. The development for color reversal films used in the present invention is detailed from page 1, line 5 to page 10, line 5, and from page 15, line 8 to page 24, line 2 of a publicly-known document No. 6 (Apr. 1, 1991) published by Aztec Corporation, and the contents thereof can be preferably used. Examples of preferable development including the above contents are an E-6 development of Eastman Kodak Co. and a CR-56 development of Fuji Photo Film Co., Ltd. It is possible to form an image of the photosensitive material of the present invention by developing the material by activator processing, or developing it with a processing solution containing a developing agent/base. The activator processing is a method of processing in which a color-developing agent is included in a photosensitive material and development is performed with a processing solution containing no color-developing agent. The processing solution in this method is characterized by containing no color developing agent which is contained in a common developing solution. The processing solution may contain other constituents (i.e. alkali, an auxiliary developing agent and the like). Activator processing is described in publicly known documents such as EP 545,491 Al and 565,165 A1.

It is also preferable that the image of the photosensitive material of the present invention is formed by heat development after image exposure. Heat processing of photosensitive materials is publicly known in the field of the art. Heat development photosensitive materials and processing thereof are described in "Shashin Kogaku no Kiso (Principles of Photographic Science and Engineering)" (1970, published by Corona Publishing Co., Ltd.), pages 553–555, "Eizou Johou (Image Information)" published on April 1978, page 40, Nabletts Handbook of Photography and Reprography 7th Ed. (Vna Nostrand and Reinhold Company) pages 32–33, U.S. Pat. Nos. 3,152,904, 3,301,678, 3,392,020 and 3,457,075, UK Patent Nos. 1,131,108 and 1,167,777, and RD No. 17029 (1978), pages 9–15. The heating temperature of the heat development is about 50 to 250° C., and the range of 60 to 180° C. is especially useful.

Next, a processing material and processing method used in the case of adopting heat development in the present invention will now be described in detail. In the photosensitive material of the present invention, a base or base precursor can be used to promote silver development and dye formation reaction. Examples of the base precursor are a salt of a base and an organic salt which is capable of decarboxylated by heat, and a compound which releases amines by intramolecular nucleophilic substitution, Lossen rearrangement and Beckman rearrangement. Specific examples thereof are disclosed in U.S. Pat. Nos. 4,514,493 and 4,657,848 and Publicly-Known Techniques, Number 5 (Mar. 22, 1991, published by Aztec Corporation) pages 55–86, etc. Further, as described in EP 210,660 and U.S. Pat. No. 4,740,445, a method can be adopted in which a base is generated by a combination of a basic metal compound hardly soluble in water, and a compound which is capable of undergoing complex-forming reaction with the metal ion of the basic metal compound (the compound is called "complex-forming compound"). The amount of use of the base or base precursor is 0.1 to 20 g/m$^2$, preferably 1 to 10 g/m$^2$. To supply a base, a processing member having a processing layer containing the base or base precursor can be used.

When heat development is performed by using a processing member, a small quantity of water is preferably used to promote development, transfer of the processing material, or diffusion of unnecessary substances. Specific examples thereof are described in U.S. Pat. Nos. 4,704,245 and 4,470,445, and JP-A-61-238056.

A publicly-known heat solvent can be added to the heat development photosensitive material for the purpose of promoting heat development. The heat solvent is an organic substance which is a solid in an ambient temperature, but has, together with the other components, a mixed melting point at a heat development temperature to be used or a lower temperature, and is liquefied at the time of heat development to perform a function of promoting the heat development and heat transfer of dye. As the heat solvent, useful are compounds which can be a solvent of a developer, compounds which are substances having a high dielectric constant and known as a promoter of physical development of silver salt, and compounds which are compatible with a binder and have a function of swelling the binder, and the like.

In the present invention, although image information can be taken in without removing developed silver generated by development and undeveloped silver halide, the image can also be taken in after removing them. In the latter case, means for removing them simultaneously with or after development can be applied. In order to remove developed silver in the photosensitive material simultaneously with development, or in order to make silver halide into complex or to solubilize silver halide, it is possible to contain, in the processing member, an oxidizer to silver or re-halogenator functioning as a bleaching agent, or a silver halide solvent functioning as a fixing agent, thereby to cause the above reactions at the time of heat development. Further, it is also possible, after the completion of the development for image formation, that a second member containing an oxidizer to silver, re-halogenator or a silver halide solvent is bonded to the photosensitive material, and thereby to remove developed silver, or make silver halide into complex or to solubilize silver halide.

Any commonly-used silver bleaching agents can be used as a bleaching agent to be used in the processing member of the present invention. Such bleaching agents are described in U.S. Pat. Nos. 1,315,464 and 1,946,640, and Photographic Chemistry, vol.2, chapter 30, Foundation Press, London, England. As the fixing agent, a silver halide solvent which can be contained in the processing member (first processing member) for developing the lightsensitive member can be used. The same binder, support and other additives as those used for the first processing member can be used for the second processing member.

In the present invention, it is also preferable to photoelectrically read an image formed on the photosensitive material by heat development, and convert it into a digital signal. A generally known image input device can be used as an image reading device. The details of the image input device is described in Takao Andoh, et al. "Digital Gazou Nyuuryoku no Kiso (Basis of Digital Image Input)" Corona Corporation (1998), pages 58–98.

Suitable examples of an image-processing method applicable to the image formation in the present invention are described below. The image-processing system and method disclosed in JP-A-6-139323 can be adopted, which enables faithful color reproduction of an object from a negative film, more specifically, which comprises forming an object image in a color negative, transforming the image into image data corresponding thereto by means of a scanner or the like, and outputting the same colors as those of the object from the demodulated color information. As an image-processing method which comprises controlling the graininess or noise of a digitized image and emphasizing the image sharpness, the method disclosed in JP-A-10-243238 may be employed, wherein the weighting and subdividing processing of edges and noises is carried out on the basis of sharpness emphasized image data, smoothened image data and edge detection data, or the image-processing method disclosed in JP-A-10-243239 may be employed, wherein the edge component is determined on the basis of sharpness emphasized image data and smoothened image data, and then the weighting and subdividing processing is carried out.

In order that, in a digital color print system, the color reproduction in the final prints is corrected for variations arising from differences in, e.g., storage condition and development condition for picture-taking materials, the method disclosed in JP-A-10-255037 can be adopted, wherein the unexposed area of a picture-taking material is exposed to light via patches of at least 4 steps or 4 colors, developed and then examined for the patch densities, thereby determining the look-up table and the color conversion matrix necessary for correction and carrying out color correction of photographic images by the use of the look-up table conversion and the matrix operation.

As a method of changing the color reproduction region of image data, the method disclosed in JP-A-10-229502 can be adopted, wherein the image data are represented by color signals which form a color regarded as visually neutral when their values are well matched, and each color signal is decomposed to a colored component and a colorless component and these components are processed individually. With respect to the image-processing method for eliminating the deterioration in quality of images taken with a camera due to aberration of the camera lens and light quantity decrease in a peripheral part of the camera lens, the method and device disclosed in JP-A-11-69277 may be employed, wherein a lattice-shaped correction pattern for making correction data on image deterioration is recorded in advance on film, the image and the correction pattern are read with a film scanner or the like after picture-taking, and thereby the data for correcting the deterioration factors attributed to the camera lens are made, and further the digital image data is corrected using the correction data of the image deterioration.

As for the colors of skin and blue sky, too emphasized sharpness brings about the emphasis of graininess (noise) to create an unpleasant impression, so that it is desirable to control the degree to which the sharpness of those images is emphasized. As a method suitable for such control, the method disclosed in, e.g., JP-A-11-103393, may be adopted, wherein the USM coefficient, namely the unsharp masking coefficient, is taken as the function of (B-A) and (R-A) in the unsharp masking-utilized sharpness emphasizing processing.

Further, the colors of skin, green grass and blue sky are referred to as important colors with respect to color reproduction, and require selective processing for their color reproduction. As for the brightness reproduction, it is said that the visually desirable finishing is to give a bright color to the skin image and a deep blue color to the sky image. As a method of reproducing the important colors in colors with visually desirable brightness, the method disclosed in, e.g., JP-A-11-177835 may be adopted, wherein the color signal for each pixel is converted by the use of a coefficient capable of taking a small value when the corresponding hue is yellowish red, while a great value when the corresponding hue is cyan blue, such as the hue of (R-G) or (R-B).

In order to effect natural emphasis processing by suppressing troubles, such as highlight discontinuity and collapse in high density section, and controlling the generation of data outside the defined region at the time of processing for increase in saturation, sharpness and so on, the image-processing method and device disclosed in JP-A-11-177832 can be used, wherein the density data of each color among color image data are converted to exposure density data by the use of a characteristic curve and then subjected to image processing, including color emphasis, and further converted to density data by the use of a characteristic curve.

EXAMPLES

The following are examples of the present invention. However, the present invention is not limited to them.

Example 1

Silver halide emulsions Em-A, Em-AP1, Em-AP2, and Em-ARP1 to Em-ARP12 were prepared by the following methods.

(Em-A)

42.2 liter (hereinafter liter is also referred to as "L") of an aqueous solution containing 31.7 g of a low-molecular-weight gelatin of 15,000 molecular weight and converted to phthalate at a ratio of 97% and 31.7 g of KBr was vigorously agitated while maintaining the temperature at 35° C. 1583 milliliter (hereinafter milliliter is also referred to as "mL") of an aqueous solution containing 316.7 g of $AgNO_3$ and 1583 mL of an aqueous solution containing 221.5 g of KBr and 52.7 g of a low-molecular-weight gelatin whose molecular weight was 15,000 were added by the double jet method over a period of 1 min. Immediately after the completion of the addition, 52.8 g of KBr was added, 2485 mL of an aqueous solution containing 398.2 g of $AgNO_3$ and 2485 mL of an aqueous solution containing 291.1 g of KBr were added by the double jet method over a period of 2 min. Immediately after the completion of the addition, 47.8 of KBr was added and heated to 40° C., and the mixture was ripened. After the completion of the ripening, 923 g of a gelatin of 100,000 molecular weight converted to phthalate at a ratio of 97% and 79.2 g of KBr were added, and an aqueous solution of KBr and 15,947 mL of an aqueous solution containing 5,103 g of $AgNO_3$ were added by the double jet method over a period of 12 min while increasing the flow rate so that the final flow rate was 1.4 times the initial flow rate. During this period, the silver potential was maintained at −60 mV against saturated calomel electrode. After the mixture was washed with water, gelatin was added, and effecting adjustments to a pH of 5.7, a pAg of 8.8, a gelatin weight to 64.1 g and weight of the emulsion, in terms of silver, to 131.8 g per kg of emulsion. Thus, a seed emulsion was obtained.

1211 mL of an aqueous solution containing 46 g of a gelatin converted to phthalate at a ratio of 97% and 1.7 g of KBr was vigorously agitated while maintaining the temperature at 75° C. 9.9 g of the above seed emulsion and then 0.3 g of modified silicon oil (L7602, produced by Nippon Unicar Company, Limited) were added thereto. $H_2SO_4$ was added to thereby adjust the pH to 5.5, and 67.6 mL of an aqueous solution containing 7.0 g of $AgNO_3$ and an aqueous solution of KBr were added by the double jet method over a period of 6 min while increasing the flow rate so that the final flow rate was 5.1 times the initial flow rate. During this period, the silver potential was maintained at −20 mV against saturated calomel electrode. 2 mg of sodium benzenethiosulfonate was added, an aqueous solution containing 144.5 g of $AgNO_3$ and 410 mL of a mixed aqueous solution of KBr and KI containing 7 mol % of KI were added by the double jet method over a period of 56 min while increasing the flow rate so that the final flow rate was 3.7 times the initial flow rate. During this period the silver potential was maintained at −30 mV against saturated calomel electrode. Still further, an aqueous solution of KBr and 121.3 mL of an aqueous solution containing 45.6 g of $AgNO_3$ were added by the double jet method over a period of 22 min. During this period, the silver potential was maintained at +20 mV against saturated calomel electrode. The mixture was heated to 82° C., and KBr was added to thereby adjust the silver potential to −80 mV. Thereafter, an AgI fine grain emulsion of 0.037 $\mu$m grain size was added in an amount, in terms of the weight of KI, of 6.33 g. Immediately after the completion of the addition, 206.2 mL of an aqueous solution containing 66.4 g of $AgNO_3$ was added over a period of 16 min. For 5 min in the initial stage of addition, the silver potential was maintained at −80 mV by the use of an aqueous solution of KBr. The mixture was washed with water, and gelatin was added, adjusting the pH and pAg thereof at 40° C. to 5.8 and 8.7, respectively. The gelatin contains ingredients having a molecular weight of 280,000 or more, which was measured according to PAGI method, in an amount of 30%. The temperature was raised to 60° C., sensitizing dyes 11 and 12 were added, and potassium thiocyanate, chloroauric acid, sodium thiosulfate and N,N-dimethylselenourea were added to thereby effect optimum chemical sensitization. At the completion of chemical sensitization, Compounds 13 and 14 were added. The terminology "optimum chemical sensitization" used herein means that the addition amount of sensitizing dye or each compound has been selected so as to fall within the range of $10^{-1}$ to $10^{-8}$ mol per mol of silver halide.

Sensitizing dye 11

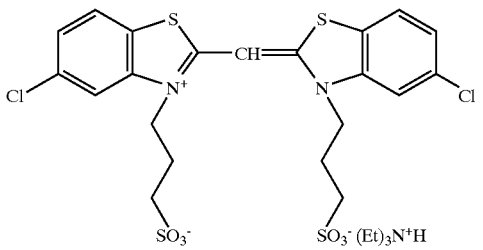

Sensitizing dye 12

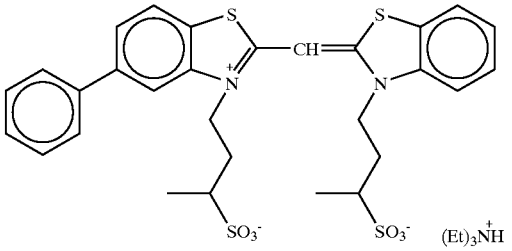

Compound 13

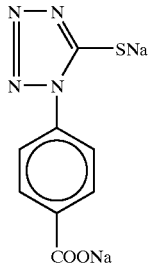

Compound 14

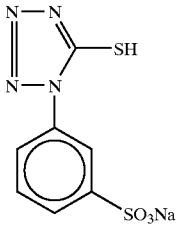

The thus obtained grains were observed with transmission electron microscope while cooling with liquid nitrogen. As a result, 10 or more dislocation lines per grain were observed at a periphery portion of the grains (Characteristics of the obtained silver halide emulsion Em-A and other emulsions are shown in Table 5 of Example 3.)

(Em-AP1 and Em-AP2)

Emulsions Em-AP1 and Em-AP2 were obtained in the same manner as in Em-A, except that the compounds 24 and 11 of the present invention was added, respectively, after the temperature of the emulsion which was chemically sensitized after addition of compounds 13 and 14 was lowered to 40° C., so that the contents of the compounds to the silver amount in the emulsion were as shown in Table 1.

(Em-ARP1 to Em-ARP4)

Emulsions Em-ARP1 to Em-ARP4 were obtained in the same manner as in Em-AP1 or Em-AP2, except that the reducing compound $B_1$-1 or $B_9$-7 was added to the emulsion before the addition of compound 24 or 11, so that the contents of the compounds to the silver amount in the emulsion were as shown in Table 1.

(Em-ARP5 to Em-ARP8)

Emulsions Em-ARP5 to Em-ARP8 were obtained in the same manner as in Em-AP1 or Em-AP2, except that the reducing compound $B_2$-3 or $B_{11}$-1 was added to the emulsion before the addition of sensitizing dyes 11 and 12 at the time of chemical sensitization, so that the contents of the compounds to the silver amount in the emulsion were as shown in Table 1.

(Em-ARP9 to Em-ARP10)

Emulsions Em-ARP9 and Em-ARP10 were obtained in the same manner as in Em-AP1 and Em-AP2, respectively, except that the reducing compound $B_{11}$-1 was added to the emulsion before the addition of sensitizing dyes 11 and 12 at the time of chemical sensitization, so that the content of the compound to the silver amount in the emulsion was as shown in Table 1, and the reducing compound $B_1$-1 was added to the emulsion before addition of the compound 24 or 11 of the present invention, so that the content of the reducing compound to the silver amount in the emulsion was as shown in Table 1.

(Em-ARP11 to Em-ARP12)

Emulsions Em-ARP11 and Em-ARP12 were obtained in the same manner as in Em-AP1 and Em-AP2, respectively, except that the reducing compounds $B_6$-2 and $B_9$-7 were added to the emulsion before addition of the compound 24 or 11 of the present invention, so that the contents of the compounds to the silver amount in the emulsion were as shown in Table 1.

TABLE 1

Addition time and amount of the compounds according to the present invention into Em-A to, Em-ARP12

| Emulsion No. | Compound of types 1 to 4 ($\times 10^{-6}$ mol/Ag-mol) | Reducing compound Before the addition of sensitizing dye ($\times 10^{-6}$ mol/Ag-mol) | After the addition of Compounds 13 and 14 ($\times 10^{-3}$ mol/Ag-mol) |
|---|---|---|---|
| A | — | — | — |
| AP1 | Exemplified compound 24 (9) | — | — |
| AP2 | Exemplified compound 11 (6) | — | — |
| ARP1 | Exemplified compound 24 (9) | — | $B_1$-1 (2) |
| ARP2 | Exemplified compound 11 (6) | — | $B_1$-1 (2) |
| ARP3 | Exemplified compound 24 (9) | — | $B_9$-7 (2) |
| ARP4 | Exemplified compound 11 (6) | — | $B_9$-7 (2) |
| ARP5 | Exemplified compound 24 (9) | $B_2$-3 (2) | — |
| ARP6 | Exemplified compound 11 (6) | $B_2$-3 (2) | — |
| ARP7 | Exemplified compound 24 (9) | $B_{11}$-1 (3) | — |

TABLE 1-continued

| Emulsion No. | Compound of types 1 to 4 ($\times 10^{-6}$ mol/Ag-mol) | Reducing compound Before the addition of sensitizing dye ($\times 10^{-6}$ mol/Ag-mol) | After the addition of Compounds 13 and 14 ($\times 10^{-3}$ mol/Ag-mol) |
|---|---|---|---|
| | Addition time and amount of the compounds according to the present invention into Em-A to, Em-ARP12 | | |
| ARP8 | Exemplified compound 11 (6) | $B_{11}$-1 (3) | — |
| ARP9 | Exemplified compound 24 (9) | $B_{11}$-1 (3) | $B_1$-1 (2) |
| ARP10 | Exemplified compound 11 (6) | $B_{11}$-1 (3) | $B_1$-1 (2) |
| ARP11 | Exemplified compound 24 (9) | — | $B_6$-2 (0.1), $B_9$-7 (3) |
| ARP12 | Exemplified compound 11 (6) | — | $B_6$-2 (0.1), $B_9$-7 (3) |

Samples 101 to 124 were prepared by coating each of the emulsions Em-A, Em-AP1, Em-AP2, and Em-ARP1 to Em-ARP12 on respective cellulose triacetate film supports each provided with a substratum, under coating conditions as shown in the following Table A (the reducing compound to be additionally added to the emulsion is also shown in Table 2).

samples were exposed to light and processed in the same manner, to obtain raw stock storability.

The development was done as follows by using an automatic processor FP-350 manufactured by Fuji Photo Film Co., Ltd (until the accumulated replenishing amount becomes three times the mother tank solution).

TABLE A

| | | |
|---|---|---|
| (1) | Emulsion layer | |
| | Emulsion: Each emulsion | (silver $1.63 \times 10^{-2}$ mol/m$^2$) |
| | Coupler | ($2.26 \times 10^{-3}$ mol/m$^2$) |

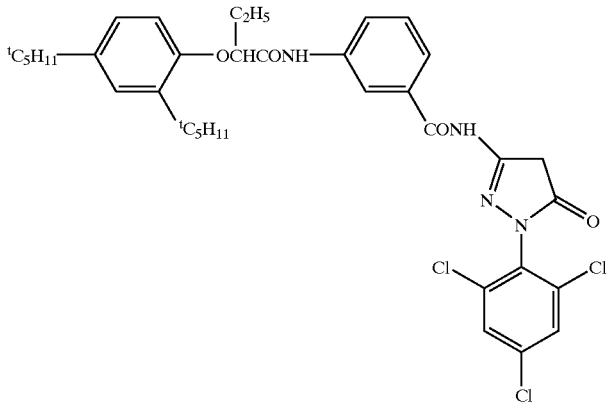

| | | |
|---|---|---|
| | Reducing compound of the invention (Compounds and the amount thereof are described in Tables 2 and 4) | |
| | Tricresyl phosphate | (1.32 g/m$^2$) |
| | Gelatin | (3.24 g/m$^2$) |
| 2) | Protective layer | |
| | 2,4-dichloro-6-hydroxy-s-triazine sodium salt | (0.08 g/m$^2$) |
| | Gelatin | (1.80 g/m$^2$) |

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge, to obtain fresh photographic property. Another set of the same samples was subjected to the same film hardening, kept under the conditions of 50° C. and 80% RH for three days. Then, the (Processing Steps)

| Step amount* | Time | Temperature | Replenishing |
|---|---|---|---|
| Color development | 2 min 45 sec | 38° C. | 45 mL |
| Bleaching | 1 min 00 sec | 38° C. | 20 mL |
| All of the | | | |

-continued

| Step amount* | Time | Temperature | Replenishing |
|---|---|---|---|
| overflow of the bleach solution was flown to the tank of bleach-fix | | | |
| Bleach-fix | 3 min 15 sec | 38° C. | 30 mL |
| Washing (1) | 40 sec | 35° C. | Counter |
| current flow from (2) to (1) | | | |
| Washing (2) | 1 min 00 sec | 35° C. | 30 mL |
| Stabilization | 40 sec | 38° C. | 20 mL |
| Drying | 1 min 15 sec | 55° C. | |

*The replenishment rate is a value per 1.1 m of a 35-mm wide lightsensitive material (equivalent to one role of 24 Ex. film).

The composition of each processing solution was as follows.

| (Color developer) | Tank solution (g) | Replenisher (g) |
|---|---|---|
| Diethylenetriaminepentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methylaniline sulfate | 4.5 | 5.5 |
| Water to make | 1.0 L | 1.0 L |
| pH (adjusted by the use of potassium hydroxide and sulfuric acid) | 10.05 | 10.10 |

| (Bleach solution) | Common to tank solution and replenisher (unit: g) |
|---|---|
| Fe(III) ammonium ethylenediaminetetraacetate Dihydrate | 120.0 |
| Disodium ethylenediaminetetraacetate | 10.0 |
| Ammonium bromide | 100.0 |
| Ammonium nitrate | 10.0 |
| Bleach accelerator $(CH_3)_2N—CH_2—CH_2—S—S—CH_2—CH_2—N(CH_3)_2.2HCl$ | 0.005 mol |
| Aqueous ammonia (27%) | 15.0 ml |

-continued

| | |
|---|---|
| Water to make | 1.0 L |
| pH (adjusted by the use of aqueous ammonia and nitric acid) | 6.3 |

| (Bleach-fix sol) | Tank solution (g) | Replenisher (g) |
|---|---|---|
| Fe (III) ammonium ethylenediaminetetraacetate Dihydrate | 50.0 | — |
| Disodium ethylenediaminetetraacetate | 5.0 | 2.0 |
| Sodium sulfite | 12.0 | 20.0 |
| Aqueous solution of ammonium thiosulfate (700 g/L) | 240.0 mL | 400.0 mL |
| Aqueous ammonia (27%) | 6.0 ml | — |
| Water to make | 1.0 L | 1.0 L |
| pH (adjusted by aqueous ammonia and acetic acid) | 7.2 | 7.3 |

(Washing Water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 0.15 g/L of sodium sulfate were added. The pH of the solution ranged from 6.5 to 7.5.

| (Stabilizer) | Common to tank solution and replenisher (unit: g) |
|---|---|
| Sodium p-toluenesulfinate | 0.03 |
| Polyoxyethylene-p-monononylphenyl ether (av. polymerization degree: 10) | 0.2 |
| Disodium Ethylenediaminetetraacetic acid | 0.05 |
| 1,2,4-Triazole | 1.3 |
| 1,4-Bis (1,2,4-triazol-1-ylmethyl) piperazine | 0.75 |
| Water to make | 1.0 L |
| PH | 8.5 |

The results of photographic performances of the samples are shown in the following Table 2. The speed of each sample was indicated by a relative value of a logarithm of a reciprocal of an exposure amount necessary for reaching the density of the fog density plus 0.2. (Sample 101 was regarded as a control: 100).

TABLE 2

Photographic performance of Samples 101 to 124

| Sample | Used emulsion | Reducing compound ($\times 10^{-2}$/Ag) | Photographic performance with green filter: Relative speed | Photographic performance with green filter: Fog | Photographic performance after storage under heat: Relative speed | Photographic performance after storage under heat: Fog after storage under heat | Remarks |
|---|---|---|---|---|---|---|---|
| 101 | A | — | 100 (control) | 0.21 | 98 | 0.23 | Comp. |
| 102 | AP1 | — | 115 | 0.36 | 95 | 0.45 | Comp. |
| 103 | AP2 | — | 113 | 0.38 | 94 | 0.44 | Comp. |
| 104 | ARP1 | — | 121 | 0.26 | 116 | 0.32 | Inv. |
| 105 | ARP2 | — | 119 | 0.27 | 114 | 0.33 | Inv. |

TABLE 2-continued

Photographic performance of Samples 101 to 124

| Sample | Used emulsion | Reducing compound ($\times 10^{-2}$/Ag) | Photographic performance with green filter: Relative speed | Photographic performance with green filter: Fog | Photographic performance after storage under heat: Relative speed | Photographic performance after storage under heat: Fog after storage under heat | Remarks |
|---|---|---|---|---|---|---|---|
| 106 | ARP3 | — | 120 | 0.25 | 116 | 0.33 | Inv. |
| 107 | ARP4 | — | 117 | 0.26 | 115 | 0.34 | Inv. |
| 108 | ARP5 | — | 118 | 0.31 | 113 | 0.37 | Inv. |
| 109 | ARP6 | — | 119 | 0.32 | 113 | 0.38 | Inv. |
| 110 | ARP7 | — | 120 | 0.28 | 115 | 0.34 | Inv. |
| 111 | ARP8 | — | 119 | 0.27 | 114 | 0.33 | Inv. |
| 112 | ARP9 | — | 125 | 0.24 | 120 | 0.30 | Inv. |
| 113 | ARP10 | — | 124 | 0.24 | 119 | 0.31 | Inv. |
| 114 | ARP11 | — | 122 | 0.26 | 118 | 0.33 | Inv. |
| 115 | ARP12 | — | 123 | 0.25 | 119 | 0.32 | Inv. |
| 116 | A | $B_2$-4 (1) | 102 | 0.20 | 100 | 0.22 | Comp. |
| 117 | AP1 | $B_2$-4 (1) | 123 | 0.25 | 118 | 0.30 | Inv. |
| 118 | AP2 | $B_2$-4 (1) | 122 | 0.26 | 117 | 0.31 | Inv. |
| 119 | ARP1 | $B_2$-4 (1) | 132 | 0.23 | 129 | 0.26 | Inv. |
| 120 | ARP2 | $B_2$-4 (1) | 129 | 0.23 | 127 | 0.27 | Inv. |
| 121 | ARP7 | $B_2$-4 (1) | 126 | 0.24 | 122 | 0.28 | Inv. |
| 122 | ARP8 | $B_2$-4 (1) | 125 | 0.24 | 122 | 0.29 | Inv. |
| 123 | ARP9 | $B_2$-4 (1) | 135 | 0.22 | 131 | 0.24 | Inv. |
| 124 | ARP10 | $B_2$-4 (1) | 136 | 0.21 | 133 | 0.23 | Inv. |

Table 2 shows that a combined use of at least one of the reducing compounds of the present invention, with compound 24 or 11, which is a compound represented by types (1) to (4) of the present invention, reduces the density of unexposed region (fog) as one of the fresh photographic property, and enlarges the speed enhancing effect.

Further, it also shows that, also in the case of keeping the samples under the conditions of 50° C. and 80% RH for three days, the combined use of the reducing compounds of the present invention with a compound represented by types (1) to (4) of the present invention reduces the speed decrement after the raw stock storage, and attains low fog.

In addition, a combined use of plural kinds of the reducing compounds of the present invention with a compound represented by types (1) to (4) of the present invention further improves the unexposed part density (fog) as one of the fresh photographic property, and reduces deterioration of fog after raw stock storage.

Example 2

Silver halide emulsions Em-Q, Em-QP1, Em-QP2, and Em-QRP1 to Em-QRP10 were prepared by the following methods.

(Em-Q)

1,200 mL of an aqueous solution containing 0.38 g of a gelatin of 10,000 molecular weight and converted to phthalate at a ratio of 97%, and 0.99 g of KBr were vigorously stirred at 60° C., while adjusting the pH thereof at 2. An aqueous solution containing 1.96 g of $AgNO_3$, an aqueous solution containing 1.97 g of KBr, and 0.172 g of KI were added over 30 sec by the double jet method. After the ripening, 12.8 g of trimellitated gelatin whose amino groups were chemically modified with trimellitic acid, containing 35 $\mu$mol of methionine per g thereof and having a molecular weight of 100,000 was added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 35 min by the double jet method. During the addition, the silver potential was maintained at −50 mV against a saturated calomel electrode. An aqueous solution containing 65.6 g of $AgNO_3$ and an aqueous KBr solution were added over 37 min by the double jet method while the flow rate was accelerated so that the final flow rate was 2.1 times the initial flow rate. During the addition, AgI fine grain emulsion that was used in the preparation of Em-A was simultaneously added at an accelerated flow rate such that the silver iodide content was 6.5 mol %. At the same time, the silver potential was maintained at −50 mV. 132 mL of an aqueous solution containing 41.8 g of $AgNO_3$ and an aqueous KBr solution were added over 13 min by the double jet method. The addition of the aqueous KBr solution was so adjusted that the silver potential at the completion of the addition was +40 mV. After 2 mg of sodium benzenethiosulfonate, KBr was added to adjust the silver potential at −100 mV. The above-mentioned AgI fine grain emulsion was added in an amount of 6.2 g in terms of a KI weight. Immediately after the addition, 300 mL of an aqueous solution containing 88.5 g of $AgNO_3$ were added over 8 min. An KBr solution was added so that the potential at the completion of the addition was adjusted to +60 mV. After washing with water, gelatin was added, and pH and pAg were adjusted to 6.5 and 8.2, respectively at 40° C. Then, the temperature was raised to 61° C. After sensitizing dyes 15, 16 and 17 were added, $K_2IrCl_6$, potassium thiocyanate, chlorauric acid, sodium thiosulfate, and N,N-dimethylselenourea were added to optimally perform chemical sensitization. Compounds 13 and 14 were added at the completion of the chemical sensitization.

Sensitizing dye 15

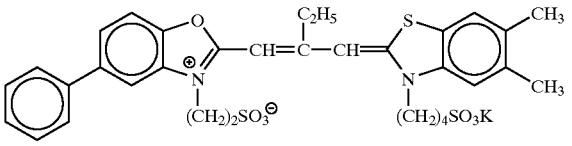

Sensitizing dye 16

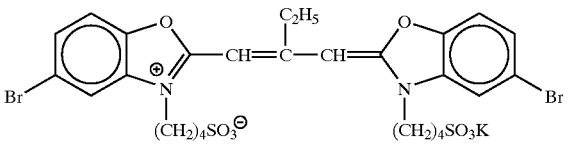

Sensitizing dye 17

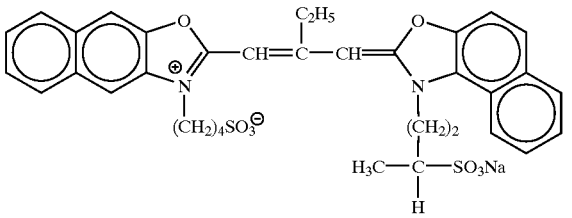

(Em-QP1 and Em-QP2)

Emulsions Em-QP1 and E-QP2 were obtained in the same manner as in Em-Q, except that the compounds 9 and 41 of the present invention was added, respectively, to the chemically sensitized emulsion after the addition of the compounds 13 and 14 so that the content of the compound to the silver amount in the emulsion was as shown in Table 3.

(Em-QRP1 to Em-QRP4)

Emulsions Em-QRP1 to Em-QRP4 were obtained in the same manner as in Em-QP1 or Em-QP2, except that the reducing compound $B_6$-6 or $B_3$-12 of the present invention was added to the emulsion before the addition of the sensitizing dyes 15, 16 and 17 at the time of chemical sensitization so that the content of the compound to the silver amount in the emulsion was as shown in Table 3.

(Em-QRP5 to Em-QRP8)

Emulsions Em-QRP5 to Em-QRP8 were obtained in the same manner as in Em-QP1 or Em-QP2, except that the reducing compound $B_{11}$-11 or $B_{10}$-1 of the present invention was added to the emulsion before the addition of the compound 9 or 41 so that the content of the reducing compound to the silver amount in the emulsion was as shown in Table 3.

(Em-QRP9 and Em-QRP10)

Emulsions Em-QRP9 and Em-QRP10 were obtained in the same manner as in Em-QP1 and Em-QP2, respectively, except that the reducing compound $B_1$-10 of the present invention was added to the emulsion before the addition of the sensitizing dyes 15, 16 and 17 at the time of chemical sensitization so that the content of the reducing compound to the silver amount in the emulsion was as shown in Table 3.

TABLE 3

| | Addition time and amount of the compounds according to the present invention into Em-Q to Em-QRP10 | | |
|---|---|---|---|
| | | Reducing compound | |
| Emulsion No. | Compound of types 1 to 4 ($\times 10^{-6}$ mol/Ag-mol) | Before the addition of sensitizing dye ($\times 10^{-6}$ mol/Ag-mol) | After the addition of Compounds 13 and 14 ($\times 10^{-3}$ mol/Ag-mol) |
| Q | — | — | — |
| QP1 | Exemplified compound 9 (7.5) | — | — |
| QP2 | Exemplified compound 41 (3.5) | — | — |
| QRP1 | Exemplified compound 9 (7.5) | $B_6$-6 (3) | — |
| QRP2 | Exemplified compound 41 (3.5) | $B_6$-6 (3) | — |
| QRP3 | Exemplified compound 9 (7.5) | $B_3$-12 (2) | — |
| QRP4 | Exemplified compound 41 (3.5) | $B_3$-12 (2) | — |
| QRP5 | Exemplified compound 9 (7.5) | — | $B_{11}$-11 (1) |
| QRP6 | Exemplified compound 41 (3.5) | — | $B_{11}$-11 (1) |
| QRP7 | Exemplified compound 9 (7.5) | — | $B_{10}$-1 (3) |
| QRP8 | Exemplified compound 41 (3.5) | — | $B_{10}$-1 (3) |
| QRP9 | Exemplified compound 9 (7.5) | $B_1$-10 (1) | $B_2$-5 (3) |
| QRP10 | Exemplified compound 41 (3.5) | $B_1$-10 (1) | $B_2$-5 (3) |

Samples 201 to 219 were prepared by coating each of the above emulsions Em-Q, Em-QP1, Em-QP2, and Em-QRP1 to Em-QRP10 in the same method as in Example 1 (the reducing compounds of the present invention to be (additionally) added to the emulsions are shown in Table 4).

The samples were subjected to hardening for 14 hours under the conditions of 40° C. and 70% RH. Thereafter, they were subjected to exposure of 1/100 sec through a gelatin filter SC-50 (a long-wavelength light transmission filter whose cut-off wavelength is 500 nm) manufactured by Fuji Photo Film Co., Ltd. and a continuous wedge, and to the same development as in Example 1. The density of each of the developed samples was measured by a green filter to evaluate the fresh photographic performance. Further, another set of the same samples was subjected to the same film hardening, and kept for three days under the conditions of 50° C. and 80% RH. Then the samples were exposed to light and processed in the same manner to obtain raw stock storability.

Table 4 below shows results of measurement of the photographic properties of the samples. The speed of each sample was indicated by a relative value of a logarithm of a reciprocal of an exposure amount necessary for reaching the density of the fog density plus 0.2. (Sample 201 was regarded as a control: 100).

TABLE 4

Photographic performance of Samples 201 to 219

| Sample | Used emulsion | Reducing compound ($\times 10^{-2}$/Ag) | Photographic performance with green filter: Relative speed | Photographic performance with green filter: Fog | Photographic performance after storage under heat: Relative speed | Photographic performance after storage under heat: Fog after storage under heat | Remarks |
|---|---|---|---|---|---|---|---|
| 201 | Q | — | 100 (control) | 0.21 | 98 | 0.23 | Comp. |
| 202 | QP1 | — | 113 | 0.35 | 98 | 0.45 | Comp. |
| 203 | QP2 | — | 115 | 0.36 | 99 | 0.44 | Comp. |
| 204 | QRP1 | — | 122 | 0.26 | 119 | 0.31 | Inv. |
| 205 | QRP2 | — | 123 | 0.27 | 119 | 0.32 | Inv. |
| 206 | QRP3 | — | 123 | 0.26 | 120 | 0.31 | Inv. |
| 207 | QRP4 | — | 122 | 0.25 | 121 | 0.33 | Inv. |
| 208 | QRP5 | — | 124 | 0.25 | 121 | 0.32 | Inv. |
| 209 | QRP6 | — | 123 | 0.26 | 119 | 0.33 | Inv. |
| 210 | QRP7 | — | 125 | 0.25 | 120 | 0.31 | Inv. |
| 211 | QRP8 | — | 124 | 0.26 | 119 | 0.32 | Inv. |
| 212 | QRP9 | — | 128 | 0.23 | 123 | 0.29 | Inv. |
| 213 | QRP10 | — | 127 | 0.24 | 122 | 0.28 | Inv. |
| 214 | QP1 | $B_1$-3 (0.8) | 125 | 0.24 | 118 | 0.30 | Inv. |
| 215 | QP2 | $B_1$-3 (0.8) | 125 | 0.25 | 119 | 0.31 | Inv. |
| 216 | QP1 | $B_{10}$-2 (1.0) | 123 | 0.26 | 117 | 0.33 | Inv. |
| 217 | QP2 | $B_{10}$-2 (1.0) | 122 | 0.26 | 118 | 0.32 | Inv. |
| 218 | QRP7 | $B_2$-2 (1.2) | 135 | 0.22 | 129 | 0.25 | Inv. |
| 219 | QRP8 | $B_2$-2 (1.2) | 133 | 0.23 | 128 | 0.26 | Inv. |

Table 4 shows that a combined use of at least one of the reducing compounds of the present invention, with compound 9 or 41, which is a compound represented by types (1) to (4) of the present invention, reduces the density of unexposed region (fog) as one of the fresh photographic property, and enlarges the speed enhancing effect.

Further, it also shows that, also in the case of keeping the samples under the conditions of 50° C. and 80% RH for three days, the combined use of the reducing compounds of the present invention with a compound represented by types (1) to (4) of the present invention reduces the speed decrement after the raw stock storage, and attains low fog.

In addition, a combined use of plural kinds of the reducing compounds of the present invention with a compound represented by types (1) to (4) of the present invention further improves the unexposed part density (fog) as one of the fresh photographic property, and reduces deterioration of fog after raw stock storage.

Example 3

(Em-A; Emulsion for High-Speed Blue-Sensitive Layer) The same emulsion as prepared in Example 1.

(Em-B; Emulsion for Low-Speed Blue-Sensitive Layer)

1,192 mL of an aqueous solution containing 0.96 g of low-molecular weight gelatin and 0.9 g of KBr were vigorously stirred at 40° C. 37.5 mL of an aqueous solution containing 1.49 g of $AgNO_3$ and 37.5 mL of an aqueous solution containing 1.5 g of KBr were added over 30 sec by the double jet method. After 1.2 g of KBr were added, the temperature was raised to 75° C. to ripen the material. After the ripening, 30 g of trimellitated gelatin whose amino groups were chemically modified with trimellitic acid and whose molecular weight was 100,000 were added, and the pH was adjusted to 7.6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the silver potential was maintained at −20 mV against a saturated calomel electrode. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of Em-A was simultaneously added at an accelerated flow rate so that the silver iodide content was 15.8 mol %. At the same time, the silver potential was maintained at 0 mV against the saturated calomel electrode. 96.5 mL of an aqueous solution containing 24.1 g of $AgNO_3$ and an aqueous KBr solution were added over 3 min by the double jet method. During the addition, the silver potential was maintained at 0 mV. After 26 mg of sodium ethylthiosulfonate were added, the temperature was lowered to 55° C., an aqueous KBr solution was added to adjust the silver potential to −90 mV. The aforementioned AgI fine grain emulsion was added in an amount of 8.5 g in terms of a KI weight. Immediately after the addition, 228 mL of an aqueous solution containing 57 g of $AgNO_3$ were added over 5 min. At this time, an aqueous KBr solution was used to adjust the silver potential at the completion of the addition to +20 mV. The resultant emulsion was washed with water and chemically sensitized in almost the same manner as for Em-A.

(Em-C; Emulsion for Low-Speed Blue-Sensitive Layer).

1,192 mL of an aqueous solution containing 1.02 g of a phthalated gelatin containing 35 μmol of methionine per g thereof and having a molecular weight of 100,000, and having a phthalation ratio of 97%, and 0.97 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 66° C. to fully ripen the material. After the completion of the ripening, 41.2 g of trimellitated gelatin used in the preparation of Em-B whose molecular weight was 100,000 and 18.5 g of NaCl were added. After the pH was adjusted to 7.2, 8 mg of dimethylamineborane was added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the silver potential was maintained at −30 mV against saturated calomel electrode. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of Em-A was simultaneously added at an accelerated flow rate so that the silver iodide content was 2.3 mol %. At the same time, the silver potential was maintained at −20 mV against saturated calomel electrode. After the addition of 10.7 mL of 1N potassium thiocyanate, 153.5 mL of an aqueous solution containing 24.1 g of $AgNO_3$ and an aqueous KBr solution were added over 2 min and 30 sec by the double jet method. During the addition, the silver potential was maintained at 10 mV. An aqueous KBr solution was added to adjust the silver potential to −70 mV. The aforementioned AgI fine grain emulsion was added in an amount of 6.4 g in terms of a KI weight. Immediately after the addition, 404 mL of an aqueous solution containing 57 g of $AgNO_3$ were added over 45 min. At this time, an aqueous KBr solution was used to adjust the silver potential at the completion of the addition to −30 mV. The resultant emulsion was washed with water and chemically sensitized in almost the same manner as for Em-A.

(Em-D; Emulsion for Low-Speed Blue-Sensitive Layer)

In the preparation of Em-C, the addition amount of $AgNO_3$ during the nucleation was changed to 2.0 times, and the potential at the completion of the addition of the final 404 mL aqueous solution containing 57 g of $AgNO_3$ was changed to +90 mV by adjustment with a KBr aqueous solution. The other parts of preparation of Em-D were substantially the same as those of Em-C. (Em-E; Magenta-coloring layer having a spectral sensitivity peak in a range of 480–550 nm; layer for donating multilayer effect to a red-sensitive layer) 1,200 mL of an aqueous solution containing 0.71 g of low-molecular weight gelatin having a molecular weight of 15,000, 0.92 g of KBr and 0.2 g of modified silicon oil used in the preparation of Em-A were held at 39° C. and stirred with violence at pH 1.8. An aqueous solution containing 0.45 g of $AgNO_3$ and an aqueous KBr solution containing 1.5 mol % of KI were added over 17 sec by the double jet method. During the addition, the excess KBr concentration was held constant. The temperature was raised to 56° C. to ripen the material. After the ripening, 20 g of phthalated gelatin containing 35 μmol of methionine per g thereof and having a molecular weight of 100,000, and having a phthalation ratio of 97% was added. After the pH was adjusted to 5.9, 2.9 g of KBr were added. 288 mL of an aqueous solution containing 28.8 g of $AgNO_3$ and an aqueous KBr solution were added over 53 min by the double jet method. During the addition, an AgI fine grain emulsion used in the preparation of Em-A was simultaneously added such that the silver iodide content was 4.1 mol %. At the same time, the silver potential was maintained at −60 mV against a saturated calomel electrode. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the silver potential was maintained at −70 mV. After adding 1 mg of thiourea dioxide, 132 mL of an aqueous solution containing 41.8 g of $AgNO_3$ and an aqueous KBr solution were added over 25 min by the double jet method. The addition of the aqueous KBr solution was so adjusted that the silver potential at the completion of the addition was +20 mV. After the addition of 2 mg of sodium benzenethiosulfonate, the pH was adjusted to 7.3. After KBr was added to adjust the silver potential at −70 mV, the aforementioned AgI fine grain emulsion was added in an amount of 5.73 g in terms of a KI weight. Immediately after the addition, 609 mL of an aqueous solution containing 66.4 g of $AgNO_3$ were added over 10 min. For the first 6 min of the addition, the silver potential was maintained at −70 mV by an aqueous KBr solution. After washing with water, gelatin was added, and the pH and the pAg were adjusted to 6.5 and 8.2, respectively. Compounds 11 and 12 were added, and then the temperature was raised to 56° C. The abovementioned AgI fine grain emulsion was added in an amount of 0.0004 mol per mol of silver. Then, sensitizing dyes 13 and 14 were added. Potassium thiocyanate, chlorauric acid, sodium thiosulfate, N,N-dimethylselenourea were added to optimally perform chemical sensitization. Compounds 13 and 14 were added at the completion of the chemical sensitization.

Compound 11

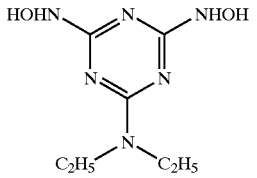

Compound 12

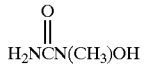

Sensitizing dye 13

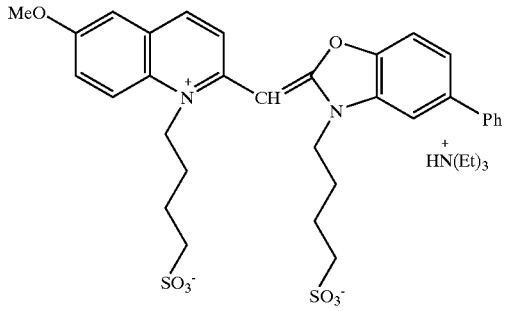

Sensitizing dye 14

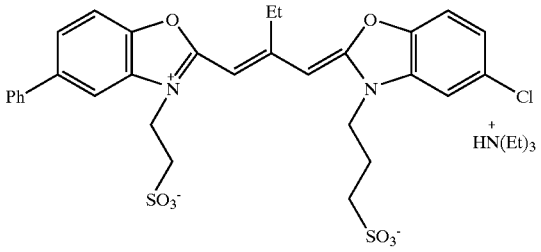

(Em-F; Emulsion for Medium-Speed Green-Sensitive Layer)

Emulsion Em-F was prepared in almost the same manner as in Em-E, except that the addition amount of $AgNO_3$ during the nucleation was changed to 3.1 times. In addition, sensitizing dyes in Em-E were changed to sensitizing dyes 15, 16 and 17.

Sensitizing dye 15

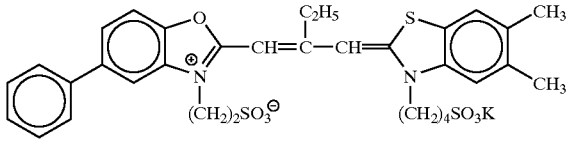

Sensitizing dye 16

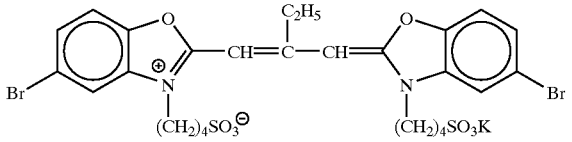

-continued

Sensitizing dye 17

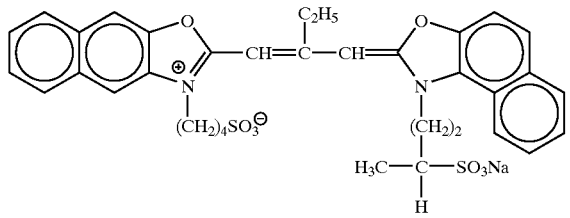

(Em-G; Emulsion for Low-Speed Green-Sensitive Layer)

1,200 mL of an aqueous solution containing 0.70 g of low-molecular weight gelatin having a molecular weight of 15,000, 0.9 g of KBr, 0.175 g of KI and 0.2 g of modified silicon oil used in the preparation of Em-A were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 69° C. to ripen the material. After the ripening, 27.8 g of trimellitated gelatin obtained by chemically modifying amino groups with trimellitic acid, containing 35 μmol of methionine per g thereof and having a molecular weight of 100,000 was added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion was simultaneously added such that the silver iodide content was 4.1 mol %, and the silver potential was maintained at −60 mV against a saturated calomel electrode. The AgI fine grain emulsion was prepared immediately before the addition thereof, by mixing an aqueous solution of a low-molecular weight gelatin having a molecular weight of 15000, an $AgNO_3$ aqueous solution and a KI aqueous solution in a separate chamber provided with a magnetic coupling induction type stirrer described in JP-A-10-43570, and has a grain size of 0.008 μm. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, above-mentioned AgI fine grain emulsion that was prepared by mixing immediately before the addition thereof was simultaneously added such that the silver iodide content was 7.9 mol %. At the same time, the silver potential was maintained at −70 mV. After adding 1 mg of thiourea dioxide, 132 mL of an aqueous solution containing 41.8 g of $AgNO_3$ and an aqueous KBr solution were added over 20 min by the double jet method. The addition of the aqueous KBr solution was so adjusted that the silver potential at the completion of the addition was +20 mV. After the temperature was raised to 78° C., the pH was adjusted to 9.1. After KBr was added to adjust the silver potential at −60 mV, the AgI fine grain emulsion used in the preparation of Em-A was added in an amount of 5.73 g in terms of a KI weight. Immediately after the addition, 321 mL of an aqueous solution containing 66.4 g of $AgNO_3$ were added over 4 min. For the first 2 min of the addition, the silver potential was maintained at −60 mV by an aqueous KBr solution. The emulsion was washed with water and chemically sensitized in almost the same manner as in Em-F.

(Em-H; Emulsion for Low-Speed Green-Sensitive Layer)

An aqueous solution containing 17.8 g of ion-exchanged gelatin having a molecular weight of 100,000, 6.2 g of KBr and 0.46 g of KI was vigorously stirred while maintaining the temperature thereof at 45° C. An aqueous solution containing 11.85 g of $AgNO_3$ and an aqueous solution containing 3.8 g of KBr were added by the double jet method over 47 sec. After the temperature was raised to 63° C., 24.1 g of ion-exchanged gelatin having a molecular weight of 100,000 was added to ripen the material. After the full ripening, an aqueous solution containing 133.4 g of $AgNO_3$ and an aqueous KBr solution were added by the double jet method over 20 min so that the final flow rate becomes 2.6 times the initial flow rate. During the addition, the silver potential was maintained at +40 mV against a saturated calomel electrode. Also, 10 min after the initiation of the addition, 0.1 mg of $K_2IrCl_6$ was added. After 7 g of NaCl was added, an aqueous solution containing 45.6 g of $AgNO_3$ and an aqueous KBr solution were added over 12 min by the double jet method. At the same time, the silver potential was maintained at +90 mV. Also, 100 mL of an aqueous solution containing 29 mg of yellow prussiate was added over 6 min from the initiation of the addition. After 14.4 g of KBr was added, the AgI fine grain emulsion that was used in the preparation of Em-A was added in an amount of 6.3 g in terms of a KI weight. Immediately after the addition, an aqueous solution containing 42.7 g of $AgNO_3$ and a KBr solution were added by the double jet method over 11 min. At this time, the silver potential was maintained at +90 mV. The resultant emulsion was washed with water and chemically sensitized in almost the same manner as for Em-F.

(Em-I; Emulsion for Low-Speed Green-Sensitive Layer)

Emulsion Em-I was prepared in almost the same manner as in Em-H, except that the temperature at nucleation was changed to 38° C.

(Em-J1; Emulsion for High-Speed Red-Sensitive Layer)

1,200 mL of an aqueous solution containing 0.38 g of phthalated gelatin having a molecular weight of 100,000 and phthalation ratio of 97%, and 0.99 g of KBr was vigorously stirred at 60° C., while adjusting the pH thereof at 2. An aqueous solution containing 1.96 g of $AgNO_3$, an aqueous solution containing 1.97 g of KBr, and 0.172 g of KI were added over 30 sec by the double jet method. After the completion of the ripening, 12.8 g of trimellitated gelatin whose amino groups were chemically modified with trimellitic acid, containing 35 $\mu$mol of methionine per g thereof and having a molecular weight of 100,000 was added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 35 min by the double jet method. During the addition, the silver potential was maintained at −50 mV against a saturated calomel electrode. An aqueous solution containing 65.6 g of $AgNO_3$ and an aqueous KBr solution were added over 37 min by the double jet method while the flow rate was accelerated so that the final flow rate was 2.1 times the initial flow rate. During the addition, the AgI fine grain emulsion that was used in the preparation of Em-A was simultaneously added with an accelerated flow rate such that the silver iodide content was 6.5 mol %. At the same time, the silver potential was maintained at −50 mV. After adding 1.5 mg of thiourea dioxide, 132 mL of an aqueous solution containing 41.8 g of $AgNO_3$ and an aqueous KBr solution were added over 13 min by the double jet method. The addition of the aqueous KBr solution was so adjusted that the silver potential at the completion of the addition was +40 mV. After 2 mg of sodium benzenethiosulfonate was added, KBr was added to adjust the silver potential at −100 mV. The above-mentioned AgI fine grain emulsion was added in an amount of 6.2 g in terms of a KI weight. Immediately after the addition, 300 mL of an aqueous solution containing 88.5 g of $AgNO_3$ were added over 8 min. A KBr solution was added so that the potential at the completion of the addition was adjusted to +60 mV. After washing with water, gelatin was added, and pH and pAg were adjusted to 6.5 and 8.2, respectively at 40° C. After compounds 11 and 12 were added, the temperature was raised to 61° C. After sensitizing dyes 18, 19, 20, 21 and 22 were added, $K_2IrCl_6$, potassium thiocyanate, chlorauric acid, sodium thiosulfate, and N,N-dimethylselenourea were added to optimally perform chemical sensitization. Compounds 13 and 14 were added at the completion of the chemical sensitization.

Sensitizingy dye 18

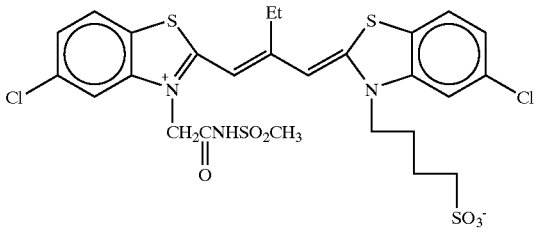

Sensitizingy dye 19

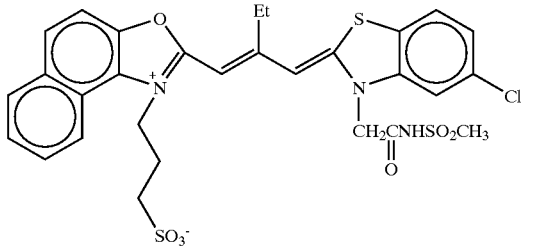

Sensitizingy dye 20

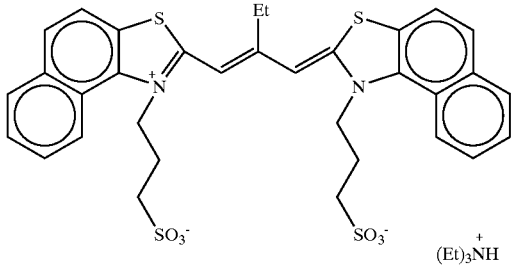

Sensitizingy dye 21

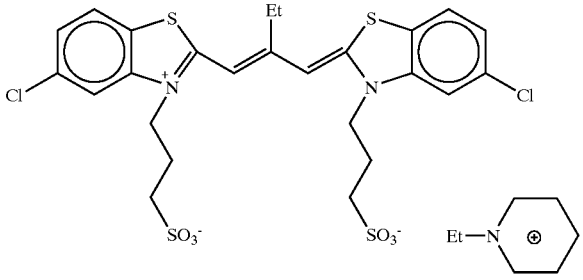

-continued

Sensitizingy dye 22

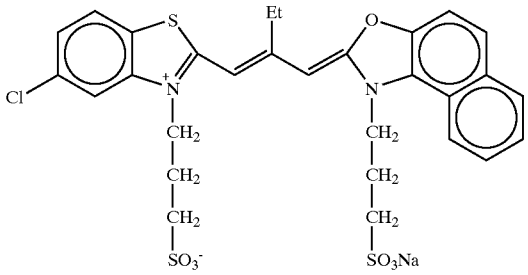

(Em-K; Emulsion for amedium-speed red-sensitive layer)

1,200 mL of an aqueous solution containing 4.9 g of low-molecular weight gelatin having a molecular weight of 15,000, and 5.3 g of KBr was held at 60° C. and vigorously stirred. 27 mL of an aqueous solution containing 8.75 g of $AgNO_3$ and 36 mL of an aqueous solution containing 6.45 g of KBr were added over 1 min by the double jet method. After the temperature was raised to 77° C., 21 mL of an aqueous solution containing 6.9 g of $AgNO_3$ was added over 2.5 min. 26 g of $NH_4NO_3$, 56 mL of 1N NaOH were added subsequently, and then ripened. After the completion of the ripening, pH was adjusted to 4.8. 438 mL of an aqueous solution containing 141 g of $AgNO_3$ and 458 mL of an aqueous solution containing 102.6 g of KBr were added by the double jet method while the flow rate was accelerated so that the final flow rate was 4 times the initial flow rate. After the temperature was lowered to 55° C., 240 mL of an aqueous solution containing 7.1 g of $AgNO_3$ and an aqueous solution containing 6.46 g of KI were added by the double jet method over 5 min. After 7.1 g of KBr was added, 4 mg of sodium benzenethiosulfonate and 0.05 mg of $K_2KrCl_6$ were added. 177 mL of an aqueous solution containing 57.2 g of $AgNO_3$ and 223 mL of an aqueous solution containing 40.2 g of KBr were added over 8 min by the double jet method. Washing and chemical sensitization were performed in almost the same manner as in Em-J1.

(Em-L; Emulsion for a Medium-Speed Red-Sensitive Layer)

Emulsion Em-L was prepared in almost the same manner as in Em-K, except that the temperature during the nucleation was changed to 42° C.

(Em-M, Em-N and Em-O; Emulsions for Low-Speed Red-Sensitive Layer)

Em-M, Em-N and Em-O were prepared in almost the same manner as in Em-H or Em-I, except that the chemical sensitization was performed in almost the same manner as in Em-J1.

(Em-P1; Emulsion for High-Speed Green-Sensitive Layer)

Em-P1 was prepared in the same manner as in Em-J1, except that the spectral sensitizing dyes were changed to sensitizing dyes 15, 16 and 17, thereby performing an optimal chemical sensitization.

The characteristics of the thus obtained silver halide emulsions Em-A to Em-ARP12, Em-B to Em-P1 and Em-Q to Em-QRP10 are shown in Table 5.

TABLE 5

Grain characteristics of silver halide emulsions Em-A to Em-QRP10

| Emulsion No. | Equivalent sphere diameter μm | Projected area diameter μm | Aspect ratio | Iodide content mol % | Index of main plane | Cl content mol % |
|---|---|---|---|---|---|---|
| Em-A to Em-ARP12 | 1.7 | 3.15 | 9.5 | 6.1 | (111) | 0 |
| Em-B | 1.0 | 2.0 | 12.2 | 10.0 | (111) | 0 |
| Em-C | 0.7 | — | 1 | 4.0 | (111) | 1.0 |
| Em-D | 0.4 | 0.53 | 3.5 | 4.1 | (111) | 2.0 |
| Em-E | 1.1 | 2.63 | 20.6 | 6.7 | (111) | 0 |
| Em-F | 1.2 | 2.74 | 18 | 6.9 | (111) | 0 |
| Em-G | 0.9 | 1.98 | 15.9 | 6.1 | (111) | 0 |
| Em-H | 0.7 | 1.22 | 8 | 6.0 | (111) | 2.0 |
| Em-I | 0.4 | 0.63 | 6 | 6.0 | (111) | 2.0 |
| Em-J1 | 1.3 | 3.18 | 22 | 3.5 | (111) | 0 |
| Em-K | 1.0 | 2.37 | 20 | 4.0 | (111) | 0 |
| Em-L | 0.8 | 1.86 | 19 | 3.6 | (111) | 0 |
| Em-M | 0.6 | 1.09 | 8.9 | 2.9 | (111) | 2.0 |
| Em-N | 0.4 | 0.63 | 6 | 2.0 | (111) | 2.0 |
| Em-O | 0.3 | 0.38 | 3 | 1.0 | (111) | 2.0 |
| Em-P1 | 1.3 | 3.18 | 22 | 3.5 | (111) | 0 |
| Em-Q to Em-QRP10 | 1.3 | 3.18 | 22 | 3.5 | (111) | 0 |

Further, the following is an outline of preparation prescription of the emulsion of the present invention.

A solution made by dissolving a coupler in ethyl acetate, a high-boiling organic solvent, and a surfactant are added to a 10% gelatin solution and mixed. The mixture is emulsified by using a homoginizer (Nippon Seiki) to obtain an emulsion.

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 pm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/$m^2$, by using a bar coater) consisting of 0.1 g/$m^2$ of gelatin, 0.01 g/$m^2$ of sodium a-sulfodi-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/$m^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Lightsensitive Layer

Next, on the opposite side of the support of the back layer obtained by the above, layers of the following compositions were coated in a superposed manner to prepare a color negative photosensitive material of Sample 301. Samples 302–313 were prepared by replacing Em-A described in Example 1 and used in the 14th layer of Sample 301 with Em-AP1 to Em-AP4 and Em-ARP1, Em-ARP2, Em-ARP9 and Em-ARP10, and the reducing compound $B_2$-2 or $B_8$-10 of the present invention was additionally added to the 14th layer (the added reducing compound and addition amount are shown in Table 6).

(Composition of Lightsensitive Layers)

| Main materials used for the layers are classified into the following: | |
|---|---|
| ExC: cyan coupler | UV: ultraviolet absorbent |
| ExM: magenta coupler | HBS: high-boiling organic solvent |
| ExY: yellow coupler | H: gelatin hardener |

(Specific compounds are shown in the following description. Numerical values are described after the symbols, and their chemical formulae are shown thereafter.)

The figures corresponding to respective components indicate coating amounts in terms of g/m$^2$. With respect to silver halide, the figures indicate a coating amount in terms of silver.

| | | |
|---|---|---|
| 1st layer (First antihalation layer) | | |
| Black colloidal silver | silver | 0.155 |
| Surface-fogged AgBrI (2) of 0.07 μm | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (Second antihalation layer) | | |
| Black colloidal silver | silver | 0.066 |
| Gelatin | | 0.407 |
| ExM-1 | | 0.050 |
| ExF-1 | | 2.0 × 10$^{-3}$ |
| HBS-1 | | 0.074 |
| Solid disperse dye ExF-2 | | 0.015 |
| Solid disperse dye ExF-3 | | 0.020 |
| 3rd layer (Intermediate layer) | | |
| AgBrI (2) of 0.07 μm | | 0.020 |
| ExC-2 | | 0.022 |
| HBS-1 | | 0.068 |
| Cpd-1 | | 0.075 |
| Polyethylacrylate latex | | 0.085 |
| Gelatin | | 0.294 |
| 4th layer (Low-speed red-sensitive emulsion layer) | | |
| Em-M | silver | 0.065 |
| Em-N | silver | 0.100 |
| Em-O | silver | 0.158 |
| ExC-1 | | 0.109 |
| ExC-3 | | 0.044 |
| ExC-4 | | 0.072 |
| ExC-5 | | 0.011 |
| ExC-6 | | 0.003 |
| ExC-8 | | 0.052 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Em-K | silver | 0.21 |
| Em-L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| ExC-8 | | 0.007 |

-continued

| | | |
|---|---|---|
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Em-J1 | silver | 1.67 |
| ExC-1 | | 0.18 |
| ExC-3 | | 0.07 |
| ExC-6 | | 0.047 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Intermediate layer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (Interlayer effect-donating layer (layer for donating interlayer effect to red-sensitive Layer)) | | |
| Em-E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Em-G | silver | 0.39 |
| Em-H | silver | 0.28 |
| Em-I | silver | 0.35 |
| ExM-2 | | 0.36 |
| ExM-3 | | 0.045 |
| ExC-9 | | 0.008 |
| ExG-1 | | 0.005 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Em-F | silver | 0.20 |
| Em-G | silver | 0.25 |
| ExC-6 | | 0.005 |
| ExC-9 | | 0.004 |
| ExC-8 | | 0.005 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Em-P1 | silver | 1.200 |
| ExC-6 | | 0.003 |
| ExC-9 | | 0.002 |
| ExC-8 | | 0.007 |
| ExM-1 | | 0.016 |
| ExM-3 | | 0.036 |
| ExM-4 | | 0.020 |
| ExM-5 | | 0.004 |
| ExY-5 | | 0.008 |
| ExM-2 | | 0.013 |
| Cpd-4 | | 0.007 |
| HBS-1 | | 0.18 |

-continued

| | | |
|---|---|---|
| Polyethylacrylate latex | | 0.099 |
| Gelatin | | 1.11 |
| 12th layer (Yellow filter layer) | | |
| Yellow colloidal silver | silver | 0.047 |
| Cpd-1 | | 0.16 |
| Dye ExF-5 | | 0.010 |
| Solid disperse dye ExF-6 | | 0.010 |
| HBS-1 | | 0.082 |
| Gelatin | | 1.057 |
| 13th layer (Low-speed blue-sensitive emulsion layer) | | |
| Em-B | silver | 0.18 |
| Em-C | silver | 0.20 |
| Em-D | silver | 0.07 |
| ExC-1 | | 0.041 |
| ExC-7 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Em-A of Example 1 | silver | 0.75 |
| ExC-1 | | 0.013 |
| ExY-2 | | 0.31 |
| ExY-3 | | 0.05 |
| ExY-6 | | 0.062 |
| Exemplified Compounds $B_2$-2 or $B_8$-10 (The compound used and addition amount thereof are shown in Table 6) | | |
| HBS-1 | | 0.10 |
| Gelatin | | 0.91 |
| 15th layer (First protective layer) | | |
| AgBrI (2) of 0.07 μm | silver | 0.30 |
| UV-1 | | 0.21 |
| UV-2 | | 0.10 |
| UV-3 | | 0.18 |
| UV-4 | | 0.025 |
| UV-5 | | 0.07 |
| F-18 | | 0.009 |
| F-19 | | 0.005 |
| F-20 | | 0.005 |
| HBS-1 | | 0.12 |
| HBS-4 | | $5.0 \times 10^{-2}$ |
| Gelatin | | 2.3 |
| 16th layer (Second protective layer) | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, the individual layers contained B-4 to B-6, F-1 to F-18, iron salt, lead salt, gold salt, platinum salt, palladium salt, iridium salt, ruthenium salt and rhodium salt. Also in the coating liquids for the 8th and the 11th layers, $8.5\times10^{-3}$ g and $7.9\times10^{-3}$ g, respectively, per mol of silver halide of calcium was added in the form of calcium nitrate aqueous solution, thereby preparing samples. In addition, at least one of W-1, -6, -7 and -8 was added in order to improve anti-electron static property, and at least one of W-2 and -5 was added in order to improve coating property. Preparation of dispersions of organic solid disperse dyes ExF-3 was dispersed by the following method. That is, 21.7 mL of water, 3 mL of a 5% aqueous solution of p-octylphenoxyethoxyethoxyethanesulfonate soda, and 0.5 g of a 5% aqueous solution of p-octylphenoxypolyoxyethyleneether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 $\mu$m.

Following the same procedure as above, solid dispersions ExF-4 was obtained. The average grain sizes of these fine dye grains was 0.45 $\mu$m. ExF-2 was dispersed by a micro-precipitation dispersion method described in Example 1 of EP549,489A. The average grain size was found to be 0.06 $\mu$m.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1
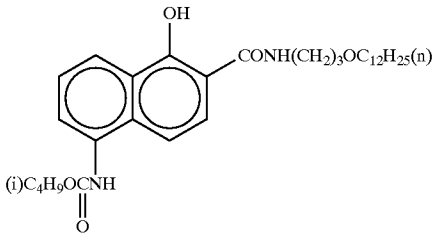
ExC-2
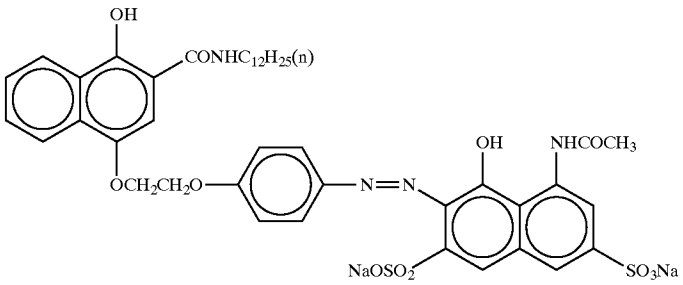
ExC-3
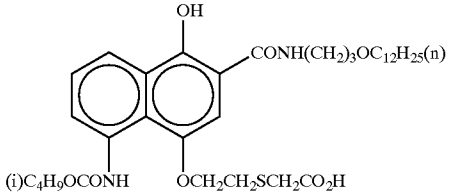
ExC-4
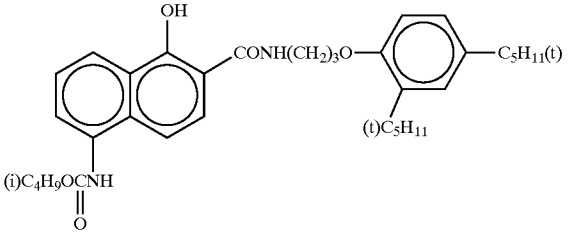

-continued
ExC-5
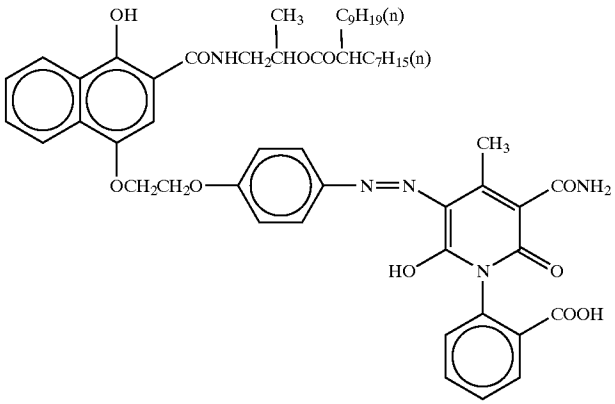
ExC-6
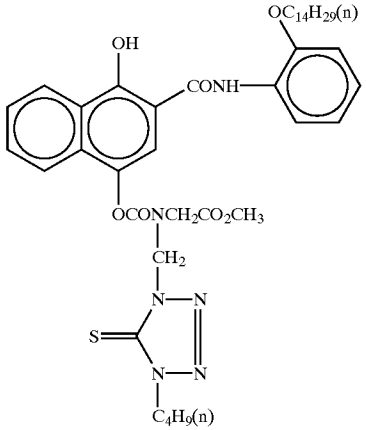
ExC-9
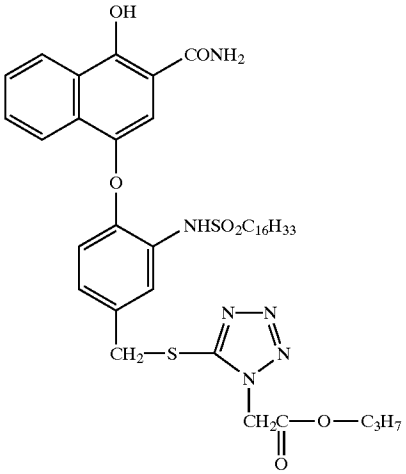

-continued
ExC-8
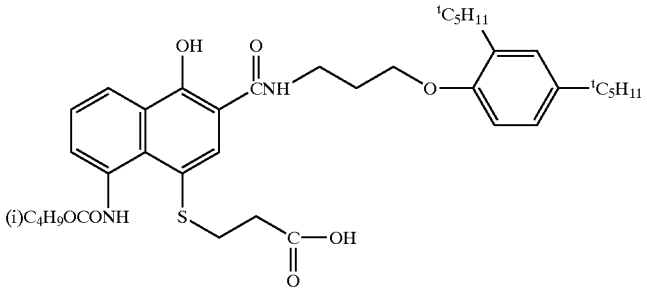
ExC-7
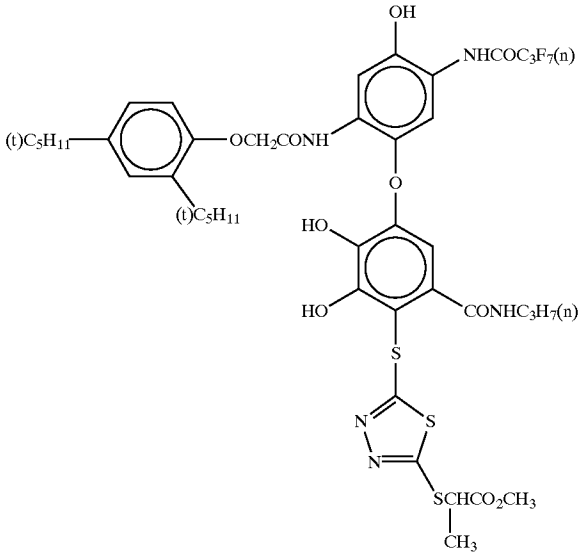

-continued
ExM-1
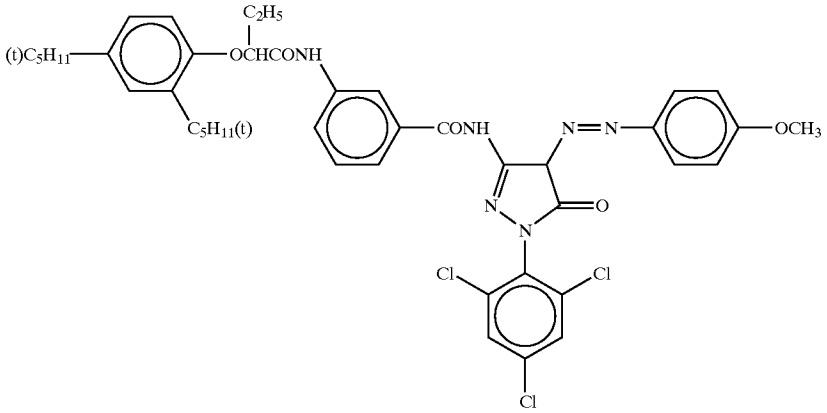
ExM-2
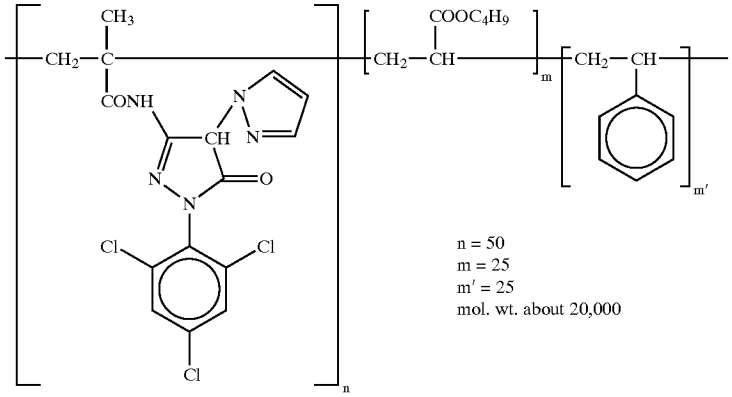

-continued
ExM-3
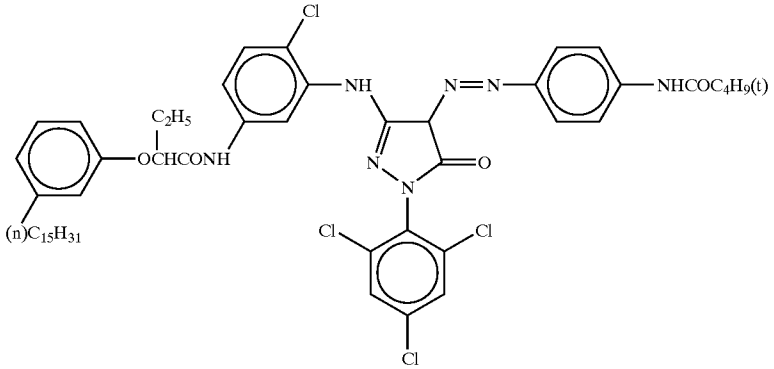
ExM-4
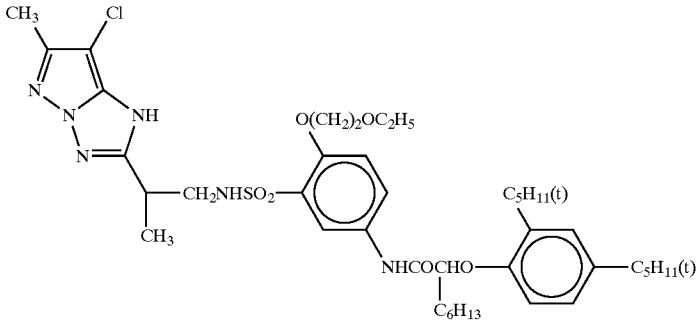
ExM-5
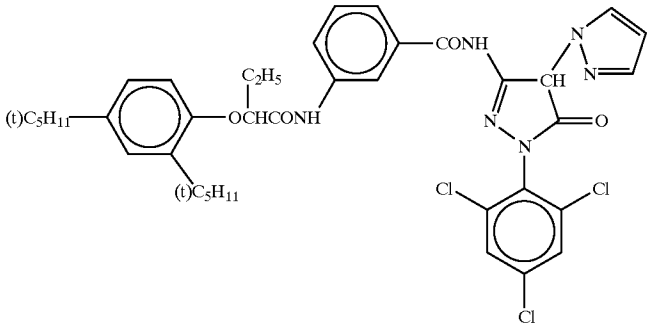

-continued
ExY-1
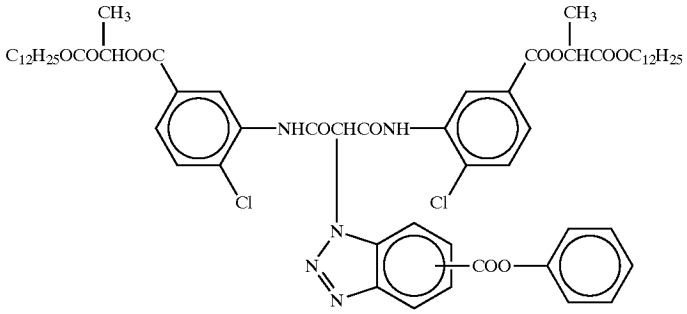
ExY-2
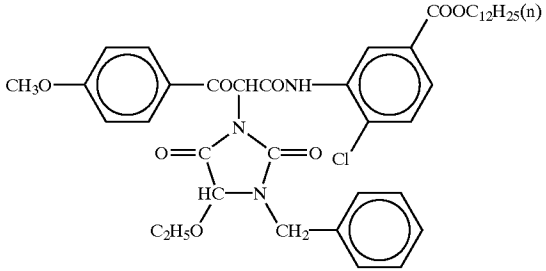
ExY-3
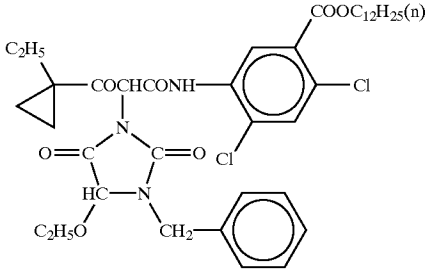
ExY-4
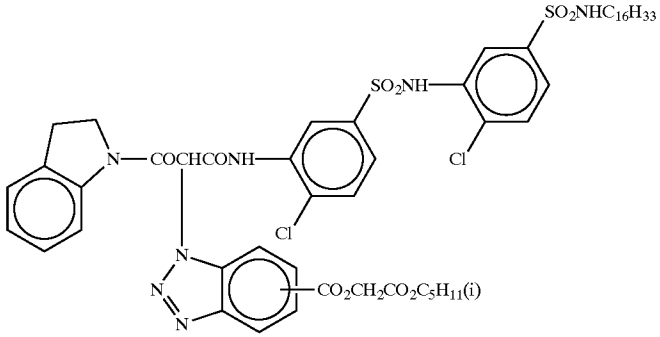

-continued
ExY-5
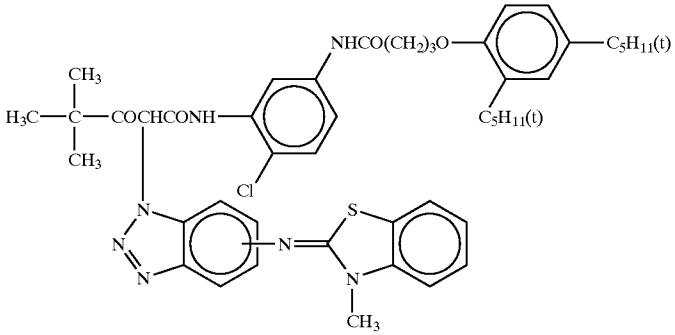
ExG-1
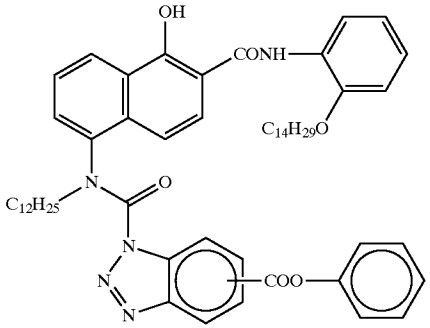
ExY-6
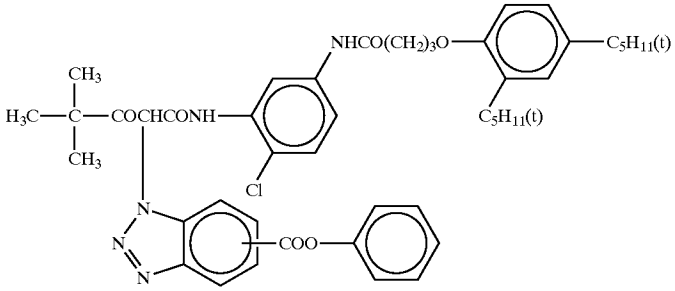

-continued
ExF-1
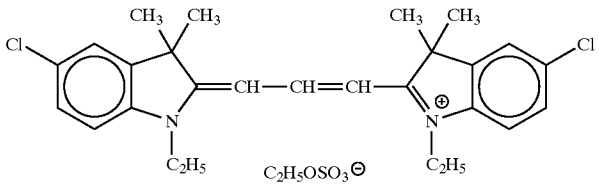
ExF-2
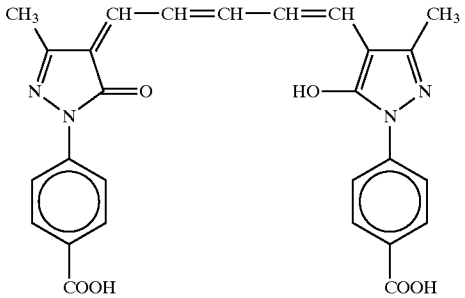
ExF-3
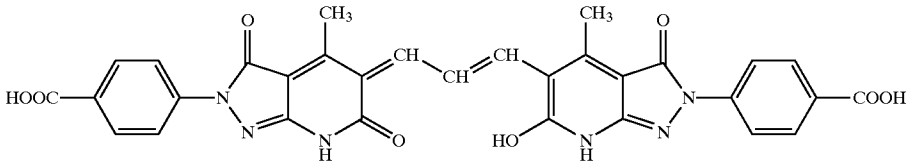
ExF-4
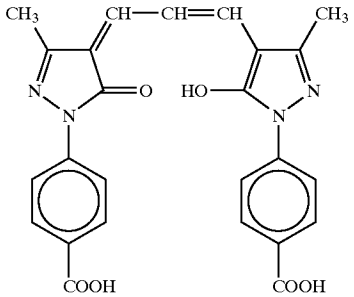

-continued
ExF-5
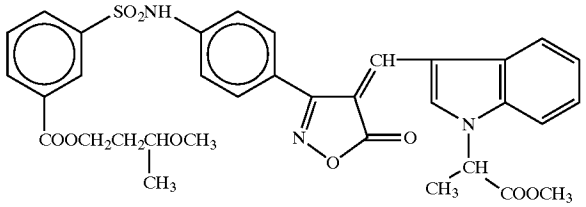
ExF-6
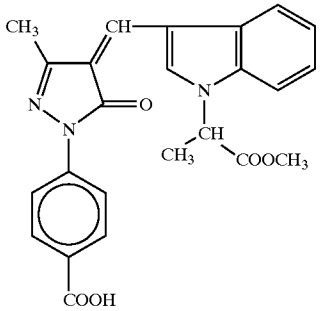
Cpd-1
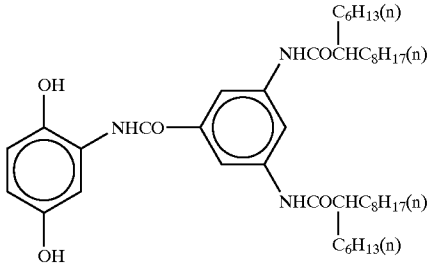
Cpd-2
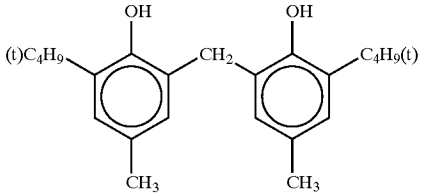
Cpd-3
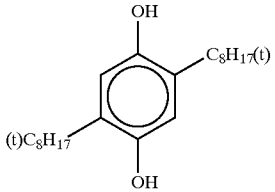
Cpd-4
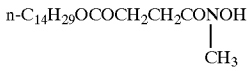
UV-1
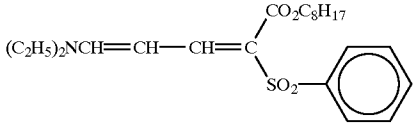
UV-2
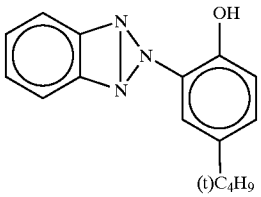
UV-3
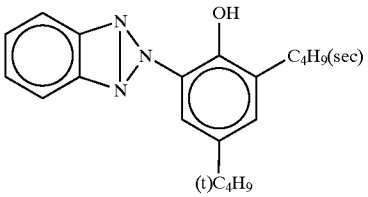

-continued
UV-4
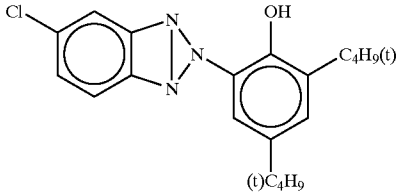
UV-5
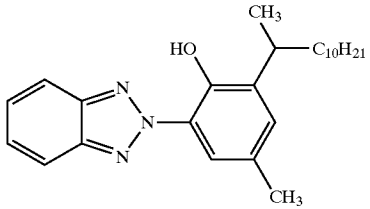
HBS-1
Tricresyl phosphate
HBS-2
Di-n-butyl phthalate
HBS-3
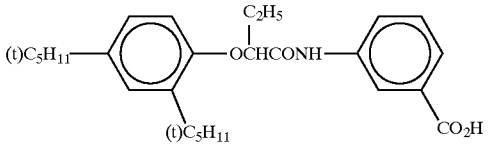
HBS-4
Tri(2-ethylhexyl)phosphate
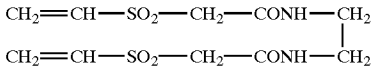
H-1
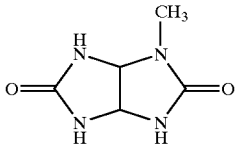
S-1
B-1
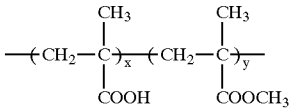
x/y = 10/90 (wt. ratio)
Av. mol. wt.: about 35,00
B-2
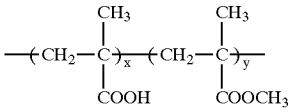
x/y = 40/60 (wt. ratio)
Av. mol. wt.: about 20,000
B-3
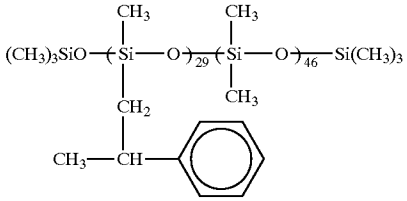
(molar ratio)
Av. mol. wt.: about 8,000
B-4
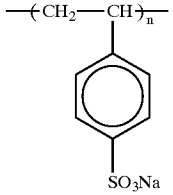
Av. mol. wt.: about 750,000

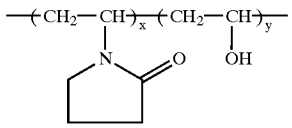
x/y = 70/30 (wt. ratio)
Av. mol. wt: about 17,000
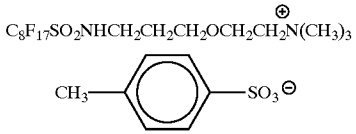
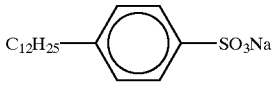
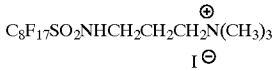
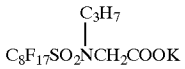
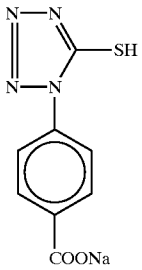
-continued
B-5
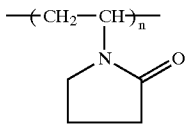
Av. mol. wt: about 10,000
B-6
W-1
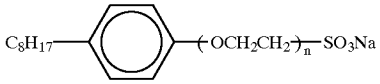
n = 2–4
W-2
W-4
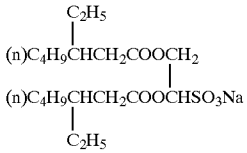
W-5
W-6
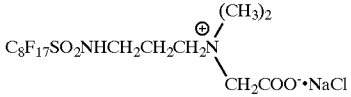
W-7
W-8
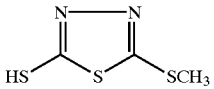
F-1
F-2
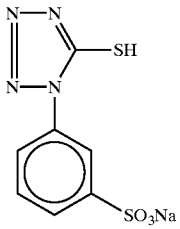
F-3

-continued
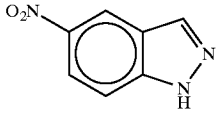
F-4
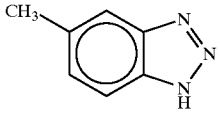
F-5
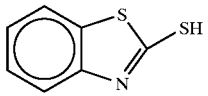
F-6
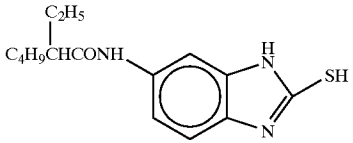
F-7
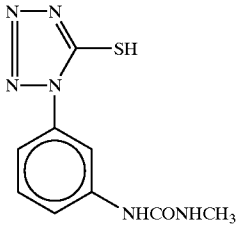
F-8
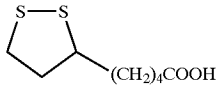
F-9
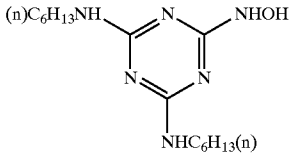
F-10
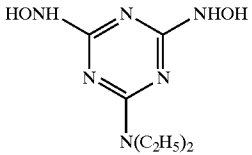
F-11
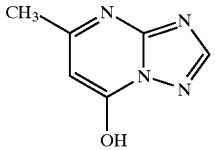
F-12
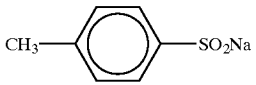
F-13
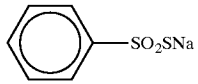
F-14
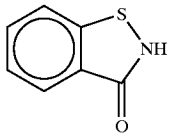
F-15

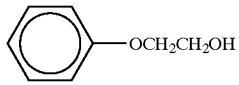
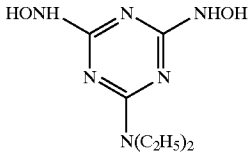
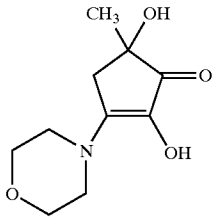
-continued
F-16
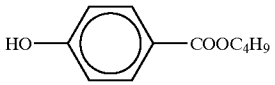
F-17
F-18
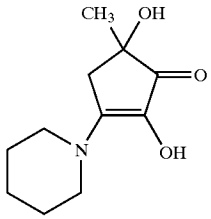
F-19
F-20

The evaluation method of the samples are as follows. These samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. Development was performed as follows by using an automatic developer FP-360B manufactured by Fuji Photo Film Co., Ltd. Note that FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing steps)

| Step | Time | Temperature | Replenishing rate* | Tank Volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. 1) The stabilizer and fixer were counter-flowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank Solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0L |
| pH (adjusted by potassium hydroxide and sulfuric acid) | 10.05 | 10.18 |
| (Bleaching Solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by aqueous ammonia) | 4.6 | 4.0 |

(Fixing (1) Tank Solution)

A 5:95 (volume ratio) mixture of the above bleaching tank solution and the following fixing tank solution (pH 6.8).

| (Fixer (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0L | 1.0 L |
| pH (adjusted by aqueous ammonia and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher (g) | |
|---|---|
| Sodium p-toluenesulfinate | 0.03 |
| Polyoxyethylene-p-monononylphenylether (average polymerization degree 10) | 0.2 |
| 1,2-benzoisothiazoline-3-one.sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

Each of the samples 301 to 313 was subjected to the aforementioned film hardening, exposure, and development processing to obtain fresh photographic property. Further, another set of the same samples after the same film hardening was kept under the conditions of 50° C. and 80% RH for three days, and subjected to the same exposure and development processing to obtain raw stock storability. The photographic performance of each sample was evaluated by measuring the density of each of the processed samples by a blue filter. The obtained results are shown in Table 6.

Further, the storability of each sample after being kept three days under the conditions of 50° C. and 80% RH was evaluated by measuring the density of each of the processed samples with a green filter. The obtained results are shown in Table 6. (Sample 301 was regarded as a control: 100.)

TABLE 6

Photographic performance of Samples 301 to 313

| Sample | Used emulsion | Reducing compound ($\times 10^{-2}$/Ag) | Photographic performance with blue filter: Relative speed | Photographic performance with blue filter: Fog | Photographic performance after storage under heat: Relative speed | Photographic performance after storage under heat: Fog after storage under heat | Remarks |
|---|---|---|---|---|---|---|---|
| 301 | A | — | 100 (control) | 0.23 | 97 | 0.26 | Comp. |
| 302 | AP1 | — | 117 | 0.36 | 101 | 0.44 | Comp. |
| 303 | AP2 | — | 116 | 0.37 | 100 | 0.45 | Comp. |
| 304 | ARP1 | — | 124 | 0.32 | 117 | 0.38 | Inv. |
| 305 | ARP2 | — | 125 | 0.32 | 116 | 0.39 | Inv. |
| 306 | ARP3 | — | 124 | 0.33 | 116 | 0.38 | Inv. |
| 307 | ARP4 | — | 123 | 0.34 | 115 | 0.38 | Inv. |
| 308 | ARP1 | $B_8$-10 (2.0) | 135 | 0.26 | 128 | 0.34 | Inv. |
| 309 | ARP2 | $B_8$-10 (2.0) | 136 | 0.26 | 127 | 0.33 | Inv. |
| 310 | ARP1 | $B_2$-2 (1.0) | 135 | 0.27 | 127 | 0.34 | Inv. |
| 311 | ARP2 | $B_2$-2 (1.0) | 134 | 0.28 | 125 | 0.35 | Inv. |
| 312 | ARP9 | $B_8$-10 (2.0) | 138 | 0.24 | 131 | 0.30 | Inv. |
| 313 | ARP10 | $B_8$-10 (2.0) | 137 | 0.24 | 130 | 0.29 | Inv. |

Table 6 shows that a combined use of at least one of the reducing compounds of the present invention, with compound 24 or 11, which is a compound represented by types (1) to (4) of the present invention reduces the density of unexposed region (fog) as one of the fresh photographic property, and enlarges the speed enhancing effect, also in a full-color silver halide photographic material.

Further, it also shows that, also in the case of keeping the samples under the conditions of 50° C. and 80% RH for three days, the combined use of the reducing compounds of the present invention with a compound represented by types (1) to (4) of the present invention reduces the speed decrement after the raw stock storage, and attains low fog.

In addition, a combined use of plural kinds of the reducing compounds of the present invention with a compound represented by types (1) to (4) of the present invention further improves the unexposed part density (fog) as one of the fresh photographic property, and reduces deterioration of fog after raw stock storage.

Example 4

Silver halide emulsions Em-R, Em-RP1, Em-RP2, and Em-RPR1 to Em-RPR8 were prepared by the following methods.

(Em-R)

Emulsion Em-R was prepared by changing the method of preparing the emulsion 1-G described in Example 1 of JP-A-2001-228572 as follows:

(1) to change the sensitizing dyes to sensitizing dyes 11 and 23; and (2) to use compound 15 and 1,3-dimethyl-1,3-dicarboxymethylthiourea instead of chloroauric acid and sodium thiosulfate, respectively, in the chemical sensitization.

Sensitizing dye 23

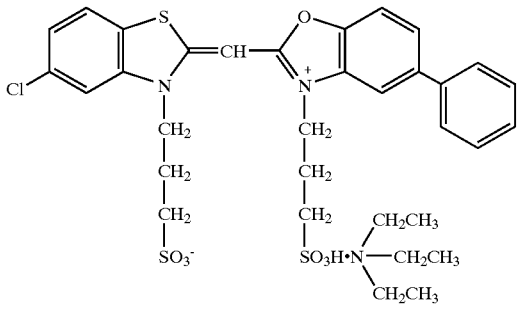

-continued

Compound 15

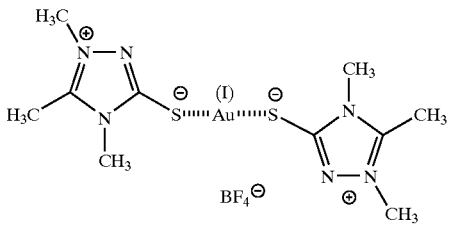

The emulsion Em-R contained tabular grains having an average equivalent circle diameter of 1.28 μm, average grain thickness of 0.088 μm, and average aspect ratio of 14.5, in the same manner as the emulsion 1-G described in Example 1 of JP-A-2001-228572. Further, at least 50% of the total projected area were occupied by grains each having an equivalent circle diameter of 1.0 μm or more, a grain thickness of 0.10 μm or less, and including 30 or more dislocation lines per grain at the grain fringe portion.

(Em-RP1 to Em-RP2)

Emulsions Em-RP1 and Em-RP2 were obtained in the same manner as in Em-R, except that the compound 8 and 34 of the present invention was added, respectively, to the emulsion, after the compounds MER-1 and MER-2 were added and the temperature of the chemically sensitized emulsion was lowered to 40° C., such that the content of the compound to the silver amount in the emulsion was as shown in Table 7.

MER-1

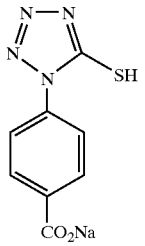

-continued

MER-2

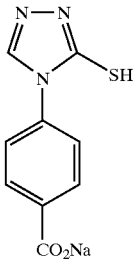

(Em-RPR1 to Em-RPR2)

Emulsions Em-RPR1 and Em-RPR2 were obtained in the same manner as in Em-RP1 and Em-RP2, respectively, except that the reducing compound $B_{11}$-1 of the present invention was added before the sensitizing dyes were added at the time of chemical sensitization, such that the content of the reducing compound to the silver amount in the emulsion was as shown in Table 7.

(Em-RPR3 to Em-RPR6)

Emulsions Em-RPR3 to Em-RPR6 were obtained in the same manner as that of Em-RP1 or Em-RP2, except that the reducing compound $B_1$-1 or $B_9$-7 of the present invention was added before the compound 8 or 34 of the present invention was added to the emulsion, such that the content of the reducing compound to the silver amount in the emulsion was as shown in Table 7.

(Em-RPR7 to Em-RPR8)

Emulsions Em-RPR7 and Em-RPR8 were obtained in the same manner as Em-RP1 and Em-RP2, respectively, except that the reducing compound $B_2$-3 of the present invention was added to the emulsions before the sensitizing dyes were added at the time of chemical sensitization, and the reducing compound $B_6$-2 of the present invention was added before the compound 8 or 34 was added, such that the contents of the reducing compounds to the silver amount in the emulsion were as shown in Table 7.

TABLE 7

Addition time and amount of the compounds according to the present invention into Em-R to Em-RPR8

| Emulsion No. | Compound of types 1 to 4 (× $10^{-6}$ mol/Ag-mol) | Reducing compound Before the addition of sensitizing dye (× $10^{-6}$ mol/Ag-mol) | After the addition of compounds MER-1 and MER-2 (× $10^{-3}$ mol/Ag-mol) |
|---|---|---|---|
| R | — | — | — |
| RP1 | Exemplified compound 8 (4.5) | — | — |
| RP2 | Exemplified compound34 (5.0) | — | — |
| RPR1 | Exemplified compound 8 (4.5) | $B_{11}$-1 (2) | — |
| RPR2 | Exemplified compound34 (5.0) | $B_{11}$-1 (2) | — |
| RPR3 | Exemplified compound 8 (4.5) | — | $B_1$-1 (1.5) |
| RPR4 | Exemplified compound34 (5.0) | — | $B_1$-1 (1.5) |
| RPR5 | Exemplified compound 8 (4.5) | — | $B_9$-7 (3.0) |

TABLE 7-continued

| Emulsion No. | Compound of types 1 to 4 ($\times 10^{-6}$ mol/Ag-mol) | Reducing compound Before the addition of sensitizing dye ($\times 10^{-6}$ mol/Ag-mol) | After the addition of compounds MER-1 and MER-2 ($\times 10^{-3}$ mol/Ag-mol) |
|---|---|---|---|
| | Addition time and amount of the compounds according to the present invention into Em-R to Em-RPR8 | | |
| RPR6 | Exemplified compound34 (5.0) | — | $B_9$-7 (3.0) |
| RPR7 | Exemplified compound 8 (4.5) | $B_2$-3 (3) | $B_6$-2 (0.5) |
| RPR8 | Exemplified compound34 (5.0) | $B_2$-3 (3) | $B_6$-2 (0.5) |

Samples 401 to 415 were prepared by coating the emulsions Em-R, Em-RP1, Em-RP2, and Em-RPR1 to Em-RPR8, respectively, in the same manner as in Example 1 (the reducing compound of the present invention to be additionally added to each emulsion is shown in Table 8).

Table 8 below shows results of measurement of the photographic properties of the samples. The speed of each sample was indicated by a relative value of a logarithm of a reciprocal of an exposure amount necessary for reaching the density of the fog density plus 0.2. (Sample 401 was regarded as a control: 100).

TABLE 8

Photographic performance of Samples 401 to 415

| Sample | Used emulsion | Reducing compound ($\times 10^{-2}$/Ag) | Photographic performance with green filter: Relative speed | Photographic performance with green filter: Fog | Photographic performance after storage under heat: Relative speed | Photographic performance after storage under heat: Fog after storage under heat | Remarks |
|---|---|---|---|---|---|---|---|
| 401 | R | — | 100 (control) | 0.22 | 97 | 0.25 | Comp. |
| 402 | RP1 | — | 120 | 0.33 | 112 | 0.44 | Comp. |
| 403 | RP2 | — | 118 | 0.35 | 108 | 0.46 | Comp. |
| 404 | RPR1 | — | 123 | 0.26 | 118 | 0.31 | Inv. |
| 405 | RPR2 | — | 122 | 0.27 | 116 | 0.32 | Inv. |
| 406 | RPR3 | — | 125 | 0.25 | 117 | 0.30 | Inv. |
| 407 | RPR4 | — | 123 | 0.23 | 119 | 0.29 | Inv. |
| 408 | RPR5 | — | 127 | 0.24 | 120 | 0.31 | Inv. |
| 409 | RPR6 | — | 124 | 0.24 | 119 | 0.30 | Inv. |
| 410 | RPR7 | — | 128 | 0.23 | 121 | 0.30 | Inv. |
| 411 | RPR8 | — | 127 | 0.22 | 120 | 0.29 | Inv. |
| 412 | RP1 | $B_1$-3 (1.3) | 122 | 0.27 | 117 | 0.32 | Inv. |
| 413 | RP2 | $B_1$-3 (1.3) | 121 | 0.26 | 115 | 0.33 | Inv. |
| 414 | RPR1 | $B_2$-2 (1.0) | 128 | 0.25 | 122 | 0.30 | Inv. |
| 415 | RPR2 | $B_2$-2 (1.0) | 127 | 0.24 | 120 | 0.29 | Inv. |

Each of the samples was subjected to hardening for 14 hours under the conditions of 40° C. and 70% RH. Thereafter, they were subjected to exposure of 1/100 sec through a gelatin filter SC-39 (a long-wavelength light transmission filter whose cut-off wavelength is 390 nm) manufactured by Fuji Photo Film Co., Ltd. and a continuous wedge, and to the same development as that in Example 1. The density of each of the developed samples was measured by a green filter to evaluate the fresh photographic performance. Further, another set of Samples 401 to 415 after the hardening was kept under the conditions of 50° C. and 80% RH for three days was exposed to light, and processed in the same manner, to obtain raw stock storability.

Table 8 shows that a combined use of at least one of the reducing compounds of the present invention, with compound 8 or 34, which is a compound represented by types (1) to (4) of the present invention, reduces the density of unexposed region (fog) as one of the fresh photographic property, and enlarges the speed enhancing effect, also with a silver halide photographic emulsion prepared by grain growth by adding silver halide grains prepared by a mixer provided outside a reactor.

Further, it also shows that, also in the case of keeping the samples under the condition of 50° C. and 80% RH for three days, the combined use of the reducing compounds of the present invention with a compound represented by types (1) to (4) of the present invention reduces the speed decrement after the raw stock storage, and attains low fog.

Furthermore, a combined use of plural kinds of the reducing compounds of the present invention with a compound represented by types (1) to (4) of the present invention further improves the unexposed part density (fog) as one of the fresh photographic property, and reduces deterioration of fog after raw stock storage.

Example 5

Silver halide emulsions Em-S, Em-SP1, Em-SP2, and Em-SPR1 to Em-SPR8 were prepared by the following methods.

(Em-S)

Silver halide emulsion Em-S was prepared by changing the method of preparing the emulsion b described in Example 1 of JP-A-2001-159799 as follows:

(1) to replace the sensitizing dyes with sensitizing dye 11; and
(2) to use compound 15 and 1,3,3-trimethyl-1-carboxymethylthiourea instead of chloroauric acid and sodium thiosulfate, respectively, in the chemical sensitization.

The emulsion Em-S contained tabular grains having an average equivalent circle diameter of 4.1 μm, coefficient of variation of equivalent circle diameter of 21%, average grain thickness of 0.090 μm, and average aspect ratio of 46, in the same manner as the emulsion b described in Example 1 of JP-A-2001-159799. Further, at least 70% of the total projected area of the emulsion were occupied by grains each having an equivalent circle diameter of 4.1 μm or more, and a grain thickness of 0.090 μm or less.

(Em-SP1 to Em-SP2)

Emulsions Em-SP1 and Em-SP2 were obtained in the same manner as in Em-S, except that the compound 3 and 13 of the present invention was added, respectively, to the emulsion, after chemical sensitization was completed and then the temperature of the emulsion was lowered to 40° C., such that the content of the compound to the silver amount in the emulsion was as shown in Table 9.

(Em-SPR1 to Em-SPR2)

Emulsions Em-SPR1 and Em-SPR2 were obtained in the same manner as that of Em-SP1 and Em-SP2, respectively, except that the reducing compound $B_1$-10 of the present invention was added to the emulsion, before sensitizing dye was added at the time of chemical sensitization, such that the content of the reducing compound to the silver amount in the emulsion was as shown in Table 9.

(Em-SPR3 to Em-SPR6)

Emulsions Em-SPR3 to Em-SPR6 were obtained in the same manner as in Em-SP1 or Em-SP2, except that the reducing compound $B_{11}$-11 or $B_1$-1 of the present invention was added before the compound 3 or 13 of the present invention was added to the emulsion, such that the content of the reducing compound to the silver amount in the emulsion was as shown in Table 9.

(Em-SPR7 to Em-SPR8)

Emulsions Em-SPR7 and Em-SPR8 were obtained in the same manner as in Em-SP1 and Em-SP2, respectively, except that the reducing compound $B_3$-12 of the present invention was added to the emulsion before the sensitizing dye was added at the time of chemical sensitization, and the reducing compound $B_3$-3 of the present invention was added before the compound 3 or 13 was added, such that the contents of the reducing compounds to the silver amount in the emulsion were as shown in Table 9.

TABLE 9

| | Addition time and amount of the compounds according to the present invention into Em-S to Em-SPR8 | | |
|---|---|---|---|
| Emulsion No. | Compound of types 1 to 4 (× $10^{-6}$ mol/Ag-mol) | Reducing compound Before the addition of sensitizing dye (× $10^{-6}$ mol/Ag-mol) | After the addition of compounds MER-1 and MER-2 (× $10^{-3}$ mol/Ag-mol) |
| S | — | — | — |
| SP1 | Exemplified compound 3 (4.0) | — | — |
| SP2 | Exemplified compound13 (2.8) | — | — |
| SPR1 | Exemplified compound 3 (4.0) | $B_1$-10 (3) | — |
| SPR2 | Exemplified compound13 (2.8) | $B_1$-10 (3) | — |
| SPR3 | Exemplified compound 3 (4.0) | — | $B_{11}$-11 (1.2) |
| SPR4 | Exemplified compound13 (2.8) | — | $B_{11}$-11 (1.2) |
| SPR5 | Exemplified compound 3 (4.0) | — | $B_1$-1 (2.0) |
| SPR6 | Exemplified compound13 (2.8) | — | $B_1$-1 (2.0) |
| SPR7 | Exemplified compound 3 (4.0) | $B_3$-12 (1) | $B_3$-3 (0.8) |
| SPR8 | Exemplified compound13 (2.8) | $B_3$-12 (1) | $B_3$-3 (0.8) |

Samples 501 to 515 were prepared by coating the emulsions Em-S, Em-SP1, Em-SP2, and Em-SPR1 to Em-SPR8 in the same manner as in Example 1 (the reducing compound of the present invention to be additionally added to each emulsion is shown in Table 10).

Each of the samples was subjected to hardening for 14 hours under the conditions of 40° C. and 70% RH. Thereafter, they were subjected to exposure of 1/100 sec through a gelatin filter SC-39 (a long-wavelength light transmission filter whose cut-off wavelength is 390 nm)

manufactured by Fuji Photo Film Co., Ltd. and a continuous wedge, and to the same development as that in Example 1. The density of each of the developed samples was measured with a green filter to evaluate the fresh photographic performance. Further, another set of Samples 401 to 415 after the hardening was kept under the conditions of 50° C. and 80% RH for three days, and processed in the same manner, to obtain raw stock storability.

Table 10 below shows results of measurement of the photographic properties of the samples. The speed of each sample was indicated by a relative value of a logarithm of a reciprocal of an exposure amount necessary for reaching the density of the fog density plus 0.2. (Sample 501 was regarded as a control: 100).

TABLE 10

Photographic performance of Samples 501 to 515

| Sample | Used emulsion | Added compounds ($\times 10^{-2}$ mol/Ag-mol) | Photographic performance with green filter: Relative speed | Photographic performance with green filter: Fog | Photographic performance after storage under heat: Relative speed | Photographic performance after storage under heat: Fog after storage under heat | Remarks |
|---|---|---|---|---|---|---|---|
| 501 | S | — | 100 (control) | 0.22 | 97 | 0.25 | Comp. |
| 502 | SP1 | — | 123 | 0.33 | 117 | 0.47 | Comp. |
| 503 | SP2 | — | 118 | 0.30 | 113 | 0.43 | Comp. |
| 504 | SPR1 | — | 122 | 0.29 | 116 | 0.35 | Inv. |
| 505 | SPR2 | — | 123 | 0.28 | 117 | 0.34 | Inv. |
| 506 | SPR3 | — | 125 | 0.29 | 119 | 0.36 | Inv. |
| 507 | SPR4 | — | 124 | 0.28 | 118 | 0.34 | Inv. |
| 508 | SPR5 | — | 126 | 0.26 | 119 | 0.30 | Inv. |
| 509 | SPR6 | — | 123 | 0.23 | 117 | 0.28 | Inv. |
| 510 | SPR7 | — | 127 | 0.23 | 119 | 0.30 | Inv. |
| 511 | SPR8 | — | 129 | 0.22 | 121 | 0.29 | Inv. |
| 512 | SP1 | $B_3$-7 (1.0) | 125 | 0.27 | 118 | 0.33 | Inv. |
| 513 | SP2 | $B_3$-7 (1.0) | 124 | 0.26 | 117 | 0.34 | Inv. |
| 514 | SPR1 | $B_2$-4 (1.0) | 129 | 0.24 | 122 | 0.29 | Inv. |
| 515 | SPR2 | $B_2$-4 (1.0) | 128 | 0.24 | 121 | 0.28 | Inv. |

Table 10 shows that a combined of at least one of the reducing compounds of the present invention, with compound 3 or 13, which is a compound represented by types (1) to (4) of the present invention, reduces the density of unexposed region (fog) as one of the fresh photographic property and enlarges the speed enhancing effect, also in a silver halide photographic emulsion prepared by supplying iodide ions by adding silver iodide fine grains prepared in a mixer provided outside a reactor.

Further, it also shows that, also in the case of keeping the samples under the condition of 50° C. and 80% RH for three days, the combined use of the reducing compounds of the present invention with a compound represented by types (1) to (4) of the present invention reduces the speed decrement after the raw stock storage, and attains low fog.

In addition, a combined use of plural kinds of the reducing compounds of the present invention with a compound represented by types (1) to (4) of the present invention further improves the unexposed part density (fog) as one of the fresh photographic property, and reduces deterioration of fog after raw stock storage.

Example 6

Silver halide emulsions Em-T, Em-TP1, Em-TP2, and Em-TPR1 to Em-TPR8 were prepared by the following methods.

(Em-T)

Emulsion Em-T was prepared by making the following change to an emulsion obtained by epitaxial precipitation on the host emulsion e described in Example 1 of JP-A-2001-235821 by the epitaxial precipitation method ③ described in the Example 1 of the same patent document:

(1) to replace the sensitizing dyes used in the epitaxial precipitation with sensitizing dyes 11 and 23.

The emulsion Em-T contained host grains similar to those of the emulsion e described in Example 1 of JP-A-2001-235821, that is, tabular grains having an average equivalent circle diameter of 4.2 μm, coefficient of variation of the equivalent circle diameter of 19%, average grain thickness of 0.062 μm, and average aspect ratio of 62, in the same manner as the emulsion e. Further, at least 90% of the total projected area of the emulsion was occupied by hexagonal tabular grains each having a ratio of the length of the longest side to the length of the shortest side of 1.4:1 or less.

An average silver iodide content of the epitaxially precipitated emulsion was 4.5 mol %, and average silver chloride content was 1.2 mol %.

(Em-TP1 to Em-TP2)

Emulsions Em-TP1 and Em-TP2 were obtained in the same manner as in Em-T, except that the compound 8 or 46 of the present invention was added to the emulsion, after chemical sensitization was completed and the temperature of the emulsion was lowered to 40° C., such that the content of the compound to the silver amount in the emulsion was as shown in Table 11.

(Em-TPR1 to Em-TPR2)

Emulsions Em-TPR1 and Em-TPR2 were obtained in the same manner as in Em-TP1 and Em-TP2, respectively, except that the reducing compound $B_{11}$-1 of the present invention was added to the emulsion, before sensitizing dyes were added at the time of chemical sensitization, such that the content of the reducing compound to the silver amount in the emulsion was as shown in Table 11.

(Em-TPR3 to -TPR6)

Emulsions Em-TPR3 to Em-TPR6 were obtained in the same manner as in Em-TP1 or Em-TP2, except that the reducing compound $B_1$-1 or $B_6$-2 of the present invention was added before the compound 8 or 46 of the present invention was added to the emulsion, such that the content of the reducing compound to the silver amount in the emulsion was as shown in Table 11.

(Em-TPR7 to Em-TPR8)

Emulsions Em-TPR7 and Em-TPR8 were obtained in the same manner as in Em-TP1 and Em-TP2, respectively, except that the reducing compound $B_6$-6 of the present invention was added to the emulsion before the sensitizing dyes were added at the time of chemical sensitization, and the reducing compound $B_6$-2 of the present invention was added before the compound 8 or 46 was added, such that the contents of the reducing compounds to the silver amount in the emulsion were as shown in Table 11.

TABLE 11

Addition time and amount of the compounds according to the present invention into Em-T to Em-TPR8

| Emulsion No. | Compound of types 1 to 4 ($\times 10^{-6}$ mol/Ag-mol) | Reducing compound Before the addition of sensitizing dye ($\times 10^{-6}$ mol/Ag-mol) | After the addition of compounds MER-1 and MER-2 ($\times 10^{-3}$ mol/Ag-mol) |
|---|---|---|---|
| T | — | — | — |
| TP1 | Exemplified compound 8 (5.5) | — | — |
| TP2 | Exemplified compound46(7.0) | — | — |
| TPR1 | Exemplified compound 8 (5.5) | $B_{11}$-1 (2) | — |
| TPR2 | Exemplified compound46(7.0) | $B_{11}$-1 (2) | — |
| TPR3 | Exemplified compound 8 (5.5) | — | $B_1$-1 (2.0) |

TABLE 11-continued

Addition time and amount of the compounds according to the present invention into Em-T to Em-TPR8

| Emulsion No. | Compound of types 1 to 4 ($\times 10^{-6}$ mol/Ag-mol) | Reducing compound Before the addition of sensitizing dye ($\times 10^{-6}$ mol/Ag-mol) | After the addition of compounds MER-1 and MER-2 ($\times 10^{-3}$ mol/Ag-mol) |
|---|---|---|---|
| TPR4 | Exemplified compound46(7.0) | — | $B_1$-1 (2.0) |
| TPR5 | Exemplified compound 8 (5.5) | — | $B_6$-2 (0.7) (0.7) |
| TPR6 | Exemplified compound46(7.0) | — | $B_6$-2 (0.7) |
| TPR7 | Exemplified compound 8 (5.5) | $B_6$-6 (1) | $B_6$-2 (0.3) |
| TPR8 | Exemplified compound46 (7.0) | $B_6$-6 (1) | $B_6$-2 (0.3) |

Samples 601 to 617 were prepared by coating the emulsions Em-T, Em-TP1, Em-TP2, and Em-TPR1 to Em-TPR8 in the same manner as that in Example 1 (the reducing compound of the present invention to be additionally added to each emulsion is shown in Table 12).

Each of the samples was subjected to hardening for 14 hours under the conditions of 40° C. and 70% RH. Thereafter, they were subjected to exposure of 1/100 sec through a gelatin filter SC-39 (a long-wavelength light transmission filter whose cut-off wavelength is 390 nm) manufactured by Fuji Photo Film Co., Ltd. and a continuous wedge, and to the same development as that in Example 1. The density of each of the developed samples was measured with a green filter to evaluate the fresh photographic performance. Further, another set of Samples 601 to 617 after the hardening was kept under the conditions of 50° C. and 80% RH for three days was subjected to light and processed in the same manner, to obtain raw stock storability.

Table 12 below shows results of measurement of the photographic properties of the samples. The speed of each sample was indicated by a relative value of a logarithm of a reciprocal of an exposure amount necessary for reaching the density of the fog density plus 0.2. (Sample 601 was regarded as a control: 100).

TABLE 12

Photographic performance of Samples 601 to 617

| Sample | Used emulsion | Added compounds ($\times 10^{-2}$ mol/Ag-mol) | Photographic performance with green filter: Relative speed | Photographic performance with green filter: Fog | Photographic performance after storage under heat: Relative speed | Photographic performance after storage under heat: Sample | Used emulsion |
|---|---|---|---|---|---|---|---|
| 601 | T | — | 100 (control) | 0.22 | 97 | 0.25 | Comp. |

TABLE 12-continued

Photographic performance of Samples 601 to 617

| Sample | Used emulsion | Added compounds ($\times 10^{-2}$ mol/Ag-mol) | Photographic performance with green filter: Relative speed | Photographic performance with green filter: Fog | Photographic performance after storage under heat: Relative speed | Photographic performance after storage under heat: Sample | Used emulsion |
|---|---|---|---|---|---|---|---|
| 602 | TP1 | — | 124 | 0.34 | 116 | 0.44 | Comp. |
| 603 | TP2 | — | 122 | 0.33 | 114 | 0.42 | Comp. |
| 604 | TPR1 | — | 127 | 0.26 | 122 | 0.33 | Inv. |
| 605 | TPR2 | — | 127 | 0.27 | 121 | 0.34 | Inv. |
| 606 | TPR3 | — | 128 | 0.25 | 122 | 0.30 | Inv. |
| 607 | TPR4 | — | 126 | 0.26 | 120 | 0.32 | Inv. |
| 608 | TPR5 | — | 127 | 0.25 | 121 | 0.31 | Inv. |
| 609 | TPR6 | — | 125 | 0.24 | 119 | 0.29 | Inv. |
| 610 | TPR7 | — | 130 | 0.24 | 123 | 0.31 | Inv. |
| 611 | TPR8 | — | 129 | 0.23 | 121 | 0.30 | Inv. |
| 612 | TP1 | $B_2$-2 (1.3) | 126 | 0.26 | 120 | 0.32 | Inv. |
| 613 | TP2 | $B_2$-2 (1.3) | 125 | 0.27 | 119 | 0.33 | Inv. |
| 614 | TPR1 | $B_2$-2 (1.0) | 130 | 0.26 | 124 | 0.31 | Inv. |
| 615 | TPR2 | $B_2$-2 (1.0) | 129 | 0.25 | 122 | 0.30 | Inv. |
| 616 | TPR7 | $B_2$-2 (1.0) | 132 | 0.23 | 124 | 0.29 | Inv. |
| 617 | TPR8 | $B_2$-2 (1.0) | 131 | 0.24 | 124 | 0.30 | Inv. |

Table 12 shows that the a combined of at least one of the reducing compounds of the present invention, with compound 8 or 46, which is a compound represented by types (1) to (4) of the present invention, reduces the density of unexposed region (fog) as one of the fresh photographic property, and enlarges the speed enhancing effect, also with a silver halide photographic emulsion containing tabular grains with epitaxial junction.

Further, it also shows that, also in the case of keeping the samples under the condition of 50° C. and 80% RH for three days, the combined use of the reducing compounds of the present invention with a compound represented by types (1) to (4) of the present invention reduces the speed decrement after the raw stock storage, and attains low fog.

Furthermore, a combined use of plural kinds of the reducing compounds of the present invention with a compound represented by types (1) to (4) of the present invention further improves the unexposed part density (fog) as one of the fresh photographic property, and reduces deterioration of fog after raw stock storage.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photosensitive material containing at least one compound selected from the following compounds of Types 1 to 4, and at least one reducing compound:

(Type 1) a compound capable of undergoing a one-electron oxidation to thereby form a one-electron oxidation product thereof, wherein the one-electron oxidation product is capable of releasing further two or more electrons accompanying a subsequent bond cleavage reaction;

(Type 2) a compound capable of undergoing a one-electron oxidation to thereby form a one-electron oxidation product thereof, wherein the one-electron oxidation product is capable of releasing further one electron accompanying a subsequent bond cleavage reaction, and the compound having, in its molecule, two or more groups adsorptive to silver halide;

(Type 3) a compound capable of undergoing a one-electron oxidation to thereby form a one-electron oxidation product thereof, wherein the one-electron oxidation product is capable of releasing further one or more electrons after going through a subsequent bond forming process; and (Type 4) a compound capable of undergoing a one-electron oxidation to thereby form a one-electron oxidation product thereof, wherein the one-electron oxidation product is capable of releasing further one or more electrons after going through a subsequent intramolecular ring cleavage reaction, wherein the at least one reducing compound has an oxidation potential in the range of about −0.3V to 1.0V.

2. The silver halide photosensitive material according to claim 1, wherein the compounds of Types 1 to 4 are represented by the following formula (A), formula (B), formula (1), formula (2), formula (3), formula (C), formula (D), formula (E), or formula (F):

(A)

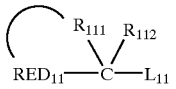

(B)

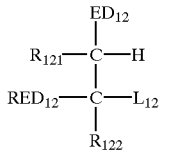

(1)

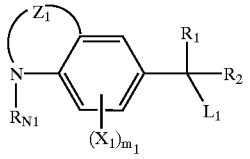

(2)

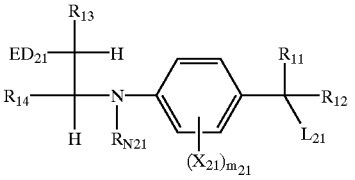

(3)

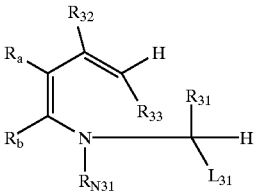

(C)

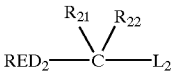

(D)

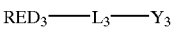

(E)

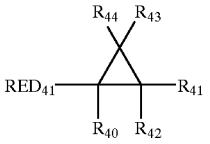

(F)

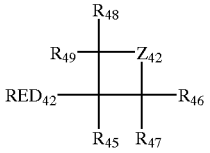

wherein in the general formula (A), $RED_{11}$ represents a one-electron oxidizable reducing group; $L_{11}$ represents a split-off group; $R_{112}$ represents a hydrogen atom or substituent; and $R_{111}$ represents a nonmetallic atomic group capable of forming, together with carbon atom (C) and $RED_{11}$, a cyclic structure corresponding to a tetrahydro form, hexahydro form or octahydro form of a 5-membered or 6-membered aromatic ring;

in the general formula (B), $RED_{12}$ represents a one-electron oxidizable reducing group; $L_{12}$ represents a split-off group; each of $R_{121}$ and $R_{122}$ represents a hydrogen atom or substituent; and $ED_{12}$ represents an electron-donating group, wherein $R_{121}$ and $RED_{12}$, or $R_{121}$ and $R_{122}$, or $ED_{12}$ and $RED_{12}$ may be bonded with each other to thereby form a cyclic structure;

in the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group;

in the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent capable of substituting on the benzene ring; $m_{21}$ is an integer of 0 to 3; and $L_{21}$ represents a split-off group, wherein any two of $R_{N21}$, $R_{13}$, $R_{14}$, $X_{21}$ and $ED_{21}$ may be bonded with each other to thereby form a cyclic structure;

in the general formula (3), each of $R_{32}$, $R_{33}$, $R_{31}$, $R_{N31}$, $R_a$ and $R_b$ represents a hydrogen atom or substituent; and $L_{31}$ represents a split-off group, provided that, when $R_{N31}$ represents a group other than an aryl group, $R_a$ and $R_b$ are bonded to each other to thereby form an aromatic ring;

in the general formula (C), $RED_2$ has the same meaning as $RED_{12}$ of the general formula (B); $L_2$ has the same meaning as $L_{11}$ of the general formula (A); each of $R_{21}$ and $R_{22}$ represents a hydrogen atom or substituent; and $RED_2$ and $R_{21}$ may be bonded with each other to thereby form a cyclic structure, wherein the compound represented by the general formula (C) is a compound having, in its molecule, two or more adsorptive groups acting on silver halides;

in the general formula (D), $RED_3$ has the same meaning as $RED_{12}$ of the general formula (B); $Y_3$ represents an organic group having a carbon-carbon double bond moiety, carbon-carbon triple bond moiety, aromatic moiety or benzo-condensed nonaromatic heterocyclic group, and capable of reacting with a one-electron oxidation product formed as a result of a one-electron oxidation of $RED_3$ to thereby form a new bond; and $L_3$ represents a linking group which links between $RED_3$ and $Y_3$;

in the general formula (E), each of $RED_{41}$ has the same meaning as $RED_{12}$ of the general formula (B); and each of $R_{40}$ to $R_{44}$ represents a hydrogen atom or substituent; and in the general formula (F), $RED_{42}$ has the same meaning as $RED_{12}$ of the general formula (B); $R_{45}$ to $R_{49}$ represents a hydrogen atom or substituent; and $Z_{42}$ represents $—C_{R420}R_{421}—$, $—NR_{423}—$ or —O—, wherein each of $R_{420}$ and $R_{421}$ represents a hydrogen atom or substituent; and $R_{423}$ represents a hydrogen atom, alkyl group, aryl group or heterocyclic group.

3. The silver halide photosensitive material according to claim 1, wherein the compounds of Types 1 to 4 are capable of undergoing one-electron oxidation that is triggered by an exposure.

4. The silver halide photosensitive material according to claim 1, wherein each of the compounds of Types 1, 3 and 4 is a compound having, in its molecule, at least one group adsorptive to silver halide or at least one partial structure of a spectral sensitizing dye.

5. The silver halide photosensitive material according to claim 1, wherein the group adsorptive to silver halide of the compound of Type 2, is a mercapto group.

6. The silver halide photosensitive material according to claim 5, wherein the compound having, in its molecule, at least one group adsorptive to silver halide is a compound having, in its molecule and as a partial structure, two or more mercapto groups.

7. A silver halide photosensitive material containing at least one compound selected from the following compounds of Types 1 to 4, and at least one reducing compound:

(Type 1) a compound capable of undergoing a one-electron oxidation to thereby form a one-electron oxidation product thereof, wherein the one-electron oxidation product is capable of releasing further two or more electrons accompanying a subsequent bond cleavage reaction;

(Type 2) a compound capable of undergoing a one-electron oxidation to thereby form a one-electron oxidation product thereof, wherein the one-electron oxidation product is capable of releasing further one electron accompanying a subsequent bond cleavage reaction, and the compound having, in its molecule, two or more groups absorptive to silver halide;

(Type 3) a compound capable of undergoing a one-electron oxidation to thereby form a one-electron oxidation product thereof, wherein the one-electron oxidation product is capable of releasing further one or more electrons after going through a subsequent bond forming process; and (Type 4) a compound capable of undergoing a one-electron oxidation to thereby form a one-electron oxidation product thereof, wherein the one-electron oxidation product is capable of releasing further one or more electrons after going through a subsequent intramolecular ring cleavage reaction, wherein the reducing compound is a compound selected from hydroxyamines; hydroxamic acids; hydroxyureas; hydroxyurethanes; hydroxysemicarbazides; phenols; phenidons; hydrazines and reductons.

8. A silver halide photosensitive material containing at least one compound selected from the following compounds of Types 1 to 4, and at least one reducing compound:

(Type 1) a compound capable of undergoing a one-electron oxidation to thereby form a one-electron oxidation product thereof, wherein the one-electron oxidation product is capable of releasing further two or more electrons accompanying a subsequent bond cleavage reaction;

(Type 2) a compound capable of undergoing a one-electron oxidation to thereby form a one-electron oxidation product thereof, wherein the one-electron oxidation product is capable of releasing further one electrons accompanying a subsequent bond cleavage reaction, and the compound having, in its molecule, two or more groups absorptive to silver halide;

(Type 3) a compound capable of undergoing a one-electron oxidation to thereby form a one-electron oxidation product thereof, wherein the one-electron oxidation product is capable of releasing further one or more electrons after going through a subsequent bond forming process; and (Type 4) a compound capable of undergoing a one-electron oxidation to thereby form a one-electron oxidation product thereof, wherein the one-electron oxidation product is capable of releasing further one or more electrons after going through a subsequent intramolecular ring cleavage reaction, wherein, the reducing compounds described are classified into three classes consisting of:

a class of compounds having an adsorptive group, a class of compounds having a ballast group, and a class of diffusive compounds having none of the both adsorptive and ballast groups, compounds of two or three classes are selected from the three classes and used in the photosensitive material.

9. The silver halide photosensitive material according to claim 1, wherein the silver halide photosensitive material comprises tabular silver halide grains having an average aspect ratio of 5 to 100.

10. The silver halide photosensitive material according to claim 2, wherein $R_{111}$ forms, together with carbon atom (C) and $RED_{11}$, a cyclic structure corresponding to a tetrahydro form, hexahydro form or octahydro form of a 5-membered or 6-membered aromatic heterocyclic ring.

11. The silver halide photosensitive material according to claim 7, wherein the reducing compound is a compound selected from chroman-6-ols, hydroquinones, catechols, resorcinols, and bisphenols.

12. The silver halide photosensitive material according to claim 7, wherein the reducing compound is a reductonderivative.

* * * * *

UNITED STATES PATENT AND TRADEMARK OFFICE

CERTIFICATE OF CORRECTION

PATENT NO. : 6,855,488 B2
DATED : February 15, 2005
INVENTOR(S) : Kohzaburoh Yamada et al.

It is certified that error appears in the above-identified patent and that said Letters Patent is hereby corrected as shown below:

Title page,
Item [75], Inventors, delete "Kohzaburch Yamada" and insert -- Kohzaburoh Yamada --.
Item [*] Notice, insert the following -- This Patent is subject to a terminal disclaimer --.

Signed and Sealed this

Sixth Day of September, 2005

JON W. DUDAS
*Director of the United States Patent and Trademark Office*